US005896143A

United States Patent [19]

Matsui et al.

[11] Patent Number: 5,896,143

[45] Date of Patent: Apr. 20, 1999

[54] INK JET RECORDING APPARATUS

[75] Inventors: Shinya Matsui, Tokyo; Shigeru Yoshimura, Yokohama; Noboru Koumura, Narashino; Shinji Kanemitsu, Yokohama; Hiroshi Fukui, Yokosuka; Hiromitsu Hirabayashi; Makoto Kashimura, both of Yokohama; Shigeyasu Nagoshi; Masafumi Wataya, both of Kawasaki; Toshiyuki Onishi, Yokohama; Noribumi Koitabashi, Yokohama; Fumiyuki Mikami, Yokohama; Hitoshi Sugimoto, Kawasaki; Yasuhiro Unosawa; Miyuki Matsubara, both of Tokyo; Kazuhiko Shinoda, Nagahama; Fumihiro Gotoh; Masaru Sato, both of Yokohama; Hisashi Morioka, Kawagoe; Masaya Uetuki, Kawasaki, all of Japan

[73] Assignee: Canon Kabushiki Kaisha, Tokyo, Japan

[21] Appl. No.: 08/822,764

[22] Filed: Mar. 24, 1997

Related U.S. Application Data

[63] Continuation of application No. 08/113,814, Aug. 31, 1993, abandoned.

[30] Foreign Application Priority Data

| | | | |
|---|---|---|---|
| Sep. 3, 1992 | [JP] | Japan | 4-260806 |
| Sep. 10, 1992 | [JP] | Japan | 4-268212 |
| Dec. 25, 1992 | [JP] | Japan | 4-358298 |

[51] Int. Cl.[6] ..... B41J 2/165

[52] U.S. Cl. ..... 347/24; 347/30; 347/33; 347/35

[58] Field of Search ..... 347/23, 29, 30, 347/32, 33, 24, 92, 35

[56] References Cited

U.S. PATENT DOCUMENTS

| | | | |
|---|---|---|---|
| 4,175,266 | 11/1979 | Nakano et al. | 400/126 |
| 4,177,471 | 12/1979 | Mitchell | 346/140 R |
| 4,313,124 | 1/1982 | Hara | 346/140 R |

(List continued on next page.)

FOREIGN PATENT DOCUMENTS

| | | | |
|---|---|---|---|
| 0120320 | 10/1984 | European Pat. Off. . | |
| 0306591 | 3/1989 | European Pat. Off. . | |
| 0430077 | 6/1991 | European Pat. Off. . | |
| 0443808 | 8/1991 | European Pat. Off. . | |
| 0447262 | 9/1991 | European Pat. Off. . | |
| 0449324 | 10/1991 | European Pat. Off. . | |
| 0471374 | 2/1992 | European Pat. Off. . | |
| 0501800 | 9/1992 | European Pat. Off. . | |
| 54-56847 | 5/1979 | Japan . | |
| 54-29791 | 9/1979 | Japan . | |
| 54-29792 | 9/1979 | Japan . | |
| 58-194554 | 11/1983 | Japan | 347/24 |
| 59-123670 | 7/1984 | Japan . | |
| 59-138461 | 8/1984 | Japan . | |
| 60-71260 | 4/1985 | Japan . | |
| 60-151059 | 8/1985 | Japan . | |
| 60-199662 | 10/1985 | Japan | 347/43 |
| 63-028672 | 2/1988 | Japan . | |
| 64-075250 | 3/1989 | Japan . | |
| 1-264853 | 10/1989 | Japan | 347/24 |
| 2-273243 | 11/1990 | Japan | 347/30 |
| 3-130160 | 6/1991 | Japan | 347/33 |
| 3-213351 | 9/1991 | Japan | B41J 2/175 |
| 4-344258 | 11/1992 | Japan | 347/24 |

*Primary Examiner*—Joseph W. Hartary
*Attorney, Agent, or Firm*—Fitzpatrick, Cella, Harper & Scinto

[57] ABSTRACT

A color ink jet printing apparatus including a single suction mechanism having a capping member designed to cap any one of the printheads of the apparatus and carrying out a suction recovery of that capped printhead. A plurality of additional caps which are not associated with the suction mechanism are provided for capping the printhead. Various printing moving schemes are devised to provide quick and efficient positioning of selected printheads opposing the suction mechanism to speedily service that printhead.

36 Claims, 36 Drawing Sheets

U.S. PATENT DOCUMENTS

| | | | |
|---|---|---|---|
| 4,345,262 | 8/1982 | Shirato et al. | 346/140 R |
| 4,361,845 | 11/1982 | Smith | 347/90 |
| 4,459,600 | 7/1984 | Sato et al. | 346/140 R |
| 4,463,359 | 7/1984 | Ayata et al. | 346/1.1 |
| 4,528,576 | 7/1985 | Koumura et al. | 347/43 |
| 4,558,333 | 12/1985 | Sugitani et al. | 346/140 R |
| 4,567,494 | 1/1986 | Taylor | 347/30 |
| 4,661,003 | 4/1987 | Okamori | 400/216.1 |
| 4,723,129 | 2/1988 | Endo et al. | 346/1.1 |
| 4,739,340 | 4/1988 | Terasawa | 347/30 |
| 4,740,796 | 4/1988 | Endo et al. | 346/1.1 |
| 4,745,414 | 5/1988 | Okamura et al. | 347/30 |
| 4,751,527 | 6/1988 | Oda | 347/91 |
| 4,819,012 | 4/1989 | Kiyohara et al. | 347/30 |
| 4,853,717 | 8/1989 | Harmon et al. | 400/126 |
| 4,874,262 | 10/1989 | Yokoi et al. | 400/216.1 |
| 4,893,138 | 1/1990 | Terasawa et al. | 347/30 |
| 4,931,955 | 6/1990 | Okabayashi et al. | 400/126 |
| 4,947,190 | 8/1990 | Mizusawa et al. | 347/33 |
| 4,959,660 | 9/1990 | Suzuki et al. | 347/34 |
| 4,965,596 | 10/1990 | Nagoshi et al. | 347/36 |
| 4,967,204 | 10/1990 | Terasawa et al. | 346/1.1 |
| 4,979,835 | 12/1990 | Beck et al. | 400/59 |
| 5,018,884 | 5/1991 | Hirano et al. | 400/126 |
| 5,032,034 | 7/1991 | Bischof et al. | 400/660 |
| 5,040,000 | 8/1991 | Yokoi | 347/30 |
| 5,081,472 | 1/1992 | Fisher | 400/126 |
| 5,092,690 | 3/1992 | Grimm et al. | 346/75 |
| 5,148,203 | 9/1992 | Hirano | 346/75 |
| 5,153,613 | 10/1992 | Yamaguchi et al. | 347/30 |
| 5,160,942 | 11/1992 | Omata et al. | 347/172 |
| 5,164,748 | 11/1992 | Katayanagi et al. | 347/30 |
| 5,166,708 | 11/1992 | Hirano et al. | 347/24 |
| 5,225,852 | 7/1993 | Uchida et al. | 400/708 |
| 5,262,802 | 11/1993 | Karita et al. | 347/87 |
| 5,266,974 | 11/1993 | Koitabashi et al. | 347/33 |
| 5,270,738 | 12/1993 | Takahashi et al. | 347/29 |
| 5,363,132 | 11/1994 | Ikkatai | 349/8 |
| 5,480,243 | 1/1996 | Kikkawa et al. | 400/354 |

INK JET RECORDING APPARATUS

This application is a continuation of application Ser. No. 08/113,814 filed Aug. 31, 1993 now abandoned.

BACKGROUND OF THE INVENTION

1. Field of the Invention

The present invention relates to an ink jet recording apparatus for recording information by discharging ink from recording means to a recording member.

2. Related Background Art

A recording apparatuses, each of which is used as an output apparatus for a recording apparatus having functions of a printer, a copying machine and a facsimile machine and the like or combined-type electronic equipment including a computer and a word processor and a work station, are arranged so that an image is recorded on a recording member (a recording medium), such as paper or a thin plastic sheet, in accordance with image information (character information included). The recording apparatuses of the foregoing type are categorized into ink jet recording apparatuses, wire dot recording apparatuses, thermal recording apparatuses and laser beam recording apparatuses and the like depending upon the recording method.

A serial-type recording apparatus adapted to a serial scan method, in which main scanning is performed in a direction that intersects a direction (a sub-scanning direction) in which a recording member is conveyed, is so arranged that information is recorded on the entire surface of the recording member by repeating the following steps of: setting the recording medium to a predetermined recording position; using recording means mounted on a carriage, which is moved along the recording member, to record (main-scan) an image until information for line is recorded; conveying paper by a predetermined quantity (conveyance of recording member); and image for the next line is recorded (main-scanned) on the recording member which has been again stopped. A line-type recording apparatus which records information by one sub-scanning in the conveyance direction of the recording member is so arranged that information is recorded on the entire surface of the recording member by the following steps of: setting the recording medium to a predetermined recording position; and continuously conveying (pitch conveying) the paper while collectively recording information for one line.

Among the foregoing various recording apparatuses, a recording apparatus (an ink jet recording apparatus) adapted to the ink jet recording method records information by discharging ink from recording means (a recording head) to a recording member and exhibits advantages that recording means can be compactized, a precise and excellent image can be recorded at high speed, the image can be recorded on plain paper without special treatment, the running cost can be reduced, noise can be satisfactorily eliminated because of the employed non-impact method, and a color image can be easily recorded by making use of multiple-color inks. In particular, a line-type recording apparatus using a full-multiple-type recording means having a multiplicity of discharge ports in the widthwise direction of the paper enables the recording operation to be performed at a higher speed.

Particularly, the ink-jet recording means (recording head) making use of heat energy to discharge ink is able to easily comprise fluid passage (configuration of discharge ports) formed precisely by forming an electrothermal converter, electrodes, the fluidpassage walls and a ceiling plate on the substrate by semiconductor manufacturing processes comprising the etching, evaporating and sputtering operations. Therefore, the size can be further reduced. Further, the recent trend of using recording members made of various materials arises a need to use a thin paper sheet and a fabric paper sheet (paper having filing punch apertures, perforated paper and paper formed into an arbitrary shape) as well as the paper and the thin resin sheet (OHP and others) which are conventional recording members.

The ink jet recording apparatus comprises a cap for capping the discharge port for use at the time of a suction recovery operation for overcoming defective discharge by sucking ink from the discharge port and for preventing the problem that the ink is dried at the discharge port. If bubbles, that cannot be eliminated at the time of the ink discharge, are excessively introduced into the discharge port or if the volume of the bubbles has been enlarged excessively, there sometimes arises a problem that the discharge port is undesirably clogged and, accordingly, the ink passage cannot be maintained. In order to eliminate the bubbles, the foregoing suction recovery operation is usually performed.

The color ink jet recording apparatus having a plurality of recording heads, for example, four-color-recording heads composed of black, cyan, magenta and yellow recording heads comprises a suction recovery system which includes a plurality (four) of caps and a plurality (four) of suction pumps connected to the caps, or another system which includes a plurality (four) of caps and one suction pump connected to the caps. As a result, all recording heads can be operate at the time timing to recover the suction.

Further, the ink jet recording apparatus encounters a problem of deterioration of the image quality due to the deviation of the ink discharging direction if ink undesirably adheres to the surface (the surface in which the discharge ports are disposed) of the discharge port of the recording head (recording means). That is, since the ink jet recording method is so arranged that ink droplet is discharged from the recording head on to the paper or the OHP film to record an image, fine flowing ink droplets generated in addition to the discharged main ink droplet or ink droplets allowed to reach and rebound from the recording member adhere to the surface of the discharge port causing the surface to be wetted. If the adhered ink gathers in the vicinity of the discharge port, problems arise in that the ink is discharged into an undesirable direction (deviation) or the ink discharge cannot be performed (no discharge).

The ink jet recording apparatus comprises means for overcoming the foregoing problem occurring due to the use of a fluid (the ink) as the recording agent to restore or maintain the surface of the discharge port at a satisfactory state, the means being restoring means (a restoring system) for the recording head. As means for refreshing the surface of the discharge port and preventing the deviation of the discharging direction, there has been used a wiping member arranged to be contact with the surface of the discharge port to enable the two elements to be moved mutually so as to wipe out (perform wiping) foreign matters such as ink droplets.

The undesirable ink droplet caused to adhere to the surface of the discharge port is also generated from ink mist generated at the time of the ink discharge to be performed at the time of the recording operation and rebound of ink from the paper. The mutual approaching movement performed by the recording head and the paper during the recording operation sometimes causes foreign matters such as paper dust to adhere to the surface of the discharge port. Therefore, the ink droplet and the foreign matter present on the surface of the discharge port are usually removed by the foregoing wiping means during or after the recording operation.

The wiping means is usually structured in such a manner that a blade made of an elastic material such as rubber wipes out the surface of the discharge port to remove the undesirable ink droplet. However, the performance of the foregoing wiping means deteriorates due to use for a long time of a temporary increase in the ink to be wiped out. Therefore, the discharging performance of the wiping means cannot easily be maintained. What is worse, ink deposited on the blade serving as the wiping means and having increased viscosity or a foreign matter is shifted reversely to the surface of the discharge port, causing a problem to occur in that the discharge cannot be performed due to the deviation of the discharging direction and embedding of the foreign matter.

Another problem sometimes arises when the surface of the discharge port of the recording head is wiped out in that a portion of the wiped ink flies in the recording apparatus due to the elasticity of the blade and the portion inside the apparatus is contaminated. What is worse, a major portion of the ink which has not flied and which is left on the blade or foreign matters such as paper dust are allowed to adhere to the blade as it is. The evaporation of the ink left on the blade increases the viscosity of the ink. Further, the foreign matter, such as the paper dust, is allowed to firmly adhere and deposits, the foreign matter being then inversely moved to the surface of the discharge port. As a result, the problems of the no-discharge and the directional deviation sometimes arise.

If two or more recording heads (the recording means) are used simultaneously and inks of a plurality of colors are used to record color images, the ink moved to the blade at the first wiping operation is mixed with a different-color ink of the recording head at the time of wiping out the recording head for the different color. In this case, the quality of the image sometimes deteriorates. Further, in the color ink jet recording apparatus, wiping of a plurality of recording heads by using one blade causes the quantity of ink allowed to adhere to the blade to be increased. Therefore, the adverse influence of the contamination of the blade becomes critical. Although it might therefore be feasible to employ a structure in which an exclusive blade is provided for each recording head, other problem arises in that the cost cannot be reduced and an excessively large installation space is required.

In order to prevent the foregoing deterioration in the wiping performance, it has been suggested that cleaning means for cleaning the wiping means is provided. As an optimum and most ordinary structure of the cleaning means, a structure using porous ink absorber exhibiting excellent ink absorbing performance has been employed. The ink absorber of the foregoing type comes in contact with the blade or the like serving as the wiping means to move mutually as to remove the foreign matter allowed to adhere to the blade by rubbing and as to absorb the ink so that the blade can be cleaned. However, the ink absorbing performance of an ink absorber even having excellent cleaning performance sometimes deteriorates as it absorbs the ink. Therefore, it is difficult to maintain the reliability for a long time.

As the case where the ink adheres to the surface of the discharge port, there is a case where the ink discharged from the fluid passage by a pump or the like adheres to the surface of the discharge port. Further, the ink jet recording apparatus sometimes encounters a problem that the viscosity of the ink in the fluid passage is increased due to evaporation of water or the like and the discharge cannot be enabled even if discharging force is supplied. Therefore, a suction pump has been usually used to forcibly discharge the ink, which is not suitable to be discharged and to refresh the ink in the fluid passage. In this case, the quantity of the ink allowed to adhere after the suction operation is sometimes larger than the quantity of ink allowed to adhere during the recording operation. In such a case, the load which must be borne by the wiping means becomes excessively heavy.

FIGS. 1A to 1D are schematic cross sectional views which illustrate the operation of a cap at the time of the suction recovery operation. FIG. 1A illustrates a capping state (a capping state realized in such a manner that a cap 103 is brought into contact in a hermetical manner with a discharge port surface 102 of a recording head 101, and a suction pump (omitted from illustration) connected to the cap 103 is used to generate vacuum pressure to suck out the ink from the discharge port, the capping state being a state in which the pressure has been recovered (a state in which the pressure has been so recovered as not to break the meniscus of the discharge port). A diagonal portion 104 shown in FIGS. 1A to 1D designates the sucked ink. In the state shown in FIG. 1A, the inside portion of the cap 103 is considered to be substantially filled with ink.

If the cap 103 is intended to be removed from the capping state shown in FIG. 1A, force for upwards sucking the ink due to the adhesive force of the ink and the negative pressure in the discharge port acts on the boundary between the discharge port surface 102 and the ink 104. Further, a surface tension of the cohesive force of the ink itself acts on the ink in the cap 103. Therefore, draw-downs 105 occur in the ink 104, the cross section of each draw-downs 105 of the ink 104 being reduced as the cap 103 is separated. Therefore, the portion of the draw-down 105 is made most weaken.

Finally, the ink is disconnected at each draw-down 105 as shown in FIG. 1D, resulting in that a portion of the ink is left on the discharge port surface 102. The quantity of the ink left on the discharge port surface 102 at this time is larger than the quantity of the ink allowed to adhere due to mist and realized during the recording operation. The quantity of the left ink tends to be enlarged in inverse proportion to the surface tension of the ink and also in inverse proportion to the water repellency of the discharge port surface 102. The load, that must be borne by the wiping blade and the wiping cleaner, is enlarged in proportion to the quantity of the ink allowed to adhere to the discharge port surface 102. As a result, the life of each of the wiping element is shortened. Other problems of falling and flying of the ink arise in the case shown in FIGS. 1A to 1D because the ink is left in the cap 103 when the cap 103 is removed.

When the cap 103 is immediately removed after the ink has been sucked, the atmospheric pressure instantaneously acts on the portion inside the cap in which the negative pressure is left. The rapid pressure change and the mechanical impact at the time of the removal break the meniscus in the discharge port, causing air to be introduced deeply into the discharge port. In this case, the ink discharge is sometimes made defective.

The suction recovery operation of the conventional ink jet recording apparatus is performed by making use of a cylinder pump which does not use the gravity of the ink, which makes use of the movement of a piston thereof and which is capable of assuredly restore ink even if it is disposed horizontally. The cylinder pump is arranged in such a manner that the surface of the cylinder pump opens/closes an aperture for restoring waster ink from an ink receiving member, such as the cap, to move the waste ink to a waster-ink accommodating portion having an ink capacity larger than the ink receiving member via a waste ink movement passage formed adjacent to the shaft of the piston.

However, the suction recovery means of the conventional ink jet recording apparatus using a plurality of recording heads, such as the color recording heads, has comprised the caps corresponding to the respective recording heads and suction pumps correspond to the caps. As an alternative to this, a structure has been employed which comprises caps corresponding to the recording heads and a large suction pump connected to all caps are provided. Further, the suction recovery operations for all of the plural recording heads are performed at the same timing. Therefore, the quantity of the waste ink increases in proportion to the number of the recording heads and, accordingly, the waste ink accommodating portion must have a large size in proportion to the quantity of the waste ink. As a result, a problem arises in that the size of the recording apparatus cannot be reduced.

The fact that the operations for recovering the suction of all recording heads are performed at the same timing causes the ink to be sucked from a recording head that does not need to be sucked due to the frequencies of use of each recording head and the characteristics of the ink. Therefore, the ink is undesirably consumed. The undesirable consumption of the ink give a user (user which mainly performs monochrome recording operations), which mainly uses a specific recording head, that the ink, which has not been used so frequently, is decreased.

In order to overcome the problem of a type of the defective ink discharge, a method disclosed in, for example, Japanese Patent Appln. Laid-Open No. 60-151059, has been employed which has an arrangement that the cap and an air inlet valve are, by a tube, connected to each other, the air inlet valve is opened to cause the inside portion of the cap to communicate with the atmosphere to suck the ink left in the cap, and then the cap is separated. However, the recent trend of reducing the size of the ink jet recording apparatus arises a necessity of reducing the size of the cap and that of its peripheral mechanisms. Therefore, it is difficult to dispose the foregoing air-inlet valve in the small cap. What is worse, dust is undesirably introduced into the tube for establishing the connection with the air inlet valve, causing the operation to be prevented.

Further, a certain level of negative pressure is needed to discharge the dust allowed to adhere to the discharge port surface, bubbles in the discharge port and the ink having a raised viscosity. Therefore, the foregoing structure in which the air inlet valve is provided in the cap causes the size of the cap to be enlarged. As a result, a problem accordingly arises in that the quantity of the ink to be sucked cannot be reduced. If the quantity of the ink to be sucked is too large, the quantity of the waste ink and the running cost cannot be reduced.

The foregoing serial-type ink jet recording apparatus comprises, in the vicinity of the home position for the carriage, the cleaning means for cleaning the recording head as well as the protecting cap. Therefore, the serial ink jet recording apparatus encounters a problem in that the width of the apparatus cannot be narrowed and the size and the weight of the apparatus cannot therefore be reduced. In a particular case where the cleaning means comprises a plurality of mechanisms, such as the suction recovery mechanism, the wiper mechanism and the sub-discharge mechanism and the like, the foregoing problems become more critically. What is worse, the distance for which the carriage must be moved at the time of the cleaning operation cannot be shortened, causing a problem to arise in that the through put at the time of the recording operation deteriorates.

When a color recording operation or a gradient image recording operation is performed with the foregoing recording apparatus, a plurality of recording heads corresponding to the colors to be recorded and the recording density have been used. The serial type recording apparatus comprising a plurality of recording heads is adapted to a method in which the plural recording heads are mounted on a movable member (a carriage), and the respective recording head are, in response to predetermined image signals, driven sequentially starting from the head disposed in the upstream of the moving direction while moving the movable member to record image on a recording member.

The serial recording apparatus must have a predetermined approaching width to act from the moment at which the movement of the movable member is commenced to a moment at which the recording head commences the recording operation. That is, a first transition region (the approaching width), in which the speed of the movable member reaches a predetermined speed from a stopped state, must be disposed between a main scanning portion (the ink discharge portion in a case where the ink jet recording head is used) for the recording operation to be performed by the recording head at the point at which the movable member commences its movement and the end of the recording member on the same side.

The recording head comprises a main scanning portion for the recording operation, such as the discharge port portion adapted to the ink jet recording method, or a heating element portion adapted to the thermal recording method or a dot wire portion adapted to the wire dot recording method. The recording head is formed into a horizontally symmetrical shape with respect to the main scanning portion for the recording operation or formed into asymmetrical with respect to the main scanning portion for the recording operation. The asymmetrical recording head requires right and left spaces which are different in size with respect to the main scanning portion for the recording operation.

SUMMARY OF THE INVENTION

However, the foregoing serial-type recording apparatus using the plural recording heads and performing the recording operation by sequentially operating all recording heads encounters a fact that the approaching width is too large. Therefore, there arises a problem in that the movable range for the movable member is too large and, accordingly, the size of the recording apparatus cannot be reduced. What is worse, all recording heads are operated to record an image during the movement of the movable member in either direction, resulting in a problem to arise in that the capacity of a power source for operating the recording heads is too large, the size of the power source cannot be reduced and the cost of the power source cannot therefore be reduced.

A serial-type recording apparatus using a plurality of recording heads formed asymmetrically and having the right portion and the left portion which are formed into different shapes with respect to a main recording scanning portion encounters a fact that the approaching width for the movable member is further enlarged if the conventional configuration of the recording heads on the movable member (a carriage) is employed in which the larger portions are disposed on the same side and, accordingly, there arises a problem in that the size and the weight of the recording apparatus cannot be reduced.

The present invention is directed to overcome the foregoing technological problem, and accordingly an object of the present invention is to provide an ink jet recording apparatus in which the quantity of waste ink can be reduced, the size of the waste ink accommodating portion can be reduced, the size of the recording apparatus can be reduced, wasteful ink consumption is prevented to reduce the cost, discomfort feeling of a user who uses only specific recording means is eliminated, and the suction quantity, the sucking intervals and the initial sucking pressure can be determined to correspond to the differences in the compositions of the inks respectively used in the corresponding recording means.

Another object of the present invention is to provide an ink jet recording apparatus capable of removing ink allowed to adhere to the surface of a discharge port of recording means (a recording head) to prevent deterioration of the performance of the wiping means so that the ink discharge from the recording means can be stabilized, an excellent recording operation can be performed for a long time and mixture of inks can be prevented if a plurality of recording means are used.

Another object of the present invention is to provide an ink jet recording apparatus capable of preventing defective ink discharge and generation of deviation at the time of the recording operation, minimizing the width of the recording apparatus, reducing the size and the weight, and improving the through put at the time of the recording operation.

Another object of the present invention is to provide a recording apparatus capable of reducing the movable range for a movable member when a plurality of recording heads (recording means) are used to record an image as to reduce the size of the apparatus, to decrease the capacity of a power source for operating the recording heads and to reduce the size and the cost of the power source.

Another object of the present invention is to provide a recording apparatus in which the approach width for a movable member can be narrowed and the movable range for the movable member can be decreased at the time of using a plurality of recording means having the right and left needed portions which are different with respect to the main recording scanning portion so that the size and the weight of the apparatus can be reduced, the capacity of a power source for operating the recording means can be decreased, and accordingly the size and the cost of the power source can be reduced.

Other and further objects, features and advantages of the invention will be appear more fully from the following description.

DETAILED DESCRIPTION OF THE PREFERRED EMBODIMENT

Figure 1A:
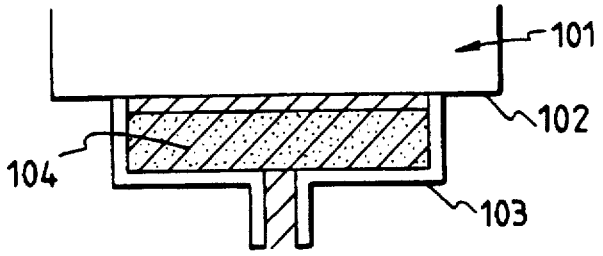
FIG. 1A PRIOR ART
FIGS. 1A to 1D respectively are schematic and partial cross sectional views which illustrate the operation of a suction recovery means of a conventional ink jet recording apparatus.
Figure 1B:
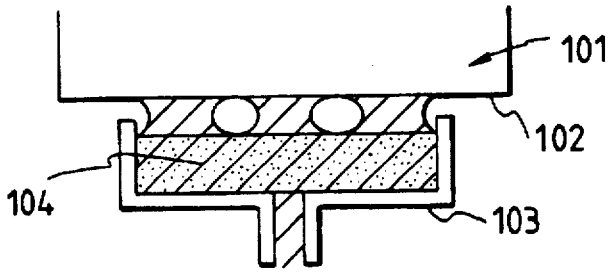
FIG. 1B PRIOR ART
Figure 1C:
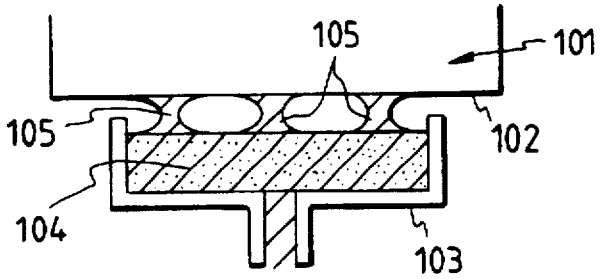
FIG. 1C PRIOR ART
Figure 1D:
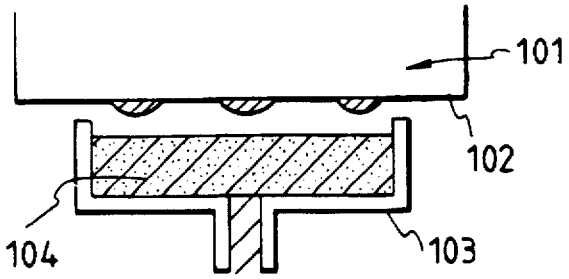
FIG. 1D PRIOR ART
Figure 2:
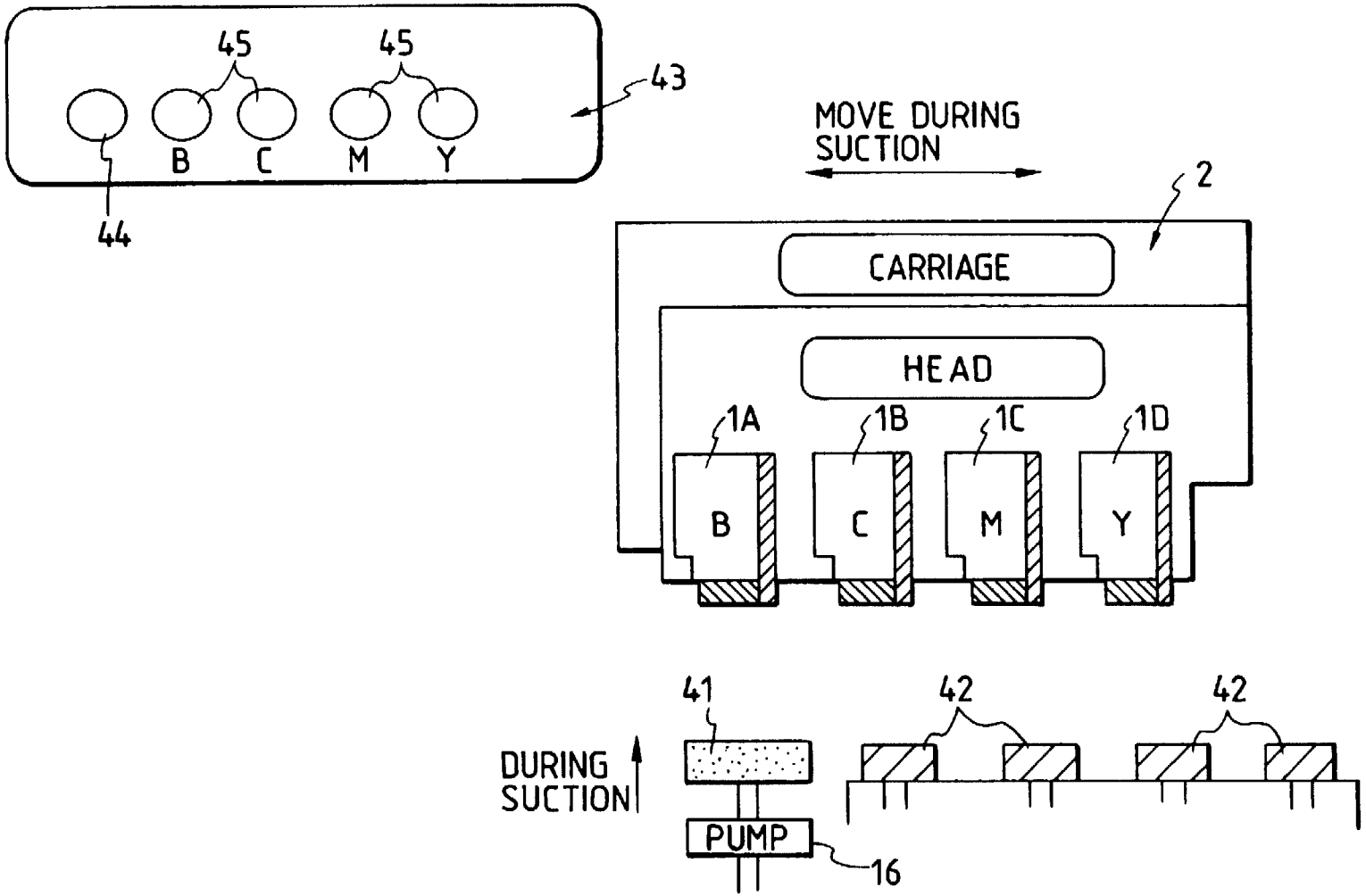
FIG. 2 is a schematic front elevational view which illustrates a state before a color of the suction recovery means of the ink jet recording apparatus according to the present invention is instructed.

FIGS. 2 to 5 are schematic views which illustrates the structure of and the operation of a first embodiment of suction recovery means of an ink jet recording apparatus according to the present invention. Referring to FIGS. 2 to 5, this embodiment is adapted to a color ink jet recording apparatus comprising a carriage 2 on which four recording heads (head cartridges) 1A to 1D for black, cyan, magenta and yellow are mounted. This embodiment is so arranged that suction recovery means composed of one suction cap 41 and one suction pump 16 selectively sucks the plural recording heads 1. Therefore, protection (reservation) caps 42, the number of which is the same as that of the recording heads, are disposed in addition to the suction cap 41. The number of the protection caps 42 may be lesser than that of the recording heads 1 by one if the suction cap 41 is used as a protection cap. A control panel 43 of the recording apparatus has a suction switch 44 for performing the suction operation and color instruction switches 45 for instructing the color (the recording head) to be sucked.

Figure 3:
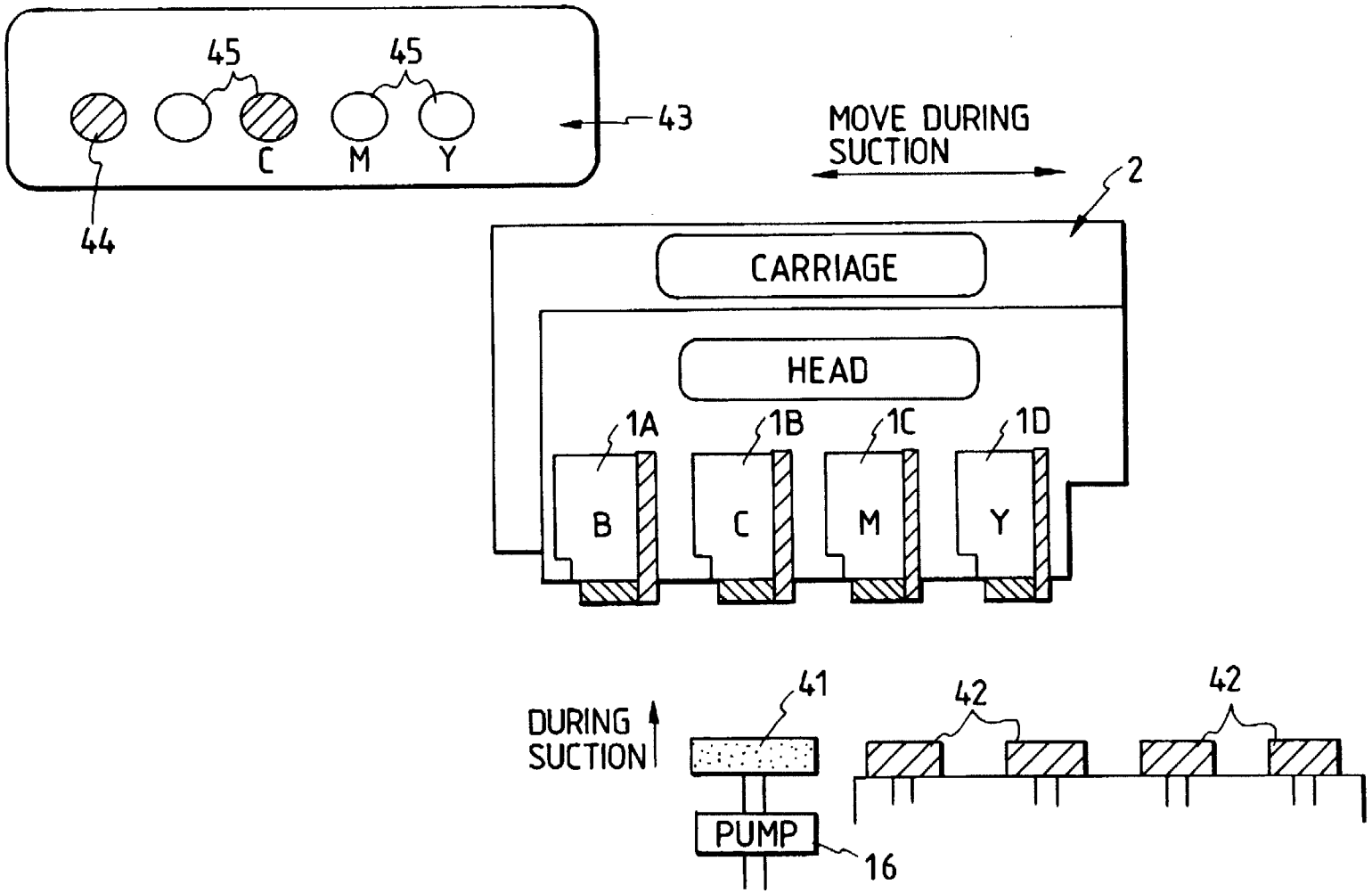
FIG. 3 is a schematic front elevational view which illustrates a state before the suction is performed in a case where a cyan of the suction recovery means shown in FIG. 2 has been instructed.
Figure 4:
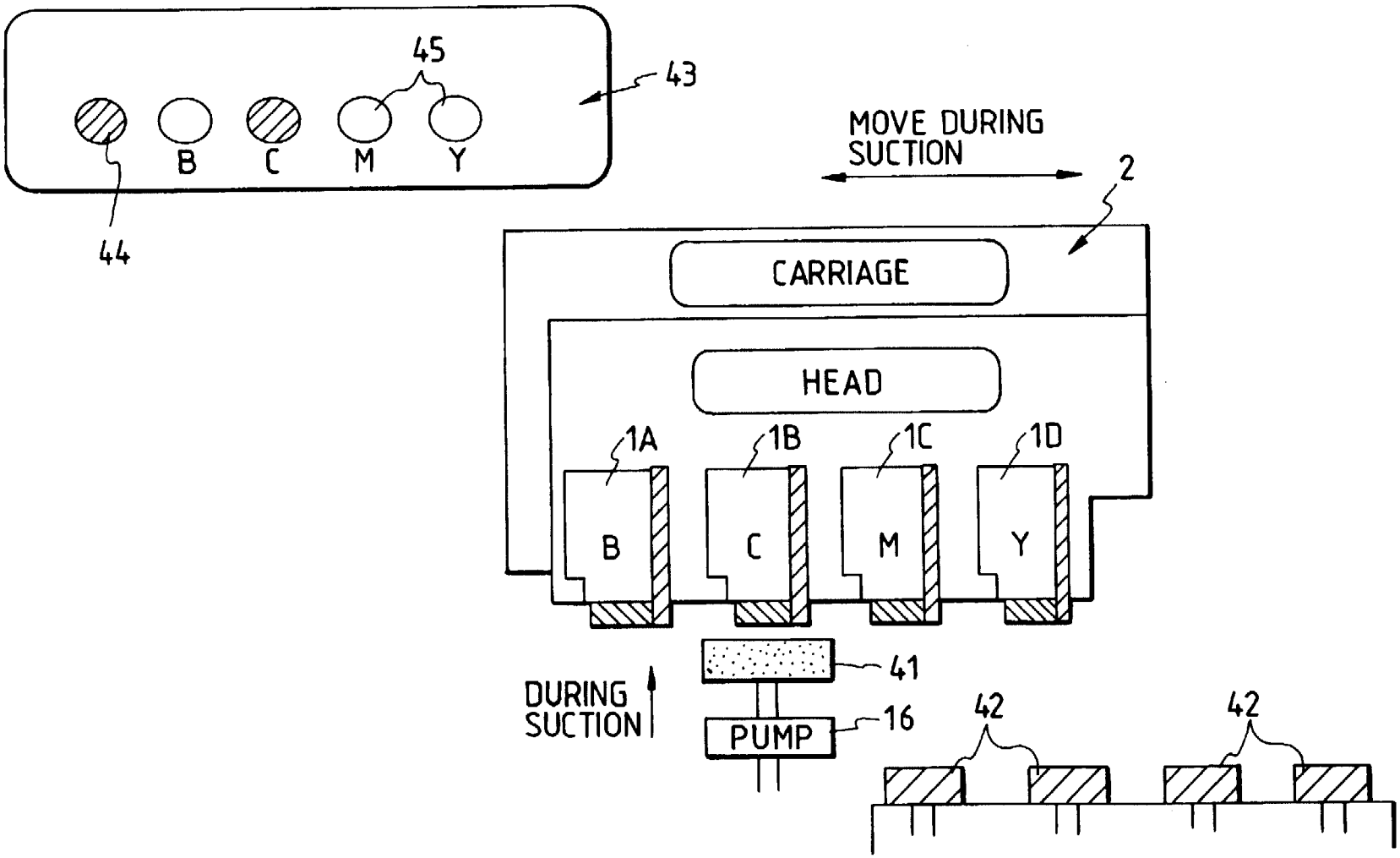
FIG. 4 is a schematic front elevational view which illustrates a state at the time of the suction operation in a case where a cyan of the suction recovery means shown in FIG. 2 has been instructed.

The suction recovery operation of the suction recovery means shown in FIGS. 2 to 5 is performed as follows. If the suction recovery is manually performed, when a user has detected a recording head 1 which cannot discharge ink normally, the user switches on the corresponding color instruction (the recording head instruction) switch 45 and the suction switch 44 on the control panel 43 as shown in FIGS. 3 and 4. FIGS. 3 and 4 illustrates a case where defective discharge of a cyan recording head 1B has been detected. In accordance with the instruction thus-made, a carriage 2 is moved to cause the recording head 1B instructed to be sucked to face the suction cap 41 at a fixed position. A modification may be employed in which the suction cap is moved while fixing the carriage 2 at the home position to cause the recording head instructed to be sucked to face the suction cap.

Then, the suction cap 41 is brought into hermetically contact with the instructed recording head 1B as shown in FIG. 4, and the suction pump 16 is operated to lower the pressure in the cap 41. As a result, ink is sucked out through the discharge port of the recording head 1 to remove foreign matters such as dust and viscous ink in the discharge port. Although the foregoing suction recovery operation is performed manually, the structure may be so arranged that defective discharge detection means for detecting the defective recording head 1 is provided to automatically perform the suction recovery operation. In the case where the automatic suction recovery is performed, the carriage 2 or the suction cap is moved to cause only a defective recording head 1 to be sucked.

Figure 5:
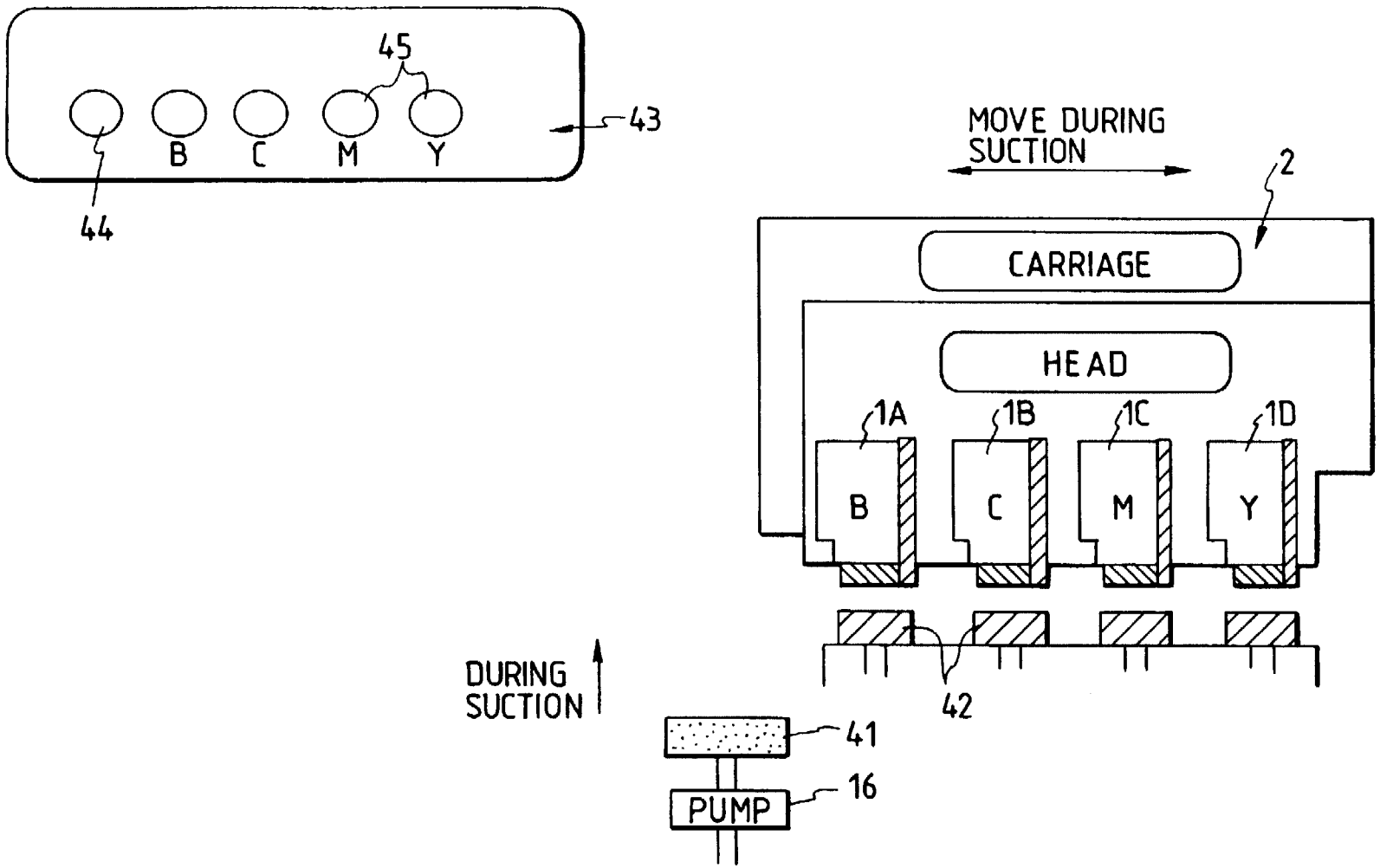
FIG. 5 is a schematic front elevational view which illustrates a state where each recording head, which has been sucked by the suction recovery means shown in FIG. 2, is capped.

If the recording head 1 is not used and allowed to stand at the time of storing the recording the apparatus, the carriage 2 is moved to cause the recording heads 1 to face the corresponding protection caps 42 as shown in FIG. 5. Further, the recording heads 1 and the corresponding protection caps 42 (the suction cap 41 also serving as the protection cap 42 included) are brought into contact with one another in a hermetical manner to cap the respective recording heads 1 (to seal the discharge port) as to prevent the viscidity and adhesion of the ink in the discharge port and the invasion of dust into the discharge port.

The suction recovery means described with reference to FIGS. 2 to 5 enabled the following effects to be obtained. First, since suction of only the needed recording heads can be recovered by a desired degree, the quantity of waste ink and the size of the waste ink accommodating portion can be reduced. Further, wasteful ink consumption can be prevented so that the cost can be reduced. Second, the discomfortable feeling of the user against the fact that the recording head, the discharge from which is normal, is sucked and its ink is wastefully discharged can be overcome. Third, the quantity of suction, the sucking interval and the initial suction pressure can be determined for the respective recording heads 1A to 1D to correspond to the difference in the compositions of the inks. Therefore, the suction recovery means, which is considerably reasonable in terms of consuming the ink, can be obtained.

Fourth, the considerable size reduction of the suction pump 16 enables the cost to be reduced significantly. Fifth, the arrangement so made that one suction pump 16 is used and only the needed recording heads 1 are sequentially located at the time of the suction operation to recover the suctions of the recording heads 1 improves the reliability of the suction operation as compared with the structure in which a plurality of recording heads 1 are simultaneously located and sucked. Sixth, even if a plurality of recording heads 1 are used, only one suction pump is required. Further, the fact that the capacity of the suction pump 16 is sufficient to be the quantity which correspond to one recording head, the necessity of using a large-capacity suction pump corresponding to the plural recording heads can be eliminated. In addition, the space of the suction pump which is a relatively large space in the recovery system can be reduced significantly. Therefore, the space of the recovery system can be reduced and, accordingly, the size and the weight of the ink jet recording apparatus can be reduced.

Figure 6:
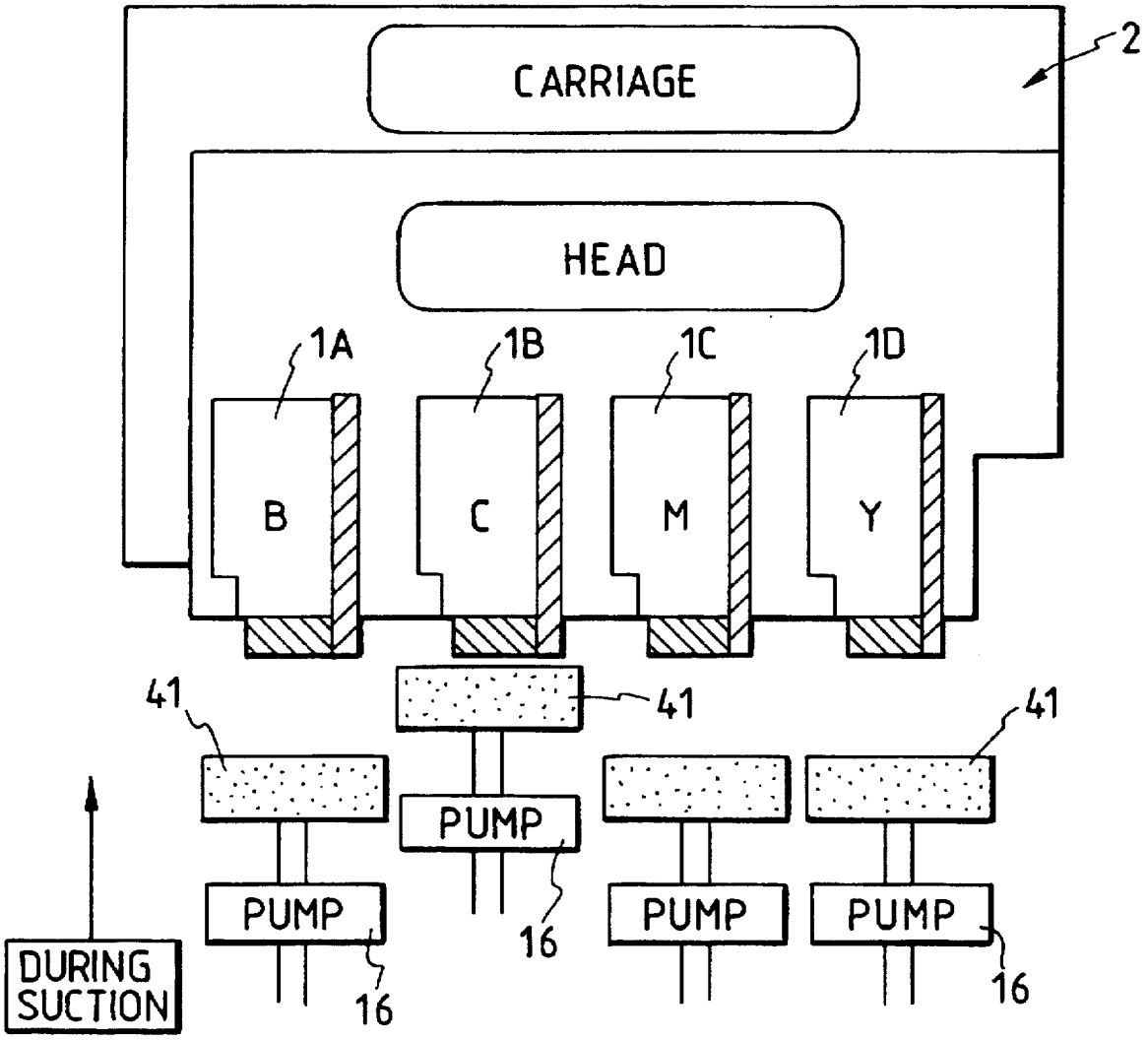
FIG. 6 is a schematic front elevational view which illustrates the structure and the operation of another example of a suction recovery means of an ink jet recording apparatus according to the present invention.
Figure 7:
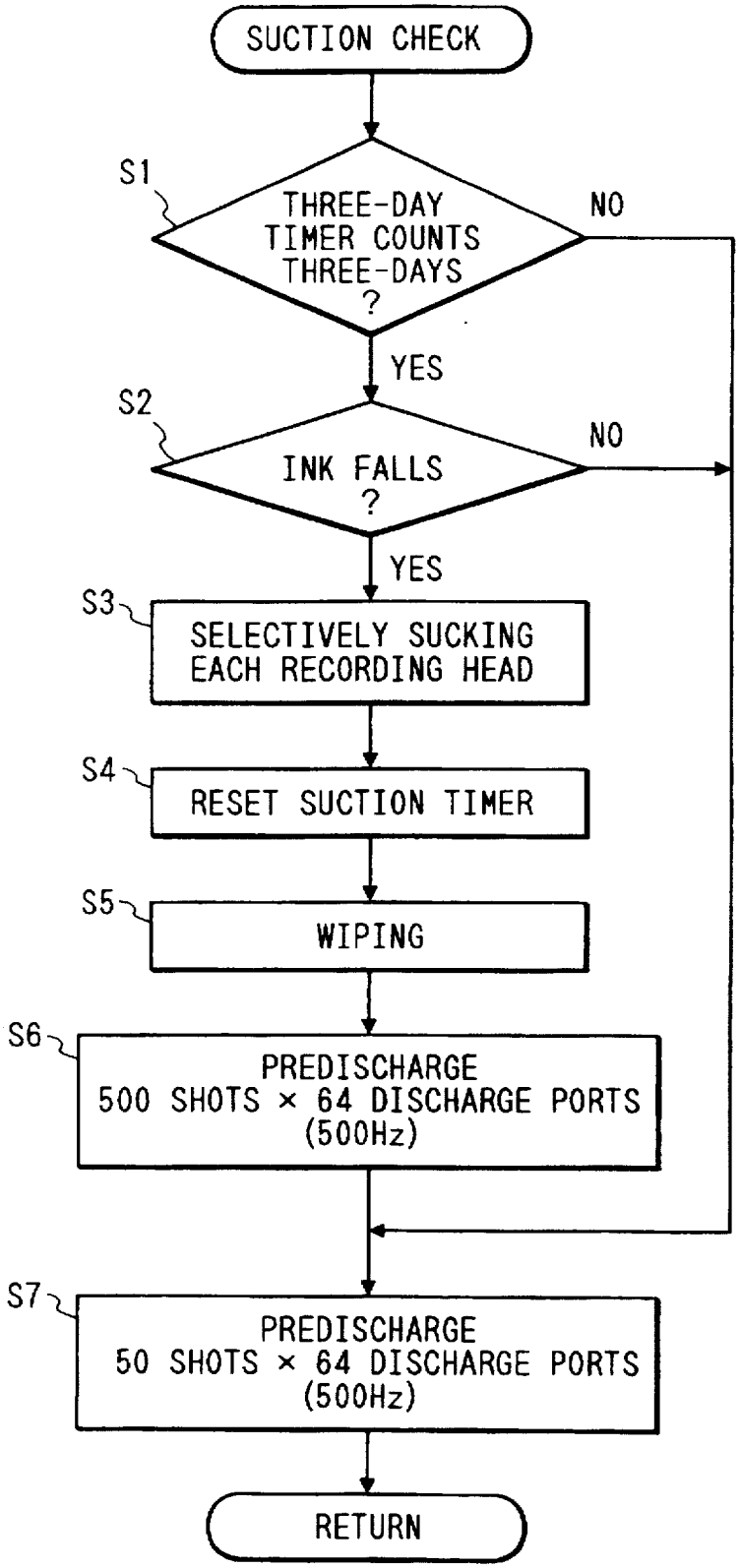
FIG. 7 is a flow chart which illustrates an example of a recovery operation sequence of an ink jet recording apparatus having the suction recovery means shown in FIG. 6.

FIG. 6 is a schematic view which illustrates the structure and the operation of a second embodiment of suction recovery means of an ink jet recording apparatus according to the present invention. FIG. 7 is a flow chart of a suction sequence of the suction recovery means shown in FIG. 6. As shown in FIG. 6, this embodiment comprises the plural recording heads 1A to 1D and a plurality of suction recovery mechanisms each comprises a pair consisting of a suction pump 16 and a suction cap 41 which are respectively individually operated from the recording heads 1A to 1D so that the recovery operations of the plural recording heads 1A to 1D are selectively performed. Since all suction caps 41 employed in this embodiment also have the functions of the foregoing protection cap 42, the protection cap is omitted. Further, the suction recovery operations of the recording heads 1 so performed that the sequence shown in FIG. 7 is used to determine whether or not the recovery operation is performed, and only the suction pump 16 corresponding to the recording head 1 determined to be sucked is operated so that a selective recovery operation is performed.

The recovery operation according to the second embodiment shown in FIG. 6 is performed as follows: first, the carriage 2 is returned to the home position, and the suction caps 1 are brought into hermetically contact with the corresponding recording heads 1 to cap the discharge port. Then, each recording head 1 is detected whether not it meets a predetermined condition to determine whether or not the recovery operation is needed. For example, the suction checking sequence shown in FIG. 7 is so arranged that a suction checking is commenced so that whether or not the three-day timer of each recording head 1 has passed is determined in step S1 and whether or not ink falls is determined in step S2. As a result, only the recording head 1 which meets the foregoing recovery condition is selected to operate only the suction pump 16 of the selected recording head 1 so that the selective suction operation is performed in step S3.

The flow chart shown in FIG. 7 contains the sequence of the cleaning operation to be usually performed before the commencement of the recording operation, cleaning operation being performed after the selective suction has been performed. That is, as shown in FIG. 6, each recording head 1 is selectively sucked, and a suction timer for performing the next suction operation is reset in step S4. In next step S5, the wiping blade 18 is used to wipe out the discharge port surface 81. In step S6, a previous discharge is performed while discharging 500 droplets from 64 discharge ports, and another previous discharge is performed in step S7 while discharging 50 droplets from 64 discharge ports. After the operation for cleaning the recording head 1 has been performed in accordance with the foregoing sequence, the carriage 2 is returned to the recording region to commence the recording operation.

The second embodiment shown in FIGS. 6 and 7 enables the following effects to be obtained: first, since suction of only the needed recording heads can be recovered by a desired degree, the quantity of waste ink and the size of the waste ink accommodating portion can be reduced. Further, wasteful ink consumption can be prevented so that the cost can be reduced. Second, the discomfortable feeling of the user against the fact that the recording head, the discharge from which is normal, is sucked and its ink is wastefully discharged can be overcome. Third, the quantity of suction, the sucking interval and the initial suction pressure can be determined for the respective recording heads 1A to 1D to correspond to the difference in the compositions of the inks. Therefore, the suction recovery means, which is considerably reasonable in terms of consuming the ink, can be obtained.

Fourth, the arrangement so made that each recording head 1 has the corresponding and individual suction pump enables some recording head 1 to be sucked simultaneously so that the time taken to complete the recovery operation is shortened. Fifth, since the suction pump 16 is made independent, the automatic and selective suction by detecting falling of ink can easily be performed. Sixth, the previous discharge of the recording head, which is not subjected to the suction operation, can freely be performed so that the degree of the recovery for each recording head 1 can be adjusted. Seventh, the employment of the suction checking sequence arranged as shown in FIG. 7 enables the automatic suction recovery operation to be performed, causing the excessive ink consumption to be prevented. Therefore, the user can be freed from a complicated operation, and excellent ink discharge performance can always be maintained.

The color ink jet recording apparatus having four-color recording heads consisting of yellow, magenta, cyan and black heads is expected to a fact that although a user who mainly records monochrome images while usually using the black ink does not use colors except black, the inks, which are not used, are consumed due to the all-color suction operation. However, the each embodiment of the foregoing suction recovery means is able to easily prevent the excessive suction of the recording head which is not frequently used. That is, the selective suction of each embodiment adapted to a method, in which a switch for selecting the monochrome mode or the color mode is provided for the control panel and only the black recording head is sucked at a predetermined timing in the monochrome mode or a method, in which the recording apparatus body previously stores the frequency of use of each of the recording heads 1A to 1D and only the recording head which is used frequently is sucked, is able to easily decrease the number of operations of sucking the yellow, magenta and cyan recording heads which are not used frequently for the user who mainly records monochrome images. Therefore, a suction recovery operation can easily be performed while preventing the excessive decrease of inks except the black ink.

Further, the foregoing embodiment is able to easily change the initial sucking pressure, the quantity of suction and the sucking interval of each recording head 1 can easily be changed to correspond to the characteristics of the inks. Therefore, the conditions for the suction operation can freely and optimally adjusted depending upon the difference of the dye of the inks for use in the respective recording heads 1. If inks having completely different compositions are used in the respective recording heads 1 in order to obtain a further excellent image quality, the sucking conditions, such as the initial sucking pressure, the quantity of suction and the sucking interval, can easily be changed to correspond to the composition of the ink. Therefore, an effective and reasonable suction operation can easily be performed.

Figure 8:
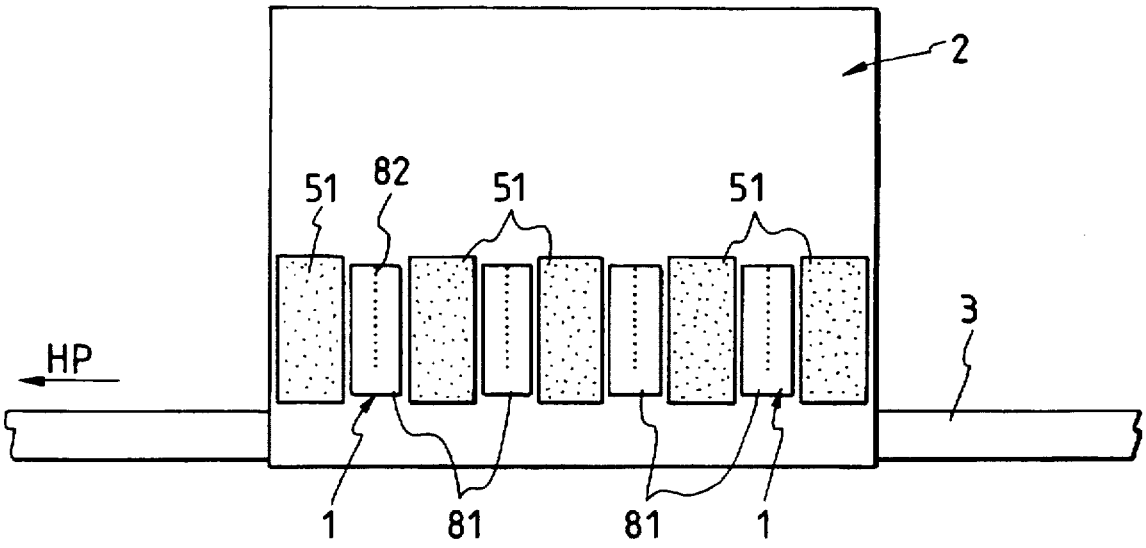
FIG. 8 is a bottom view which illustrates a carriage.
Figure 9:
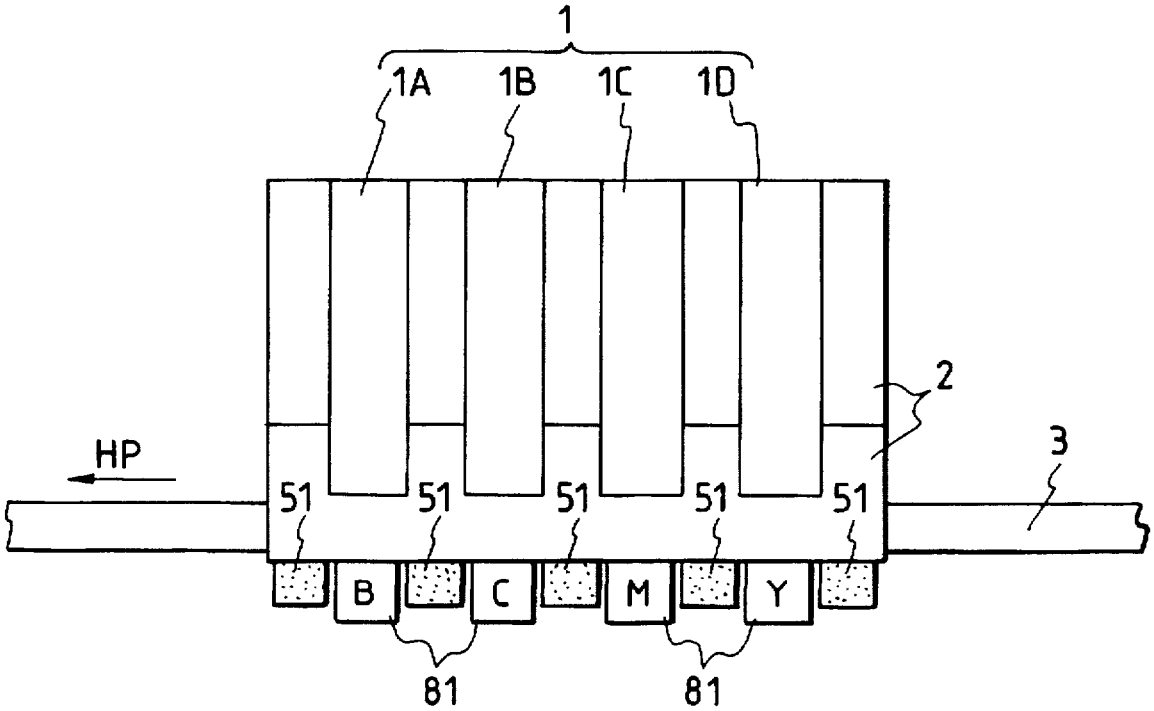
FIG. 9 is a front elevational view which illustrates a carriage.

FIG. 8 isia bottom view which shows the carriage 2. FIG. 9 is a front elevational view which illustrates the carriage 2. As shown in FIGS. 8 and 9, an ink absorber 51 serving as cleaning means to clean a blade 18 is so fastened to the bottom of the carriage 2 as to interpose a discharge port surface 81 of each recording head 1. The ink absorber 51 is made of a porous absorbing material which cannot be corroded with the ink and which is able to satisfactorily absorb ink. The ink absorbers 51 (totalling five) for cleaning the blade 18 are disposed on the two sides of the discharge port 81 of each recording head 1. As shown in FIG. 9, each ink absorber 51 is disposed to somewhat stand back from the discharge port surface 8 of each recording head 1 in order to prevent contact with the recording member 8.

The ink jet recording apparatus sometimes encounters undesirable generations of white lines or black lines in the image if the discharged ink droplet cannot precisely reach the recording member 8. In order to prevent the image quality deterioration, a structure has been employed in which the distance from the discharge port surface 81 of the recording head 1 to the recording side of the recording member 8 is minimized to eliminate the positional error with the discharged ink droplet and to improve the image quality. However, a great difference takes place between the water content in the surface, which has absorbed the ink and that in its reverse side or between the water content in the portion which has received the ink and that in the portion which has not received it if the ink has been absorbed into the recording member 8. As a result, the recording member is expanded or contracted non-uniformly, causing an undesirable ripple called a "cockling" to take place. If the cockling has taken place or if the recording member 8 curls, the fact that the gap between the recording head 1 and the recording member 8 arises a problem in that the recording head 1 and the recording member 8 are in contact and, accordingly, the recording surface is contaminated. Therefore, the gap between the recording head 1 and the recording member 8 is so minimized that rubbing is prevented even if deformation such as the cockling has taken place.

This embodiment is so arranged that the positional accuracy in discharging the ink is improved by fastening the ink absorber 51 disposed in the bottom of the carriage 2 for the purpose of cleaning the blade in such a manner that the ink absorber 51 is fastened to somewhat stand back from the recording head 1 downwards projecting over the carriage 2. While considering the case where the ink absorber 51 is expanded due to the absorption of the ink, the position of the ink absorber 51 is positioned to stand back from the recording head by a degree of about 0.5 mm.

Figure 10:
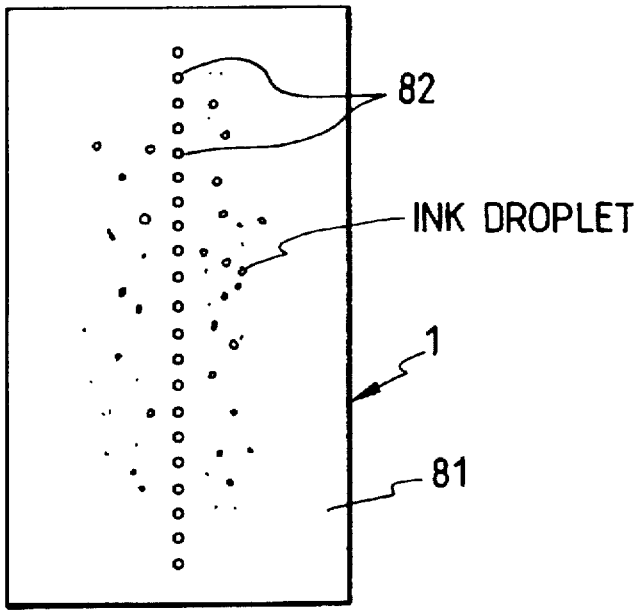
FIG. 10 is a schematic front elevational view which illustrates an example of a state where an ink droplet is allowed to adhere to the surface of a discharge port of the recording means.
Figure 11:
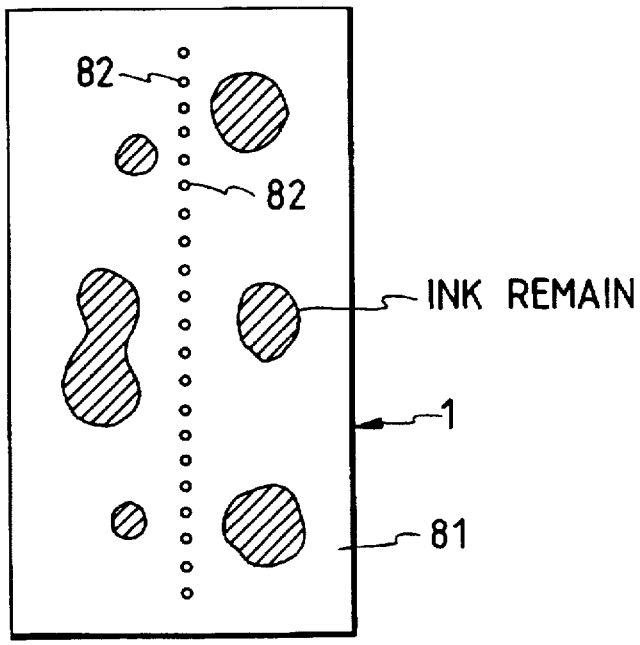
FIG. 11 is a schematic front elevational view which illustrates an example of a state where ink remain is generated on the surface of the discharge port of the recording means.

FIG. 10 is a schematic front elevational view which illustrates an example of a wetted state of the discharge port surface 81 after the image recording operation has been completed. FIG. 11 is a schematic front elevational view which illustrates an example of a state where the ink adheres to the discharge port surface 81 after the suction recovery has been performed. The discharge port surface 81 of the recording head 1 is wetted as shown in FIG. 10 after the ink has been discharged and the recording operation has been performed. If a considerably large quantity of the ink adheres to the portion in the vicinity of the discharge port 82 as shown in FIG. 10, the ink discharge is inhibited, causing the ink to be sometimes discharged into an undesirable direction (deviation). What is worse, a phenomenon (non-discharge), in which the ink droplet is not discharged, occurs. Also the suction recovery causes the ink to adhere to the discharge port surface 81 as described above by a quantity which is larger than the quantity realized due to wetting caused by the discharge as shown in FIG. 11. Accordingly, the discharge port surface 81 must be wiped out (wiped out and cleaned) by the blade 18 after the suction recovery operation has been completed or at predetermined time intervals (before the defective discharge takes place).

Figure 12A:
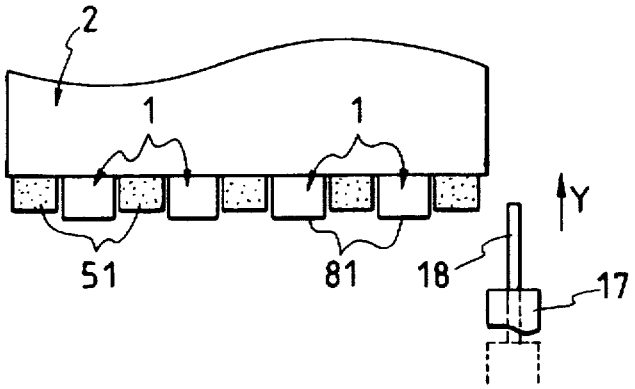
FIGS. 12A to 12C are schematic front elevational views which illustrate the wiping and blade cleaning operations adapted to the recording means.
Figure 12B:
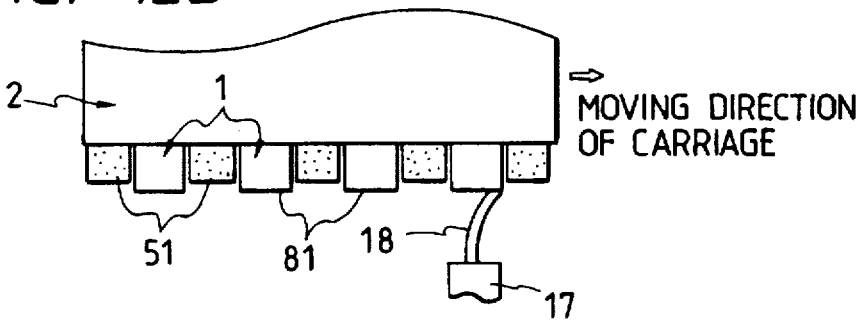
Figure 12C:
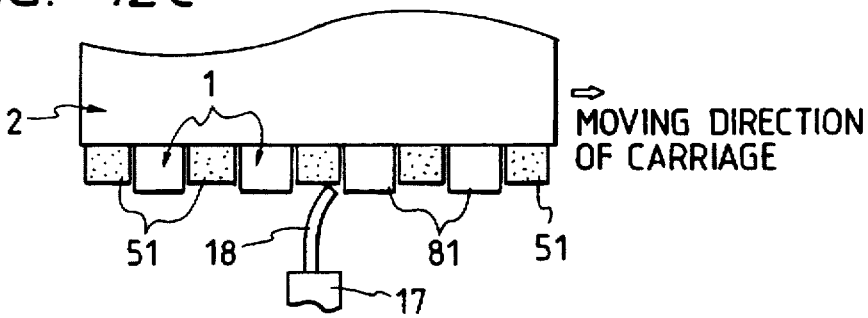

FIGS. 12A to 12C are schematic views which illustrate the wiping operation to be performed in the structure according to the present invention. As described above, the wiping operation according to the present invention is, at a needed moment, performed by moving the carriage 2 in a direction from a position adjacent to the home position (the left portion of FIGS. 12A to 12C) toward the system (the right portion of FIGS. 12A to 12C) for conveying the recording member. FIG. 12A illustrates a state immediately before the wiping operation is performed. The blade 18 held by a blade holder 17 at this time is moved upwards from the standby position in a direction designated by an arrow Y and fixed at a position (a wiping position) at which the optimum introduction quantity to wipe out the recording head 1 is realized. Then, the carriage 2 having the recording heads 1 mounted thereon is horizontally moved from the left to the right, as shown in FIGS. 12B and 12C. During this, the blade 18 wipes out and removes a foreign matter, such as the ink, allowed to adhere to each discharge port surface 81 while alternately coming in contact with each ink absorber 51 disposed in the bottom of the carriage 2 and with the discharge port surface 81 of each recording head 1. After the blade 81 has sequentially come in contact with all ink absorbers 51 and the discharge port surfaces 81, the blade 18 is moved (downwards) in the direction opposing the direction designated by the arrow Y and made on standby at the retracted position.

Since the ink absorbers 51 for cleaning the blade are disposed to come in contact with the two sides of each recording head 1 as shown in FIGS. 12A to 12C, the ink wiped out by the blade 18 from each discharge port surface 81 is sequentially absorbed by the ink absorber 51. Therefore, the quantity of ink allowed to adhere to the blade 18 and left there can always be reduced so that undesirable color mixture at the time of wiping out the discharge port surface 81 of the next recording head 1 can be prevented.

However, since the ink absorbing performance of each ink absorber is limited, an excessively-large-quantity of ink allowed to adhere to each discharge port surface 81 cannot sometimes satisfactorily be absorbed by the corresponding ink absorbers 51. However, the following embodiment is able to substantially eliminate the ink left on the discharge port surface 81 of each recording head 1. As a result, the load which must be borne by the wiping blade 18 and that which must be borne by the blade cleaner (the ink absorber) 51 can significantly be lightened so that the foregoing problem can be overcome.

Figure 13A:
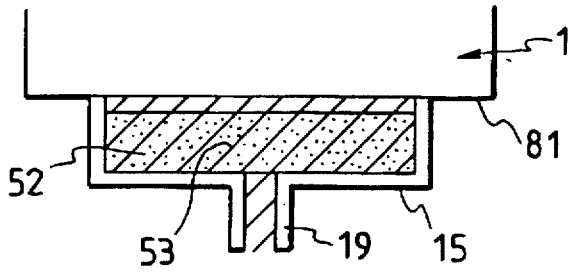
FIGS. 13A to 13D respectively are schematic and partial cross sectional views which illustrate the operation of another example of a suction recovery means of an ink jet recording apparatus according to the present invention.
Figure 17:
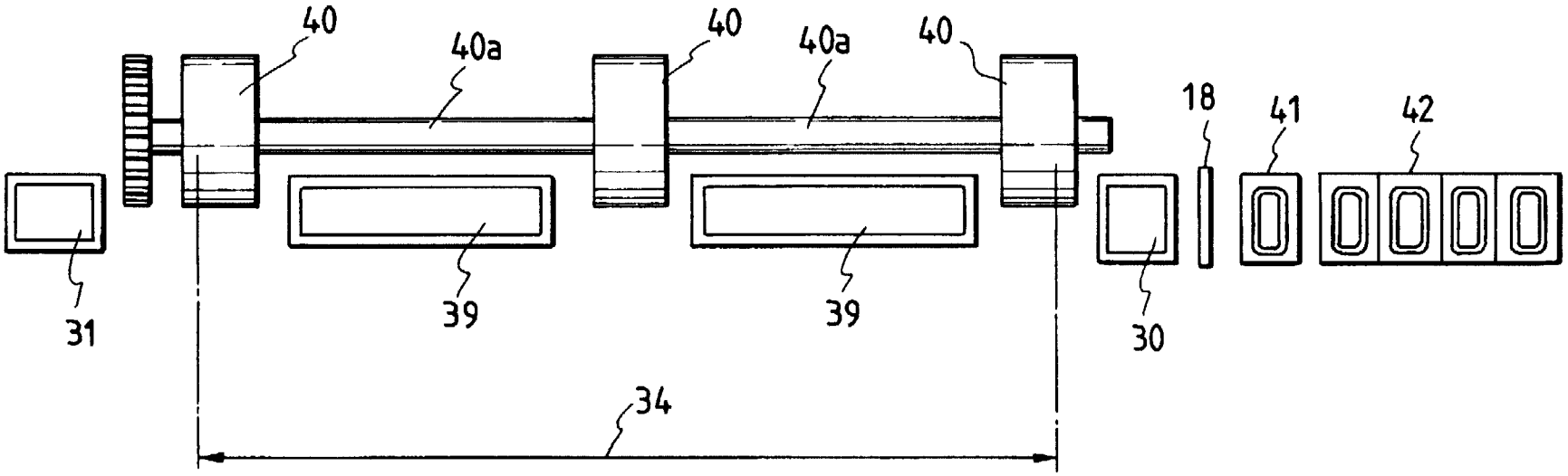
FIG. 17 is a schematic plan view which illustrates an essential portion of the structure of another example of the ink jet recording apparatus according to the present invention.

FIGS. 13A to 13D are schematic cross sectional views which illustrates a cap portion for explaining a sucking operation of a third embodiment of suction recovery means of an ink jet recording apparatus according to the present invention. As shown in FIGS. 13A to 13D, each cap 15 includes a porous ink absorber 52. The capacity of the ink absorber 52 is determined to be a value which is larger than the quantity of suction (the quantity of forcible discharge realized during one operation) performed by a suction pump 16 or a value larger than the internal capacity of an ink passage of the recording head 1. The ink absorber 52 is so disposed as to be position adjacent to the discharge port surface 81 at the time of the capping operation as shown in FIG. 13A. A diagonal line portion 53 shown in FIG. 17 represent the ink sucked out from the discharge port 82.

Figure 13B:
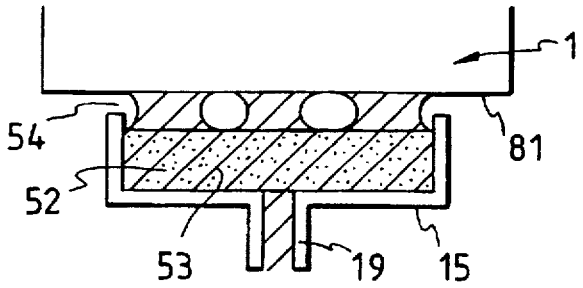

FIG. 13A illustrates a state where the cap 15 is brought into hermetically contact with the discharge port surface 81, and the suction pump 16 is operated to generate a negative pressure in the cap 15 through a tube 19 to suck an ink 53 through each discharge port 82. Then, the recording head 1 and the cap 15 are separated from each other at a predetermined timing as shown in FIG. 13B so that a gap 54 is formed between the recording head 1 and the cap 15. The timing at which the recording head 1 and the cap 15 are separated from each other is made to be a moment at which the negative pressure in the suction pump 16 has been substantially eliminated due to the stoppage of the suction pump 16 causing a predetermined quantity of the ink to be sucked or a moment at which a predetermined quantity of ink has been sucked even if a negative pressure is acting in the cap 15. The ink sucked from the recording head 1 by the suction pump 16 passes through a tube or an ink passage to be sent and discharge into an waste-ink tank (omitted from illustration). The waster-ink tank may be made of porous ink absorber capable of absorbing and holding the waste ink.

Figure 13C:
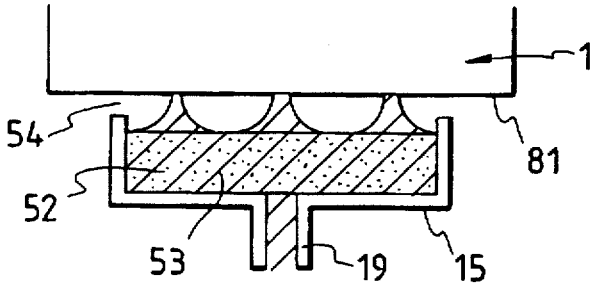
Figure 13D:
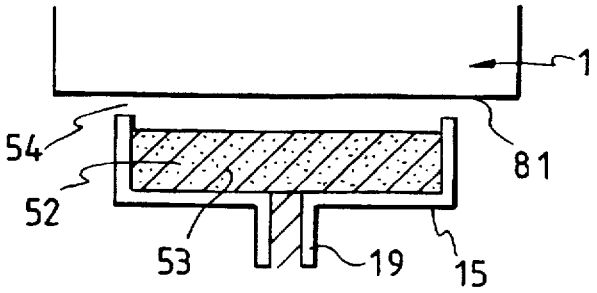

The capacity of the porous ink absorber 52 shown in FIGS. 13A to 13D is determined to be a value which is larger than the quantity of suction (the quantity of forcible suction of ink realized during one operation) realized by the suction pump 16 or a value which is larger than the capacity of the ink passage of the recording head 1. Therefore, the ink 53 positioned between the discharge port surface 81 and the cap 15 is, as shown in FIG. 13C, brought toward the ink absorber 52 due to the attractive force of the ink absorber 52. Therefore, the suction recovery operation can be completed in such a manner that no ink is left on the discharge port surface 81 of the recording head 1 as shown in FIG. 13D. As a result, the load which must be borne by the wiping blade 18 and that which must be borne by the blade cleaner (the ink absorber) 51 shown in FIGS. 12A to 12C can be significantly lightened. Further, enclosing of the porous ink absorber 52 into the cap 52 enables the ink flow in the cap 15 to be directed (in a direction from the discharge port surface 81 toward the suction pump 16) at the time of the suction operation. Therefore, undesirable ink mixture occurring such that the different-color ink allowed to adhere to the discharge port surface 81 is invaded into the discharge port 82 can be prevented.

Although the color recording apparatus according to the foregoing embodiment comprises the carriage 2 to which the four recording heads (head cartridges) 1 are fastened, the number of the recording heads 1 is not limited to four. One recording head or another number of recording heads may be employed. The problem of the color mixture peculiar to the color recording operation can be overcome by the foregoing embodiment.

Figure 14:
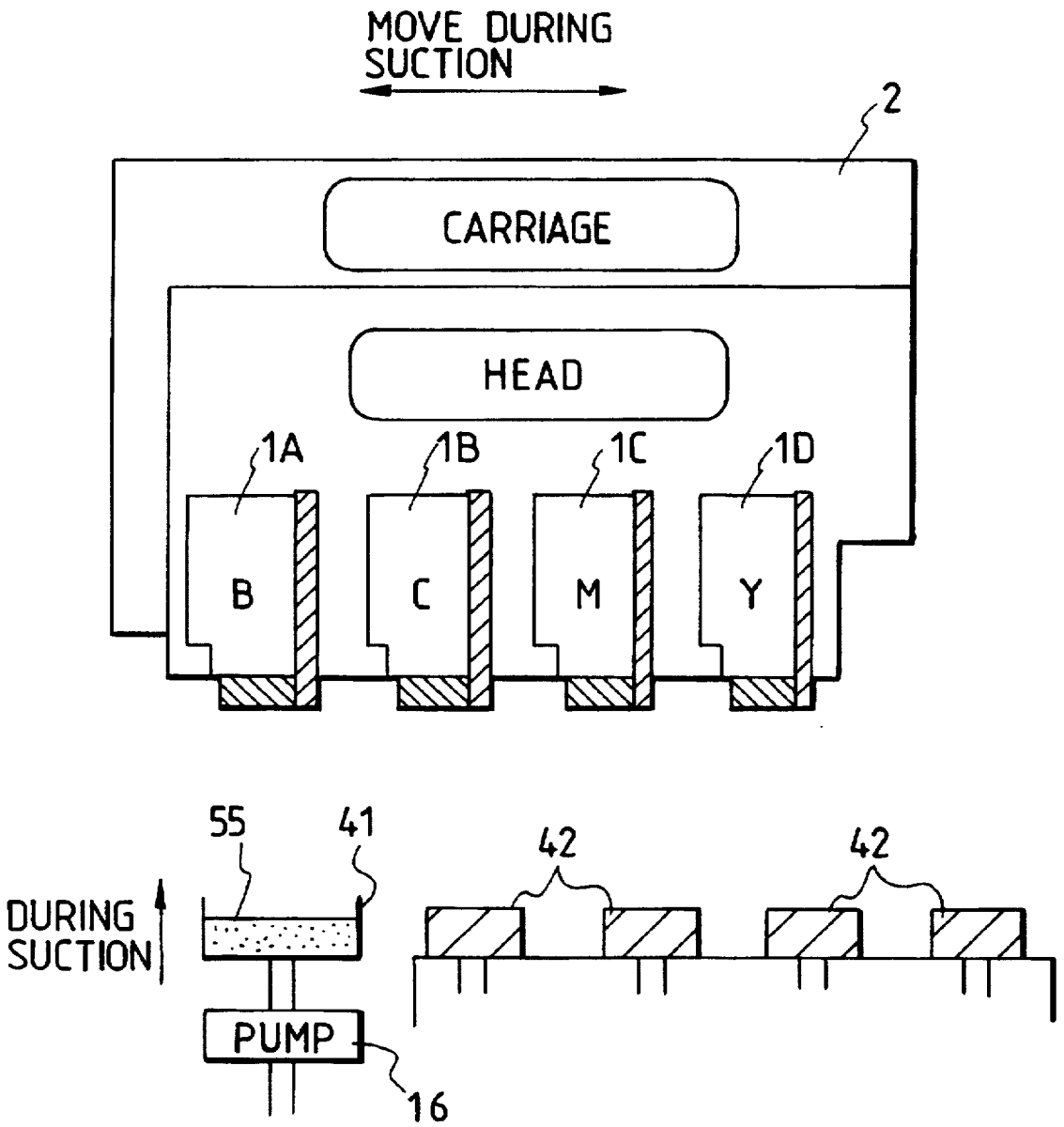
FIG. 14 is a schematic front elevational view which illustrates the structure and the operation of another example of a suction recovery means of an ink jet recording apparatus according to the present invention.

FIG. 14 is a schematic view which illustrates the structure and the operation of a fourth embodiment of a suction recovery means of an ink jet recording apparatus according to the present invention. As shown in FIG. 14, this embodiment comprises suction recovery means composed of one suction cap 41 and one suction pump 16 to sequentially perform the suction recovery operations of black (B), cyan (C), magenta (M) and yellow (Y) recording heads (head cartridges) 1A to 1D disposed on the carriage 2. The ink to be sucked from the recording head 1 by the suction pump 16 is sent and discharge to a waste-ink tank (omitted from illustration) by way of a tube or an ink passage. The waste-ink tank may be made of porous ink absorber capable of absorbing and holding the waste ink. Therefore, protection (reservation) caps 42, the number of which is the same as that of the recording heads 1, are disposed in addition to the suction cap 41. The number of the protection caps 42 may be lesser than that of the recording heads 1 by one if the suction cap 41 is used as a protection cap. The suction cap 41 has the porous ink absorber 55 enclosed therein.

The capacity of the ink absorber 52 shown in FIG. 14 is determined to be a value which is larger than the quantity of suction (the quantity of forcible discharge realized during one operation) performed by a suction pump 16 or a value larger than the internal capacity of an ink passage of the recording head 1. By making the capacity of the ink absorber 55 to be enclosed in the cap 41 to be larger than the quantity of suction performed by the suction pump 16 or a value larger than the internal capacity of an ink passage of the recording head 1 at the time of performing the suction recovery of a multiplicity of recording heads 1 by one cap (suction cap) 41 as shown in FIG. 14, the ink left on the discharge port surface 81 can be eliminated after the suction has been recovered. Therefore, the ink mixture at the discharge port 82 of each recording head 1 can be prevented.

When the suction of the cyan recording head 1B is recovered after the suction of the black recording head 1A has been recovered, the ink sucked into the black recording head 1A is substantially fully brought to the ink absorber 55 in the cap. Then, the ink is sent to the waste-ink tank, and a predetermined operation (idle suction operation or the like) is performed to sent the ink in the ink absorber 55 to the waste-ink tank. As a result, the quantity of the ink absorbed into the ink absorber 55 is recovered to a quantity near the initial value.

Then, the suction of the cyan recording head 1B is recovered. Since a predetermined quantity of ink absorber 55 has been enclosed in the suction cap 41 at this time, the ink flow in the cap is directed (in a direction from the recording head 1B toward the suction pump 16). Therefore, even if previous black ink is left in the ink absorber 55, flowing of the black ink to the cyan recording head 1B can be inhibited. Therefore, the invasion into the discharge port 82 of the recording head 1B is prevented and, accordingly, the problem of the mixture of the black ink with the cyan ink can assuredly be prevented. Since the ink between the recording head 1B and the suction cap 41 is, as described at the time of explaining the third embodiment (FIGS. 13A to 13D), brought toward the ink absorber 55 in the cap, the problem of the color mixture occurring such that the different-color ink is mixed with the ink (cyan ink) in the recording head 1B can be assuredly be prevented even if the different-color ink flown due to the wiping operation or the like has been allowed to adhere to the discharge port surface 81 of the recording head 1B.

Therefore, if the suction of a plurality of recording heads is recovered by simple and small-size suction recovery means composed of one suction cap 41 and one suction pump 16 as shown in FIG. 14, this embodiment enables the problem of the color mixture occurring at the time of recovering the suction of each recording head 1 can assuredly be overcome while needing a simple structure in which the ink absorber 55 having a capacity larger than the suction quantity of the pump 16 or the internal capacity of the ink passage of the recording head 1 is enclosed into the suction cap 41. As a result, the cost of the ink jet recording apparatus can be reduced.

Each of the third and the fourth embodiment shown in FIGS. 8 to 14 is arranged as follows:

The caps 14 and 41 for use to recover the suction are filled with the porous ink absorbers 52 and 55 each having a larger ink absorption capacity than the suction quantity of the pump 16 or the internal capacity of the ink passage of the recording head;

The following elements are disposed: the wiping blade 18 which rubs and slides on the discharge port surface 81 of the recording head 1 to wipe out an article such as the ink allowed to adhere to the surface of the discharge port surface 81 to clean the same, the blade cleaner 51 disposed on the substantially the same plane, on which the discharge port surface 81 is disposed, and arranged to rub and slide on the wiping blade 18 to clean the wiping blade 18, and the suction pump 16 for forcibly sucking the ink from the discharge port 82 of the recording head 1 in the capping state; and The following mechanisms are provided: the separation mechanism for separating, at a predetermined timing, separating the suction caps 15 and 41 from the recording head 1; and the mechanism for discharging the ink held in the ink absorbers 52 and 55 in the cap to the waste-ink tank. Therefore, the ink left on the discharge port surface 81 of the recording head 1 can be eliminated after the suction has been recovered. Therefore, the load of the wiping blade 18 and the blade cleaner 51 can be lightened to lengthen their lives. Further, the defective discharge and the deviation due to the article allowed to adhere to the discharge port surface 81 can be prevented. Therefore, an ink jet recording apparatus can be obtained, the ink discharge performance of which and the image quality of which can be maintained for a long time, and which can be assuredly freed from the color mixture at the time of performing the color recording operation.

That is, each of the third and the fourth embodiments is arranged so that the ink absorbers 52 and 55 are enclosed into the caps 15 and 41 for recovering the suction of the recording head 1, and the ink absorption capacity of each of the ink absorbers 52 and 55 is larger than the forcible discharge quantity realized by one operation of the suction pump 16 or the internal capacity of the ink passage of the recording head 1. Therefore, the residual ink allowed to adhere to the discharge port surface 81 of the recording head 1 can substantially be eliminated after the suction has been recovered. Therefore, the performance deterioration of each of the wiping blade 18 and the blade cleaner 51 can be prevented. As a result, an ink jet recording apparatus can be obtained in which the ink discharge from the recording head 1 can be stabilized so that recording can be performed satisfactorily for a long time, and the ink mixture occurring in a case where the plural recording heads 1 for performing a color recording operation are used can assuredly be prevented.

According to the foregoing embodiment, an ink jet recording apparatus can be provided in which the quantity of the waste ink can be reduced to reduce the size of the waste-ink accommodating portion and that of the recording apparatus, and wasteful ink consumption can be reduced to reduce the cost, with which the discomfortable feeling for a user who uses only specific recording means can be eliminated and in which the quantity of suction, the sucking interval and the initial suction pressure corresponding to the differences in the compositions of inks for uses in the respective recording means can be set.

Further, an ink jet recording apparatus can be provided in which the performance deterioration in the wiping means can be provided, and the ink discharge from the recording means can be stabilized, which is capable of performing an excellent recording operation for a long time and in which the ink mixture occurring in the case where the plural recording means are used can be prevented.

The foregoing wiping means is disposed in an ink jet recording apparatus as described hereinafter to reduce the size of the apparatus and to raise the recording speed so that a further preferred structure for the ink jet recording apparatus is provided.

Figure 15:
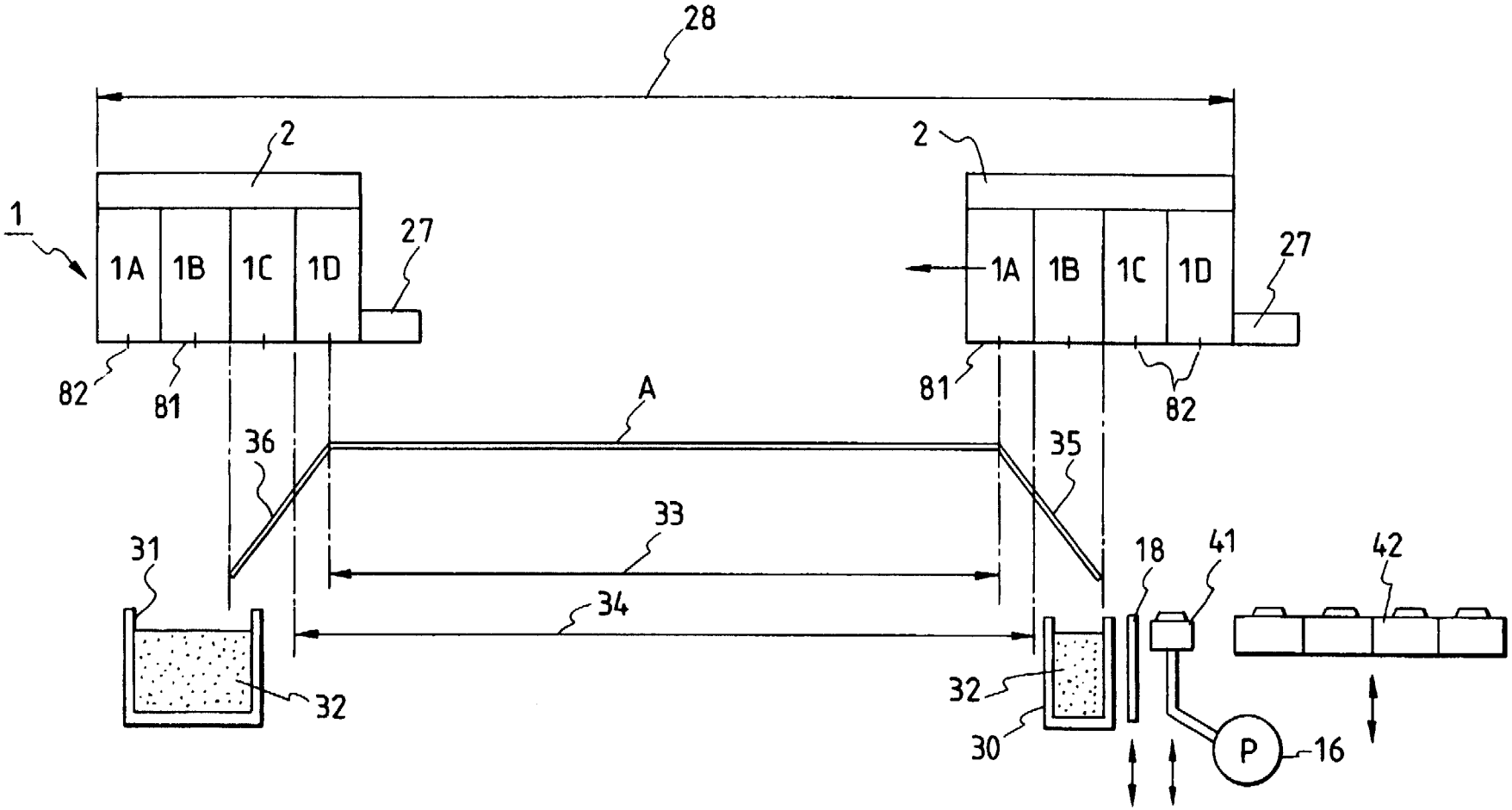
FIG. 15 is a schematic view which illustrates the relationship between the movable range of the carriage and the cleaning means of the recording head of the ink jet recording apparatus.

FIG. 15 is a schematic view which illustrates the relationship between the movable range for the carriage 2 of the ink jet recording apparatus and the cleaning means of the recording heads 1. Referring to FIG. 15, trapezoidal thick line A designates the speed diagram (the speed profile) of the carriage 2, 33 represents a constant-speed range for the carriage 2, 34 represents the maximum width of the recording member, 35 and 36 represent the acceleration range for the carriage 2, and 28 represents the recording region set in the movable range for the carriage 2. The constant-speed range 33 for the carriage 2 is determined to be the same size as that of the image formation range if a maximum-width recording member is used.

The recording region 28 for the carriage 2 is, as illustrated, a range (region) which covers the overall body of the carriage 2 when the discharge port 82 of the recording head 1 is moved to a position, which faces an end of the constant-speed range 33 for the carriage 2, to a position which faces the other end of the same. If a plurality of the recording heads 1 are used as done in this embodiment, the range is determined while using, as the standard, the position at which the discharge port 82 of the recording head in the lowest stream in the carriage movement direction faces the two ends of the forgoing constant-speed range 33.

As shown in FIG. 15, the suction cap 41 for hermetically closing the discharge port surface and the suction pump 16 for generating a negative pressure in the cap 41 constitute the suction recovery mechanism. Further, the elastic member (the foregoing wiper blade) 18 constitutes the wiper mechanism for wiping and cleaning the discharge port surface 81, the elastic member 18 moving forwards to a position at which it interferes with the discharge port surface 81 and which rubs the discharge port surface 81 due to the movement of the carriage 2. Holes 30 and 31 constitute a previous discharge mechanism, the holes 30 and 31 being arranged to receive the previous-discharged ink at the position at which the previous discharge is performed for protecting the discharge port 82 of the recording head 1 from drying. The ink holding member (the ink absorber) 27 mounted on the carriage 2 constitutes a wiper cleaning mechanism for removing and cleaning foreign matters allowed to adhere to the wiper blade.

This embodiments is so arranged that means for cleaning the recording head 1, which comprises the suction recovery mechanisms 41 and 16, the wiper mechanism 18 and the previous discharge holes 30 and 31, is disposed in the recording region 28 of the carriage 2. The protection cap 42 for sealing the discharge port 82 of each recording head 1 is disposed at a position facing the home position of the carriage 2, that is, a position (position projecting to the left in the example illustrated) projecting the recording region 28. The suction cap 41, the wiper blade 18 and the protection cap 42 respectively are movably fastened in the directions designated by arrows (forward and rearward directions).

As shown in FIG. 15, the previous discharge receiving portions (the previous discharge holes) 30 and 31 accommodate the ink holding members (for example, ink absorbers) 32. The ink holding member 32 may be, for example, a hydrophilic foaming agent or unwoven fabric. However, materials capable of holding the ink may be widely employed. As an alternative to the ink holding member 32, an ink receiving member may be formed by a structure comprising fine ribs disposed in the holes 30 and 31. If the recording apparatus is used in a stationary manner, a structure may be employed in which nothing is enclosed in the holes 30 and 31. If a waste-ink reservoir (omitted from illustration) for reserving the ink discharged from the suction pump 16 is disposed, the previous discharge holes 30 and 31 may be allowed to communicate with the waste-ink reservoir. If an interchangeable ink cartridge or a waste-ink cartridge is employed, the previous discharge holes 30 and 31 may be allowed to communicate with the cartridge.

When recording is performed in the structure shown in FIG. 15, the carriage 2 is moved along the guide shaft 3 to scan (main-scan) the recording member. In synchronization with this, each recording head 1 is operated (to discharge the ink) in response to the image signal so that an image is recorded in the image formation range of the recording member. If any one of the recording heads 1 and the discharge ports 82 is not used in the recording operation performed in the image formation range, the ink in the discharge port 82 is made viscous, causing a problem of the defective discharge to arise. Therefore, the previous discharge is performed when the recording head 1 passes over the previous discharge holes 30 and 31 to prevent the defective discharge.

The previous discharge may be performed during the scanning operation of the carriage or stoppage of the same. Since this embodiment is so arranged that the previous discharge holes 30 and 31 are disposed on the two sides of the recording member, the previous discharge for recovering the discharge can assuredly be performed while maintaining the recording speed (the through put) and eliminating the necessity of widening the width of the recording apparatus even if the structure comprises a plurality of recording heads 1 for recording a multi-color image or if a recording head is used which comprises the discharge ports 82 disposed longitudinally in the moving direction of the carriage 2.

This embodiment is so arranged that the cleaning means for cleaning the recording head 1 is disposed in the recording region 28 for the carriage 2, the cleaning means being composed the suction recovery mechanisms 41 and 16, the wiper mechanism 18 and the previous discharge receiving portions 30 and 31. Therefore, an ink jet recording apparatus can be provided in which the defective ink discharge and the discharge deviation can be satisfactorily prevented at the time of the recording operation thereof, the width of which can be minimized, the size and the weight of which can be reduced, and the through put of which can be improved.

Figure 16:
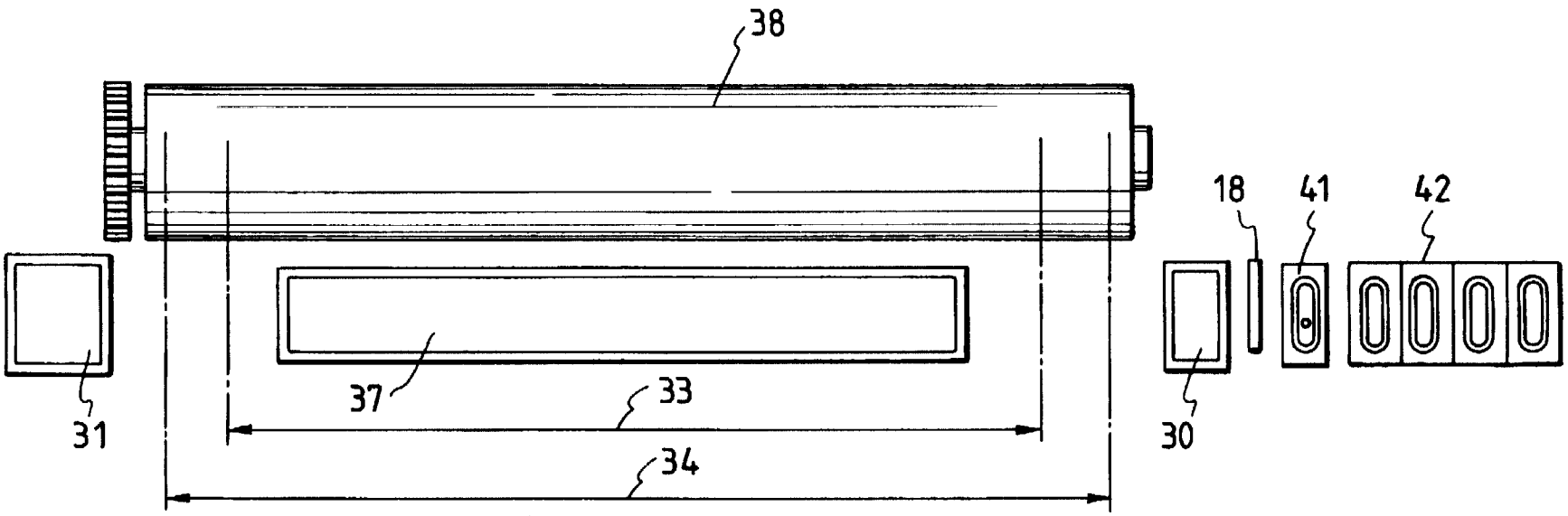
FIG. 16 is a schematic plan view which illustrates an essential portion of the structure of another example of the ink jet recording apparatus according to the present invention.

FIG. 16 illustrates a structure in which the previous discharge receiving portion (the previous discharge hole) 37 is also formed in the constant-speed range 33 of the carriage 2 or the range 34 of the recording member in addition to the structure according to the foregoing embodiment. Referring to FIG. 16, reference numeral 38 represents a paper conveyance roller, and the previous discharge receiving portion 37 is disposed on the platen (omitted from illustration). Since the constant-speed range 33 of the carriage 2 is substantially the same as the image formation range of the recording member, it can be said that the previous discharge hole 37 is formed in the image formation range.

If a color-image recording operation is performed, mixture of the inks of different colors occurring in the discharge port 82 critically deteriorates the quality of the image. In order to prevent the ink mixture, the previous discharge must be performed by a maximum times and a largest quantity. Since the structure shown in FIG. 16 comprises the additional previous discharge hole 37 in the range 34 of the recording member, portions for receiving multiple previous discharges can be secured. Therefore, the capacity of the hole 37 can significantly be enlarged. If a large quantity of the ink is received, the disposition of the large-capacity previous discharge hole 37 realizes a great advantage from the viewpoint of the ink holding force and the ink evaporating characteristics. The timing at which the previous discharge is made into the previous discharge hole (the previous discharge receiving portion) 37 is determined to a moment at which the hole 37 is not covered with the recording member, such as a moment before the supply of the recording member or a moment after the paper has been discharged.

FIG. 17 illustrates a structure in which the previous discharge hole (the previous discharge receiving portion) 39 is formed in the range 34 for the recording member. Referring to FIG. 17, reference numeral 40 represents a paper conveyance roller, and the previous discharge hole 39 is disposed on the platen (omitted from illustration). In this embodiment, the paper conveyance roller 40 is composed of three rollers fixed at the two end portions and the intermediate portion of a roller shaft 40. The previous discharge hole 39 is composed of two holes formed between the conveyance rollers 40. This embodiment is different from the foregoing embodiments in that the separation-structure paper conveyance roller 40 is used and the two previous discharge hole 39 are additionally formed. The residual arrangements are substantially the same as the foregoing embodiment shown in FIG. 15. Therefore, the corresponding portions are given the same reference numerals and their descriptions are omitted here.

Since the structure shown in FIG. 17 comprises the additional previous discharge receiving portion (the previous discharge hole) 39 in the range 34 of the recording member, portions for receiving multiple previous discharges can be secured. Therefore, the capacity of the hole 39 can significantly be enlarged. If a large quantity of the ink is received, the cleaning means for cleaning the recording head 1 exhibiting a great advantage can be structured from the viewpoint of the ink holding force and the ink evaporating characteristics. This embodiment shown in FIG. 17 is so arranged that the paper conveyance roller 40 is formed into the separation structure, the previous discharge hole 39 is disposed between the rollers, and the protection cap 42, the suction cap 41, the wiper blade 18, the previous discharge holes 30 and 31 are disposed on the same configuration line on which the previous discharge hole 39 is disposed. Therefore, the cleaning means for cleaning the recording head 1 composed of the foregoing elements can be disposed adjacent to the shaft of the paper conveyance roller 40. As a result, an effect can be obtained in that the structure of the recording apparatus can be made further compact. The timing at which the previous discharge is made into the previous discharge hole 39 is determined to a moment at which the hole 39 is not covered with the recording member, such as a moment before the supply of the recording member or a moment after the paper has been discharged. The ink holding member may be provided for the roller 40.

The operation of each element (mechanism) forming the cleaning means for cleaning the recording head 1 will now be described with mainly reference to FIG. 15. First, the operation of the wiper blade 18 will be described. The wiper blade 18 is so arranged to be capable of moving forwards/rearwards in directions designated by arrows shown in FIG. 15 to eliminate the contamination of the discharge port surface 51 and to wipe out the wet ink by a predetermined operation thereof. In usual, the wiper blade 18 is accommodated at a retraction position at which the contact with each recording head 1 can be prevented. If the cleaning operation must be performed, the wiper blade 18 is moved forwards toward the recording head 1. By moving the carriage 2 from the right portion to the left portion shown in FIG. 15 in a state where the wiper blade 18 has been moved forwards, the discharge port surface 81 is cleaned (cleaned by wiping) by the wiper blade 18. When the two recording heads 1A and 1B are cleaned up as shown in FIG. 15, the carriage 2 is introduced into the recording region 28.

After the residual recording heads 1C and 1D have been cleaned, the carriage 2 is further moved to the left portion, causing the ink holding member 27 disposed on the carriage 2 to be in contact with and slide on the wiper blade 18. As a result, the ink or the like wiped by the blade 18 is transported to the ink holding member 27. By repeating the foregoing cleaning operation, the ink and dust are accumulated in the ink holding member 27. If the ink or dust is accumulated in the ink holding member 27, the carriage 2 is moved until the ink holding member 27 is positioned in front of the suction cap 7. Then, the suction cap 41 is pressed against the ink holding member 27, and the suction pump 16 is operated so that the ink and the like on the ink holding member 27 is removed by sucking. The foreign matter such as the ink thus-sucked is introduced through the suction pump 16 to a waster ink reservoir, or an interchangeable ink cartridge or a water ink cartridge (omitted from illustration). As a result of the foregoing operation, the ink holding member which is the cleaning member of the wiper blade 18 can always be kept clean. The suction cap 41 is operated in accordance with the foregoing suction recovery sequence, the cap 41 being also disposed in the recording region 28 of the carriage 2.

Each of the foregoing embodiments comprises the protection caps 42 for covering (for preventing drying of the ink in the discharge port 82) the discharge port surface 81 of each recording head 1 by the number (four) which is the same as the number of the recording heads 1. However, the structure according to this embodiment is so arranged that one suction cap 41 is used so that the suction cap 41 can be used as a protection cap for any one of the recording heads (for example, the recording head 1A). That is, the foregoing cleaning means enables the number of the protection caps 42 to be N or N−1 assuming that the number of the employed recording heads 1 is N. If N−1 protection caps 42 are used, the suction cap 41 acts as a function of the protection cap 42. If the recording apparatus is not used, one suction cap 41 and N−1 protection caps 42 cap N recording heads 1.

When the protection cap 42 is brought into hermetically contact with the discharge port surface 81 (when the apparatus is used), the inner pressure in the protection cap 42 must be constant or in a state where the pressure is not changed. The reason for this lies in that the ink discharge performance must be maintained when the recording is again started after capping has been performed. FIGS. 18 to 21 respectively are schematic cross sectional views which illustrate examples of the structure of the protection cap capable of meeting the foregoing requirement.

Figure 18:
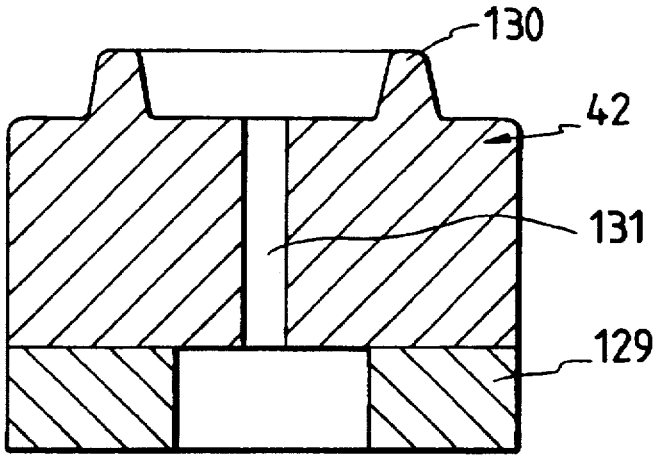
FIG. 18 is a schematic vertical cross sectional view which illustrates a first structural example of a protection cap.

Referring to FIG. 18, reference numeral 129 represents a cap holding member for holding the protection cap 42, 130 represents a rib portion of the cap 42 which comes in contact with the discharge port surface 81 of the recording head 1, and 131 represents a communication hole for allowing the inside portion of the cap 42 to communicate with the atmosphere. The foregoing communication hole 131 is a small hole which is capable of preventing drying of the discharge port 82 at the time of the capping operation.

Figure 19:
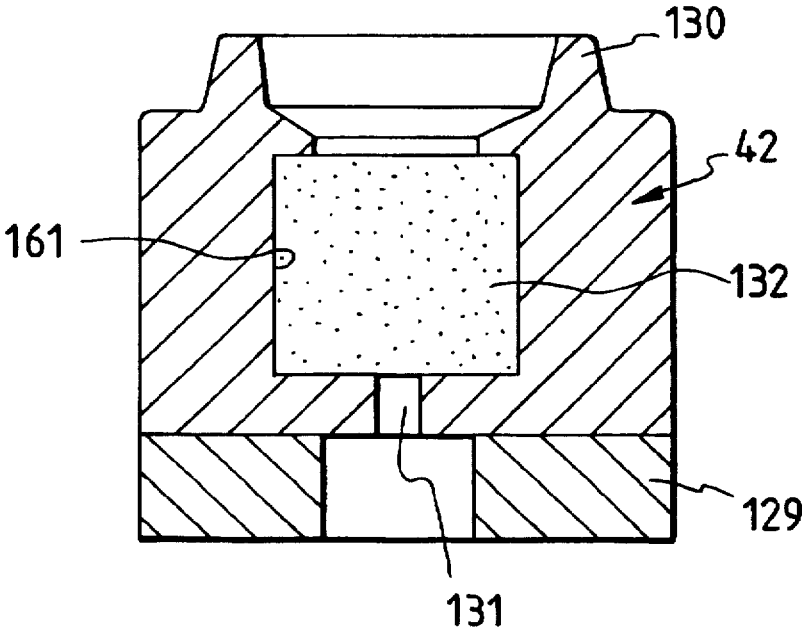
FIG. 19 is a schematic vertical cross sectional view which illustrates a second structural example of a protection cap.

Referring to FIG. 19, reference numeral 129 represents a cap holding member for holding the protection cap 42, 130 represents a rib portion of the cap 42, 131 represents a communication hole for allowing the inside portion of the cap 42 to communicate with the atmosphere, and 132 represents an ink holding member. In this embodiment, a hollow portion 161 is formed in the cap 42, the hollow portion 161 being filled with the ink holding member 132. As the ink holding member 132, a porous ink absorber or the like exhibiting excellent ink absorbing characteristics is used, the ink holding member 132 being impregnated with ink or fluid which cannot easily be evaporated. Also the communication hole 131 according to this embodiment is a small hole which is capable of preventing drying of the discharge port 82 at the time of the capping operation.

Figure 20:
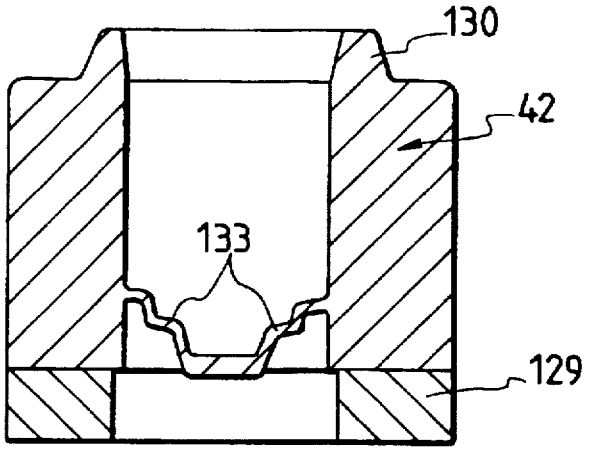
FIG. 20 is a schematic vertical cross sectional view which illustrates a third structural example of a protection cap.

Referring to FIG. 20, reference numeral 129 represents a cap holding member for holding the protection cap 42, and 130 represents a rib portion of the cap 42. In this embodiment, the inside portion of the cap 42 is hermetically sealed with a diaphragm-type thickness-deviation portion 133 at the time of the capping operation. The thickness-deviation portion 133 is formed by thinning a portion of the cap 42 to be able to absorb the pressure change occurring in the cap 42.

Figure 21:
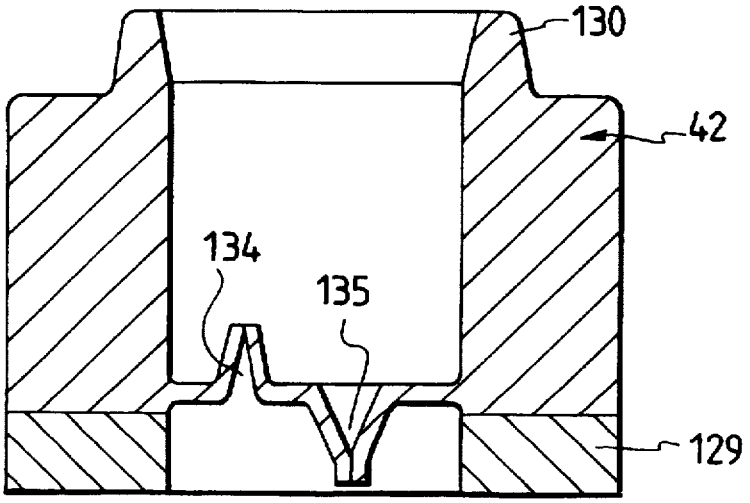
FIG. 21 is a schematic vertical cross sectional view which illustrates a fourth structural example of a protection cap.

Referring to FIG. 21, reference numeral 129 represents a cap holding member for holding the protection cap 42, and 130 represents a rib portion of the cap 42. In this embodiment, the inside portion of the cap 42 is hermetically sealed with check valves 134 and 135 which are operated in the opposite directions at the time of the capping operation. The illustrated check valves 134 and 135 are formed by portions of the cap 42. When the pressure in the cap 42 has been raised to a level higher than a predetermined level, the valve 135 is operated in the opening direction so that the pressure is lowered. If the pressure in the cap 42 is lower than the predetermined level, the valve 134 is operated in the opening direction so that a predetermined pressure (the atmospheric pressure) is restored.

FIGS. 22 to 27 are schematic views which illustrate the structural examples of a suction-quantity adjustment mechanism for adjusting the ink suction quantity at the time of the suction recovery operation. Referring to FIGS. 22 to 27, the suction quantity adjustment mechanism and the operations of the suction cap 41 and the recording head 1 will now be described. The suction recovery operation must be so performed that the quantity of the ink to be sucked from the recording head 1 is adjusted. The reason for this is that the wasteful consumption of the ink must be prevented and the time taken to complete the suction recovery operation must be shortened.

Figure 22:
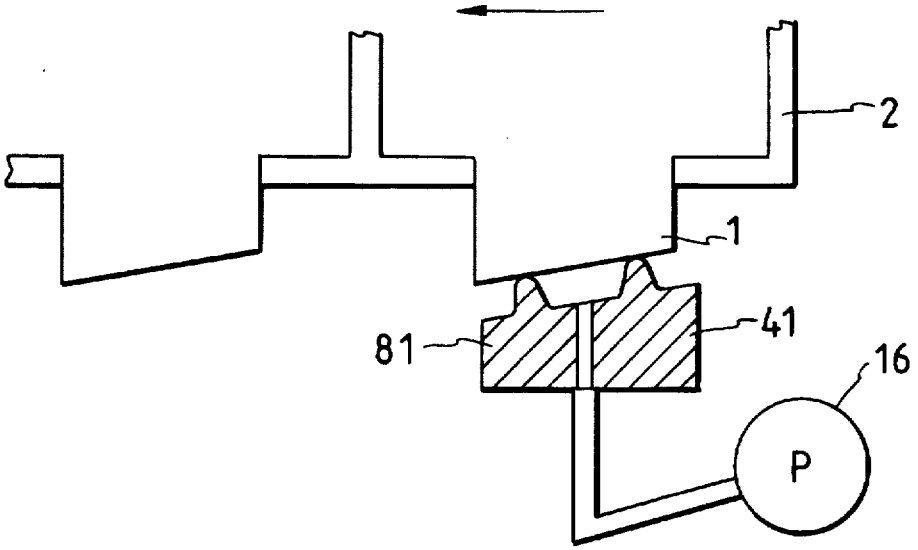
FIG. 22 is a schematic and partially-broken front elevational view which illustrates a state of a suction operation of a first structural example of an ink suction quantity adjustment mechanism.
Figure 23:
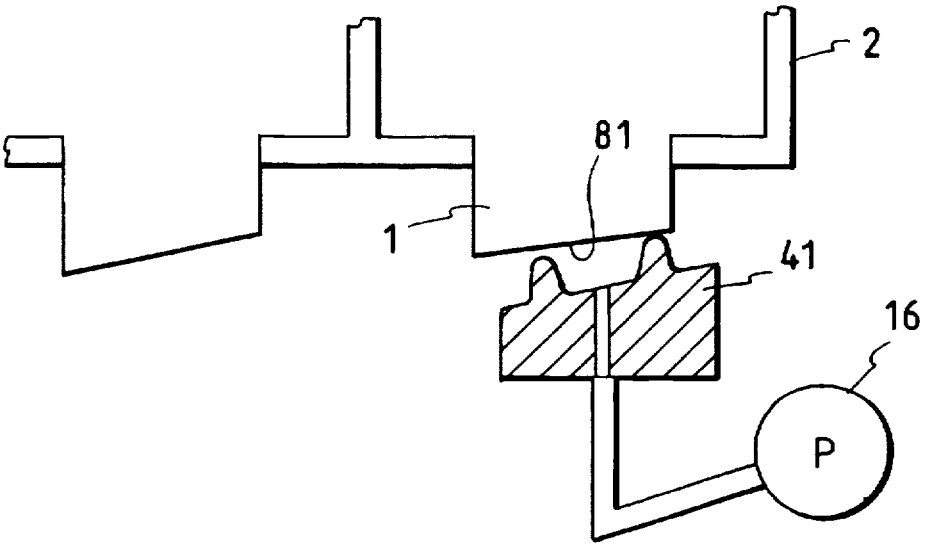
FIG. 23 is a schematic and partially-broken front elevational view which illustrates a state where the suction operation of the ink suction quantity adjustment mechanism shown in FIG. 22 is stopped.

FIG. 22 is a partially-broken front elevational view which illustrates a state of the first structural example realized during the sucking operation. FIG. 23 is a partially-broken front elevational view which illustrates a state where the suction operation shown in FIG. 22 is stopped. When negative pressure is generated by the suction pump 16 in a capping state as shown in FIG. 22, the negative pressure is generated in a space (inside portion of the cap) between the suction cap 41 and the recording head 1 (specifically, the discharge port surface 81). The negative pressure sucks the ink from the recording head 1 (specifically, from the discharge port 82) so that the negative pressure is raised. In this embodiment, the surface on which the cap 41 and the recording head 1 come in contact with each other is inclined in the illustrated direction. Therefore, when the carriage 2 is moved to the left portion shown in the drawing, a gap can be formed between the recording head 1 and the cap 41 as shown in FIG. 23. By realizing a state shown in FIG. 23 by shifting the carriage 2 to the left portion of the drawing before the negative pressure in the cap is completely raised, the suction recovery operation can be stopped at the foregoing moment. Therefore, the carriage 2 is moved at the timing at which the carriage 2 is moved, that is, at a certain time from a moment at which the generation of the negative pressure has been commenced by making use of the pump 16 so that the quantity of the ink to be sucked from the recording head 1 can be adjusted.

Figure 24:
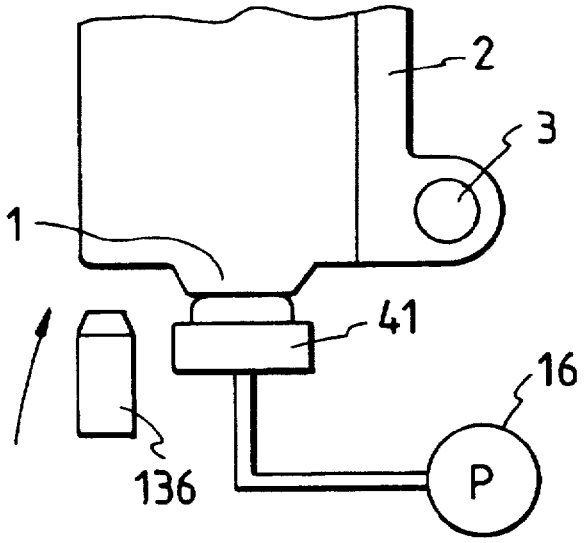
FIG. 24 is a schematic and partially-broken front elevational view which illustrates a state of the suction operation of a second structural example of an ink suction quantity adjustment mechanism.
Figure 25:
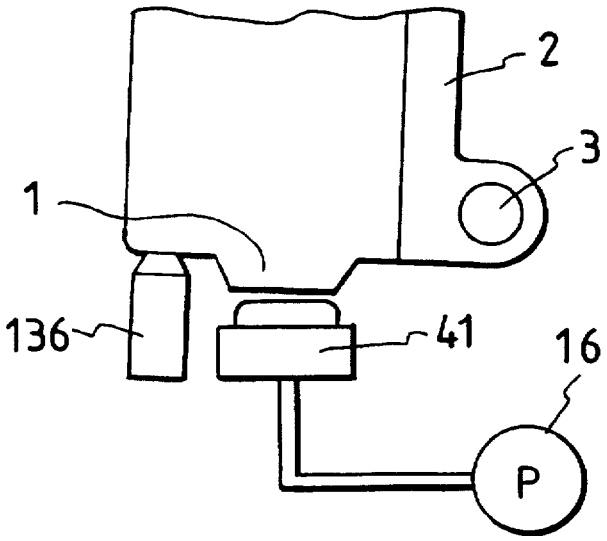
FIG. 25 is a schematic side elevational view which illustrates a state where the suction operation of the ink suction quantity adjustment mechanism shown in FIG. 24 is stopped.

FIG. 24 is a side elevational view which illustrates a state where the second structural example is performing the suction operation. FIG. 25 is a side elevational view which illustrates a state where the suction operation shown in FIG. 24 is stopped. This embodiment is arranged in such a manner that an operation member 136 disposed in the apparatus body is used to move (rotate) the carriage 2 in a direction designated by an arrow around a guide shaft 3. Similarly to the foregoing embodiment, when negative pressure is generated by the suction pump 16 in the capping state, the negative pressure is generated in the suction cap 41. The negative pressure suck the ink from the recording head 1 so that the negative pressure is relaxed. The operation member 136 is operated after a certain time has passed from the commencement of the suction recovery operation before the negative pressure in the cap 41 is completely relaxed so that the carriage 2 is moved in a direction designated by an arrow. As a result, a gap is formed between the recording head 1 and the cap 1 as shown in FIG. 25, causing the suction recovery operation to be stopped. Therefore, by determining the timing at which the carriage 2 is moved, the quantity of the ink to be sucked from the recording head 1 can be adjusted similarly to the foregoing embodiment.

Figure 26:
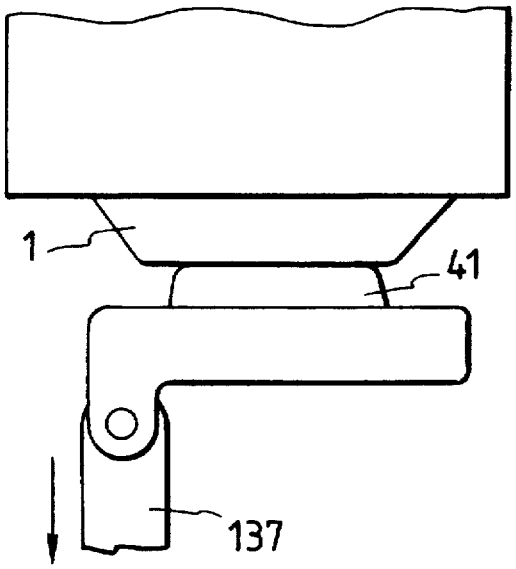
FIG. 26 is a schematic front elevational view which illustrates a state of the suction operation of a third structural example of an ink suction quantity adjustment mechanism.
Figure 27:
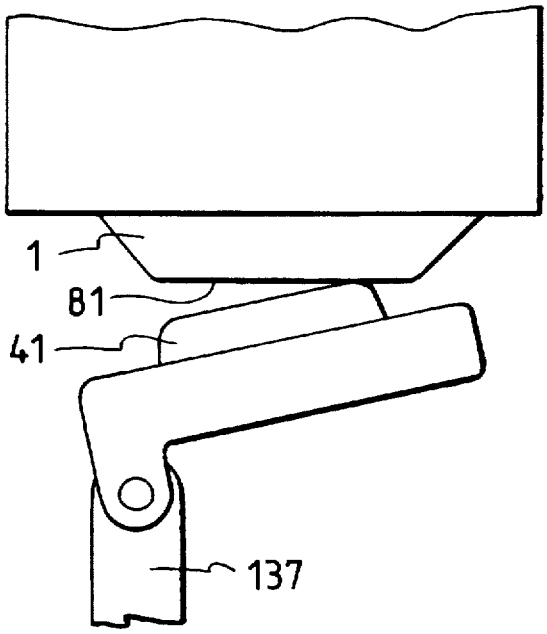
FIG. 27 is a schematic front elevational view which illustrates a state where the suction operation of the ink suction quantity adjustment mechanism shown in FIG. 26 is stopped.

FIG. 26 is a front elevational view which illustrates a state where the third structural example is performing the suction operation. FIG. 27 is a front elevational view which illustrates a state where the suction operation shown in FIG. 26 is stopped. This embodiment is so arranged that a pulling member 137 disposed in the apparatus body is used to separate the cap 41 from the recording head 1. When negative pressure is generated by the suction pump in the capping state similarly to the foregoing embodiment, negative pressure is generated in the suction cap 41. The negative pressure sucks out the ink from the recording head 1 so that the negative pressure is relaxed. Then, the pulling member 137 is driven in a direction designated by an arrow after a predetermined time has passed but before the negative pressure in the cap 41 is completely relaxed. As a result, a gap can be formed between the recording head 1 and the cap 41 as shown in FIG. 27. Therefore, the suction recovery operation can be stopped. Therefore, by determining the timing at which the pulling member 137 is driven, the quantity of the ink to be sucked from the recording head 1 can be adjusted similarly to the foregoing embodiment.

Since this embodiment is so arranged that the cleaning means for cleaning the recording means is disposed in the range of the recording region set in the movable range for the carriage, an ink jet recording apparatus can be provided in which the defective ink discharge and the deviation can be prevented at the time of the recording operation, the width of which can be minimized, the size and the weight of which can be reduced, and the through put of which can be improved.

The ink jet recording apparatus comprising the foregoing recovery mechanism performs a recording operation in the following recording operational manner so that a high quality image can stably be recorded and the size of the apparatus can be reduced.

That is, the recording apparatus according to this embodiment is so arranged that recording is performed by using different recording heads (the recording means) at the time of the forward movement of the movable member 10 (the movement in a direction designated by an arrow A) and at the time of the rearward movement (the movement in a direction designate by an arrow B). Further, the plural recording heads 11 (four in the case shown in FIGS. 1A to 1D) are divided into two groups in the movement direction. The recording is performed in such a manner that the recording heads disposed downstream in the direction of the forward movement are used at the time of the forward movement and those disposed downstream in the direction of the rearward movement are used at the time of the rearward movement. Further, the recording heads for use in the forward movement and those for use in the rearward movement can be operated to be sucked by one power source.

Figure 28:
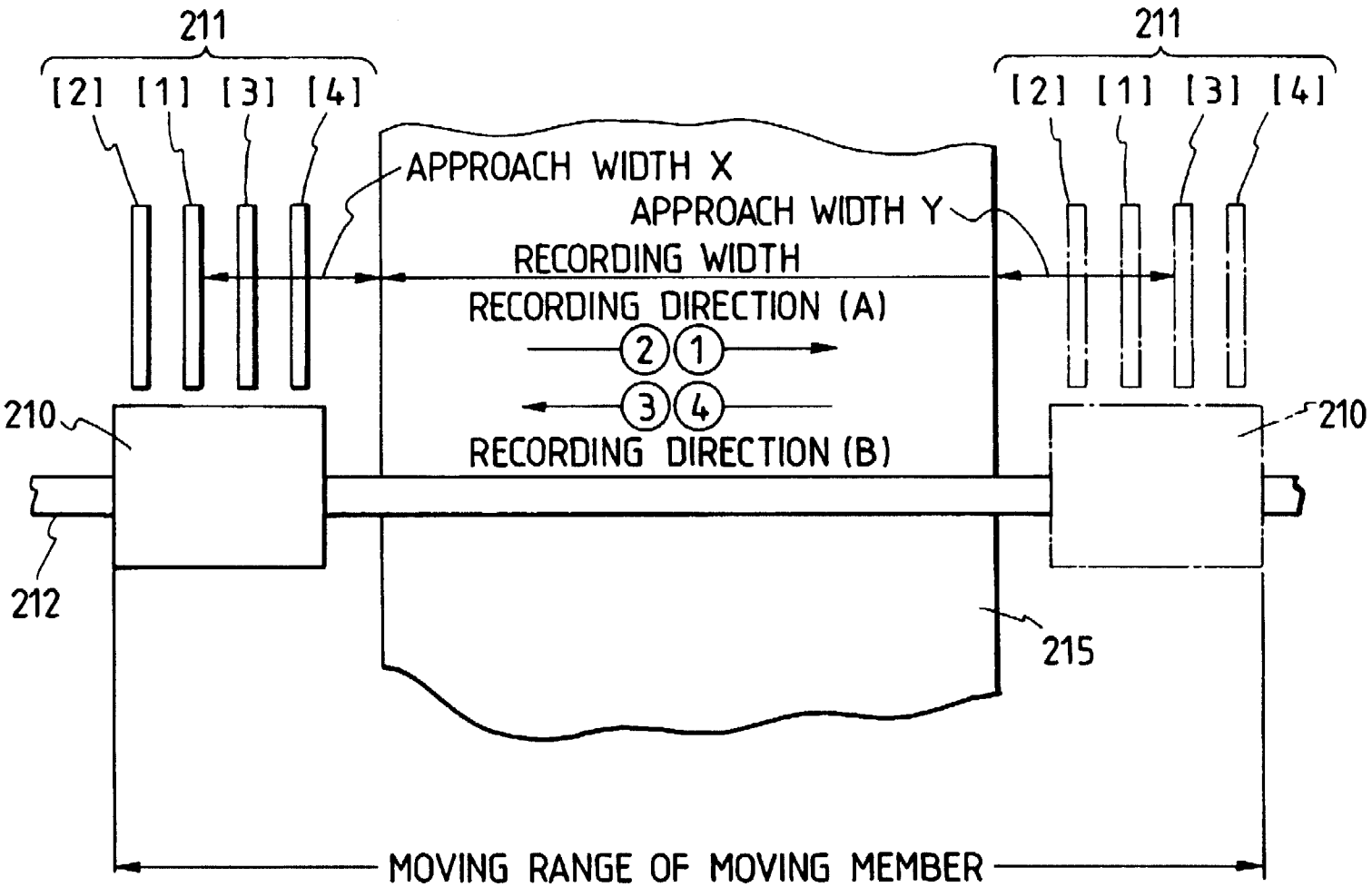
FIG. 28 is a schematic view which illustrates an example of a recording portion of a recording apparatus according to the present invention.

FIG. 28 is a schematic view which illustrates an example of the recording operation to be performed by the recording apparatus according to the present invention. Referring to FIG. 28, four recording heads 211 mounted on a movable member 210 are disposed in the following sequential order: a cyan recording head [1], a black recording head [2], a magenta recording head [3] and a yellow recording head [4] when viewed from the left. When an image is recorded on the recording member 215, a main scanning motor comprising a stepping motor or the like is rotated forwards to move the movable member (carriage) 210 from the left end designated by a solid line in a direction (to the right) designated by an arrow A. Simultaneously, the two recording heads [1] and [2] disposed downstream in the direction of the forward movement are operated in response to desired image signals to discharge the black and the cyan inks so that image for one line is recorded on the recording member 215.

Then, the main scanning motor is rotated inversely so that the movable member 210 is moved from the right end designated by an alternate long and a dashed line in a direction designated by an arrow B along the same column in the direction of the arrow A. Simultaneously, the two residual recording heads [3] and [4] disposed downstream in the direction of the rearward movement are operated in response to desired image signals. As a result, the magenta ink and the yellow ink are discharged to record an image on the recording member 215. As a result of the foregoing process, recording of a color image formed by superposing the black, cyan, magenta and yellow inks, that is, a color image in response to each image signal for one line is completed.

Then, the conveyance motor is rotated to rotate a pair of conveyance rollers (omitted from illustration) and a pair of holding rollers by predetermined quantities, the recording member 215 is conveyed (sub-scanned) by a predetermined quantity in a direction perpendicular to a direction in which the movable member 210 is moved. By repeating a process similar to the previous operation, color images for one line are recorded. By repeating the foregoing process similarly, images are recorded on the overall area of the recording member 215.

Since the foregoing embodiment is arranged in such a manner that the plural (four) recording heads 211 are divided into two groups in the movement direction, the recording heads [1] and [2] disposed downstream in the direction of the forward movement are used to record an image at the time of the forward movement in the direction designated by the arrow A. Further, the recording heads [3] and [4] disposed downstream in the direction of the rearward movement are used to record an image at the time of the rearward movement in the direction designated by the arrow B. Therefore, the approach widths X and Y for the movable member 210 shown in FIG. 28, that is, the distance from the recording head [1] or [3] disposed upstream in the movement direction before the movement is commenced and the end of the recording member 215 in the lower stream in the movement direction can be shortened. Therefore, the movable range for the movable member 210 can be reduced by the corresponding degree so that the size and the weight of the recording apparatus can be reduced. Since the color inks are always recorded in the same sequential order at the time of color-recording an image, the image quality can be stabilized.

Since only the two recording heads of the four recording heads 211 are operated to record an image when recording is performed while moving the movable member 210 in the directions designated by the arrow A and the arrow B, the power source for driving the recording heads 211 is so arranged that one source having the capacity for the two recording heads is used and the source is switched between the directions designated by the arrows A and B. As a result, the size and the cost of the power source for operating the recording heads 211 can be reduced as compared with the conventional structure in which all four recording heads are simultaneously operated to record an image.

Although the black, cyan, magenta and yellow recording is performed in this sequential order in the embodiment shown in FIG. 28, the recording order may be freely changed such that the other ink color is combined or an ink having a different density is combined. The present invention is not limited to the ink jet recording apparatus, and the same may be adapted to another type recording apparatus.

Figure 29:
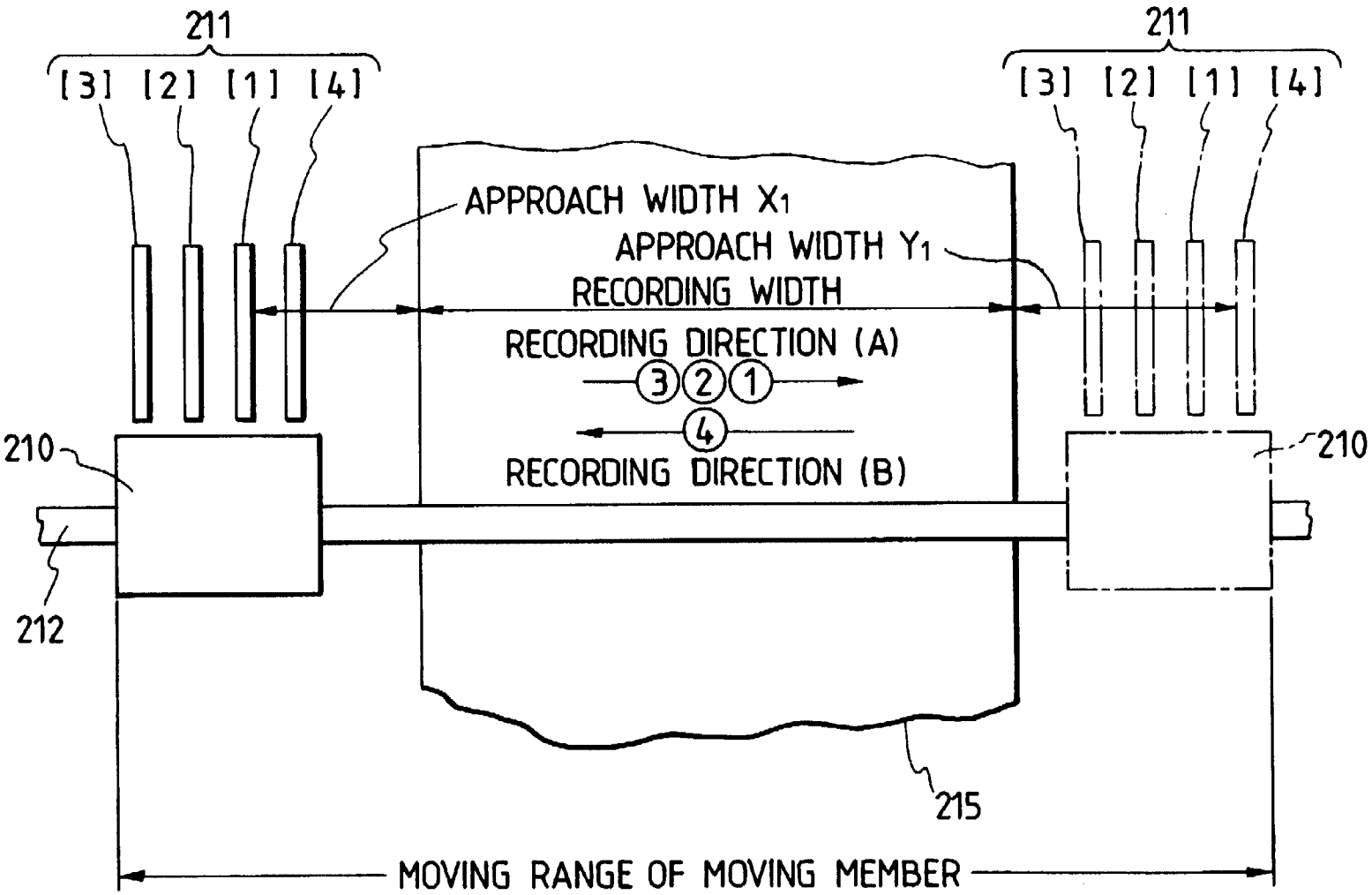
FIG. 29 is a schematic view which illustrates another example of a recording portion of a recording apparatus according to the present invention.

FIG. 29 is a schematic view which illustrates the recording operation of another embodiment of a recording apparatus according to the present invention. Referring to FIG. 28, four recording heads 211 mounted on a movable member 210 are disposed in the following sequential order: a cyan recording head [1], a black recording head [2], a magenta recording head [3] and a yellow recording head [4] when viewed from the left. When an image is recorded on the recording member 215, the movable member (carriage) 210 is moved from the left end designated by a solid line in a direction (to the right) designated by an arrow A. Simultaneously, the three recording heads [3], [1] and [2] disposed downstream in the direction of the forward movement are operated in response to desired image signals to discharge the black, cyan and magenta inks so that image for one line is recorded on the recording member 215.

Then, the movable member 210 is moved from the right end designated by an alternate long and a dashed line in a direction designated by an arrow B along the same column in the direction of the arrow A. Simultaneously, the residual recording head [4] disposed downstream in the direction of the rearward movement is operated in response to desired image signals. As a result, the yellow ink is discharged to record an image on the recording member 215. As a result of the foregoing process, recording of a color image for one line is completed in response to each color image signal, the color image being formed by superposing the black, cyan, and magenta inks recorded in the forward movement and the yellow ink recorded in the rearward movement.

By repeating a process similar to the previous operation, color images for one line are recorded. By repeating the foregoing process similarly, images are recorded on the overall area of the recording member 215.

Since the foregoing embodiment is arranged in such a manner that the plural (four) recording heads 211 are divided into two groups (into a group composed of three heads and a group composed of one head) in the movement direction, the recording heads [1], [2] and [3] disposed downstream in the direction of the forward movement are used to record an image at the time of the forward movement in the direction designated by the arrow A.

Further, the recording head [4] disposed downstream in the direction of the rearward movement is used to record an image at the time of the rearward movement in the direction designated by the arrow B. Therefore, the approach widths $X_1$ and $Y_1$ for the movable member 210 shown in FIG. 29, that is, the distance (the approach width) from the recording head [1] disposed upstream in the movement direction before the forward movement is commenced or the recording head [4] disposed upstream in the movement direction before the rearward movement is commenced and the end of the recording member 215 in the lower stream in the movement direction can be shortened. Therefore, the movable range for the movable member 210 can be reduced by the corresponding degree so that the size and the weight of the recording apparatus can be reduced.

Since only the three recording heads of the four recording heads 211 are operated to record an image when recording is performed while moving the movable member 210 in the direction designated by the arrow A, the power source for driving the recording heads 211 is so arranged that one source having the capacity for the three recording heads is used and the source is switched between the directions designated by the arrows A and B. As a result, the size and the cost of the power source for operating the recording heads 211 can be reduced as compared with the conventional structure in which all four recording heads are simultaneously operated to record an image.

Although the black, cyan, magenta and yellow recording is performed in this sequential order in the embodiment shown in FIG. 9, the recording order may be freely changed such that the other ink color is combined or an ink having a different density is combined. The present invention is not limited to the ink jet recording apparatus, and the same may be adapted to another type recording apparatus.

Figure 30:
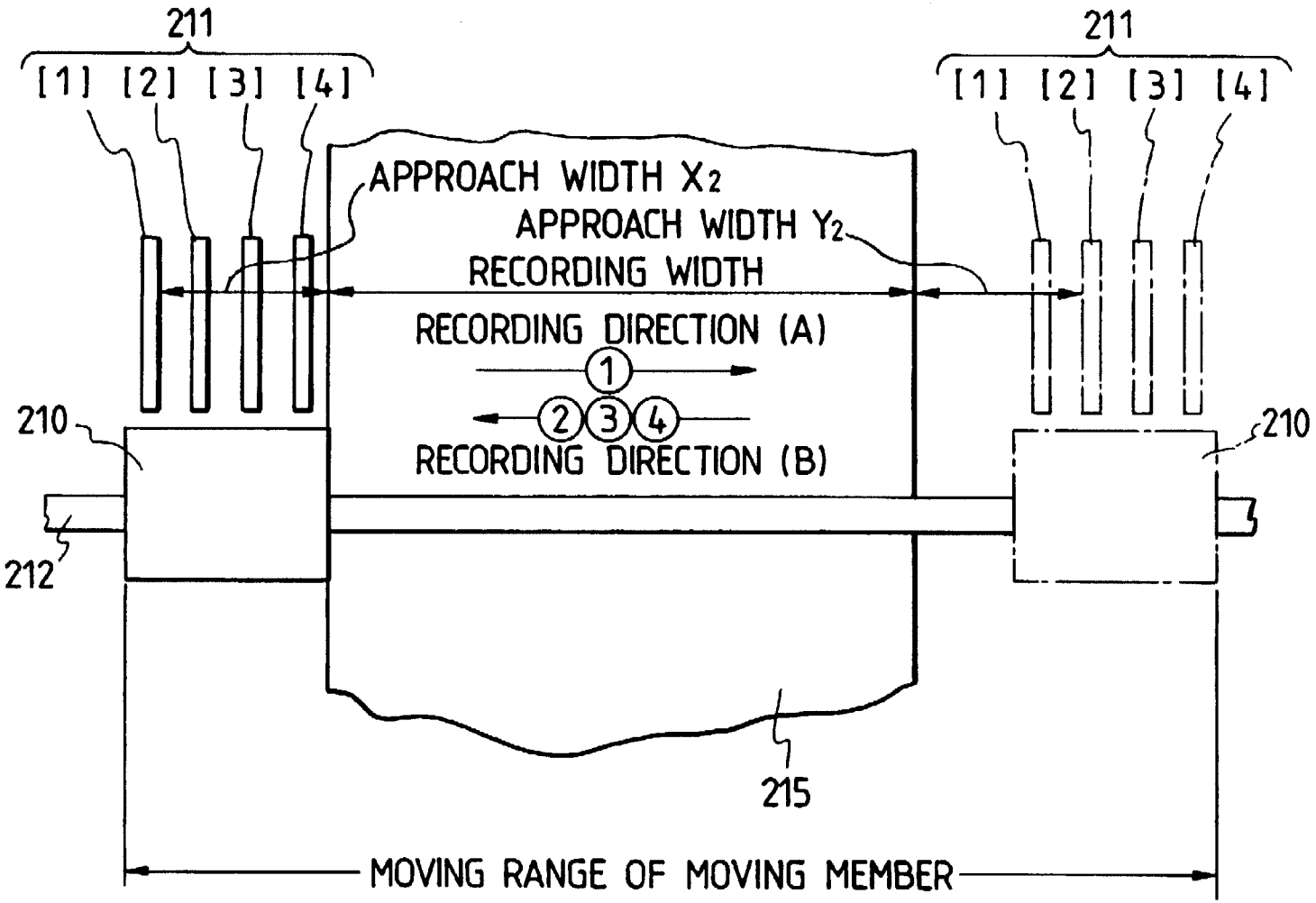
FIG. 30 is a schematic view which illustrates another example of a recording portion of a recording apparatus according to the present invention.

FIG. 30 is a schematic view which illustrates the recording operation of another embodiment of a recording apparatus according to the present invention. Referring to FIG. 30, four recording heads 211 mounted on a movable member 210 are disposed in the following sequential order: a cyan recording head [1], a black recording head [2], a magenta recording head [3] and a yellow recording head [4] when viewed from the left. When the forward movement designated by an arrow A is performed, only one recording head disposed downstream in the direction of the forward movement, that is, only the black recording head [1] is used to record an image. When the rearward movement designated by an arrow B is performed, the three recording heads disposed downstream in the direction of the rearward movement, that is, the cyan recording head [2], the magenta recording head [3] and the yellow recording head [4] are used to record an image. Thus, the reciprocating movement of the movable member 210 records (a color) image for one line.

Also according to the embodiment shown in FIG. 30, the approach widths $X_2$ and $Y_2$ for the movable member 210 shown in FIG. 30, that is, the distance (the approach width) from the recording head [1] disposed upstream in the movement direction before the forward movement is commenced or the recording head [2] disposed upstream in the movement direction before the rearward movement is commenced and the end of the recording member 215 in the lower stream in the movement direction can be shortened similarly to FIG. 29. Therefore, the movable range for the movable member 210 can be reduced by the corresponding degree so that the size and the weight of the recording apparatus can be reduced.

Since only the three recording heads or lesser recording heads are operated to record an image when recording is performed, the power source for driving the recording heads 211 is so arranged that one source having the capacity for the three recording heads is used and the source is switched between the directions designated by the arrows A and B. As a result, the size and the cost of the power source for operating the recording heads 211 can be reduced.

Figure 31:
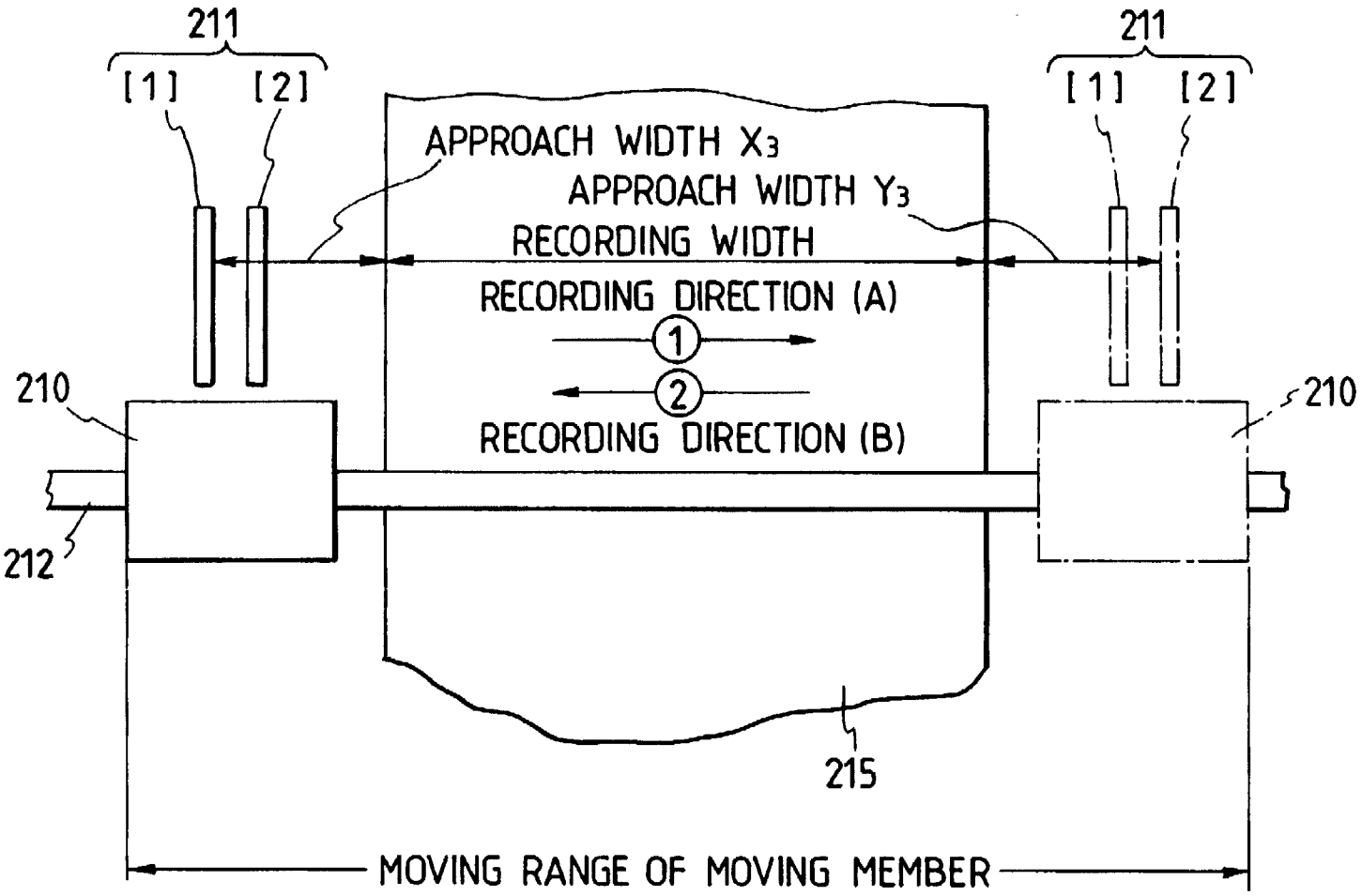
FIG. 31 is a schematic view which illustrates another example of a recording portion of a recording apparatus according to the present invention.

FIG. 31 is a schematic view which illustrates the recording operation of another embodiment of the present invention. In this embodiment, two recording heads 211 are mounted on the movable member 210, the two recording heads 211 being a black recording head [1] and a red recording head [2] for example. When an image is recorded on the recording member 215, the movable member (carriage) 210 is moved from the left end designated by a solid line into the direction (right direction) designated by an arrow A. Simultaneously, one recording head [1] disposed downstream in the forward movement direction is operated in response to a desired image signal so that, for example, black ink, is discharged to record an image for one line on the recording member 215.

Then, the movable member 210 is moved from the right end designated by an alternate long and one dash line in a direction (left direction) designated by an arrow B along the same line in the direction designated by the arrow A. Simultaneously, the residual recording head, that is, one recording head [2] disposed downstream in the direction of the rearward movement is operated in response to a desired image signal so that, for example, red ink is discharged to record an image on the recording member 215. As a result of the foregoing process, a color image for one line formed by superposing black and red inks in this sequential order is recorded.

By repeating the foregoing process, an image is recorded on the overall area of the recording member 215.

Also the embodiment shown in FIG. 31 is arranged in such a manner that the plural (two) recording heads 211 are divided into two sections in the direction of the movement. Further, the recording head [1] disposed downstream in the direction of the forward movement is used to record an image at the time of the forward movement. Further, the recording head [2] disposed downstream in the direction of the rearward movement is used to record an image at the time of the rearward movement. Therefore, the approach widths $X_3$ and $Y_3$ for the movable member 210 shown in FIG. 31 can be shortened. Therefore, the movable range for the movable member 210 can be reduced by the corresponding degree so that the size and the weight of the recording apparatus can be reduced.

Since only one recording head is operated to record an image when recording is performed while moving the movable member 210 in the reciprocating manner, the power source for driving the recording heads 211 is so arranged that one source having the capacity for the one recording head is used and the source is switched between the reciprocating directions . As a result, the size and the cost of the power source for operating the recording heads 211 can be reduced as compared with the conventional structure in which the two recording heads are simultaneously operated to record an image.

Figure 32:
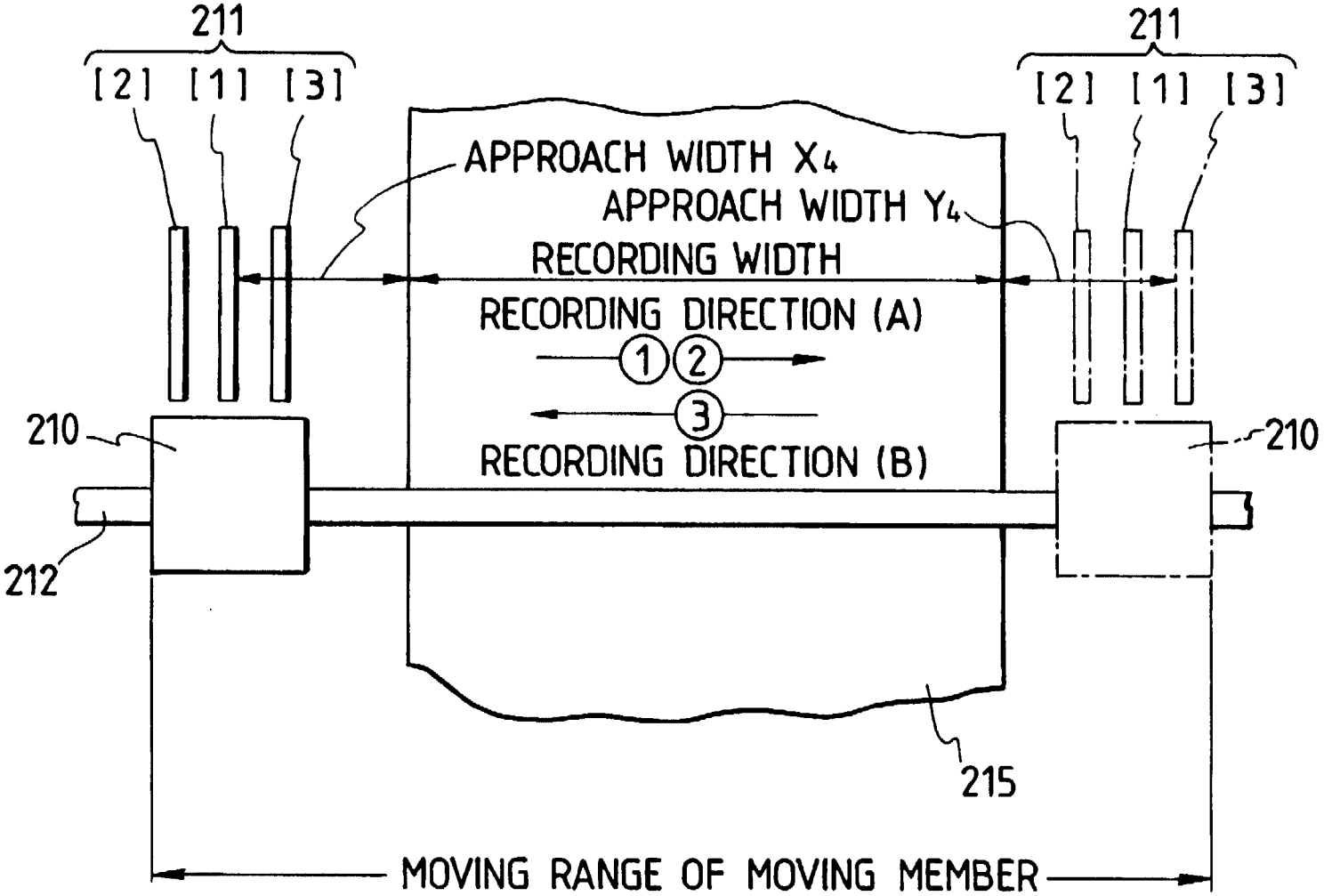
FIG. 32 is a schematic view which illustrates another example of a recording portion of a recording apparatus according to the present invention.

FIG. 32 is a schematic view which illustrates the recording operation of another embodiment of the present invention. In this embodiment, three recording heads 211 are mounted on the movable member 210, the three recording heads 211 being a magenta recording head [2], a cyan recording head [1] and a yellow recording head [3] disposed in this sequential order when viewed from the left for example. When an image is recorded on the recording member 215, the movable member (carriage) 210 is, in the forward movement operation, moved from the left end designated by a solid line into the direction (right direction) designated by an arrow A. The two recording heads [1] and [2] disposed downstream in the forward movement direction are operated in response to a desired image signal so that the cyan and magenta inks are discharged to record an image for one line on the recording member 215.

Then, the movable member 210 is moved from the right end designated by an alternate long and one dash line in a direction (left direction) designated by an arrow B along the same line in the direction designated by the arrow A. Simultaneously, the residual recording head, that is, one recording head [3] disposed downstream in the direction of the rearward movement is operated in response to a desired image signal so that, for example, yellow ink is discharged to record an image on the recording member 215. As a result of the foregoing process, a color image for one line formed by superposing cyan and magenta recorded at the forward movement and yellow recorded at the rearward movement is recorded.

By repeating the foregoing process, an image is recorded on the overall area of the recording member 215.

Also the embodiment shown in FIG. 32 is arranged in such a manner that the plural (three) recording heads 211 are divided into two sections (a group composed of two heads and another head) in the direction of the movement. Further, the recording heads [1] and [2] disposed downstream in the direction of the forward movement are used to record an image at the time of the forward movement. Further, the recording head [3] disposed downstream in the direction of the rearward movement is used to record an image at the time of the rearward movement. Therefore, the approach widths $X_4$ and $Y_4$ for the movable member 210 shown in FIG. 32 can be shortened. Therefore, the movable range for the movable member 210 can be reduced by the corresponding degree so that the size and the weight of the recording apparatus can be reduced. Since the recording operation is performed in such a manner that the two heads are used at the forward movement and one head is used at the rearward movement, the capacity of the power source for driving the recording heads 211 can be reduced to correspond to the two recording heads to be switched. As a result, the size and the cost of the power source for operating the recording heads 211 can be reduced as compared with the conventional structure.

Although the cyan, magenta and yellow recording is performed in this sequential order in the embodiment shown in FIG. 32, the recording order may be freely changed such that the other ink color is combined or an ink having a different density is combined. The present invention is not limited to the ink jet recording apparatus, and the same may be adapted to another type recording apparatus.

Figure 33:
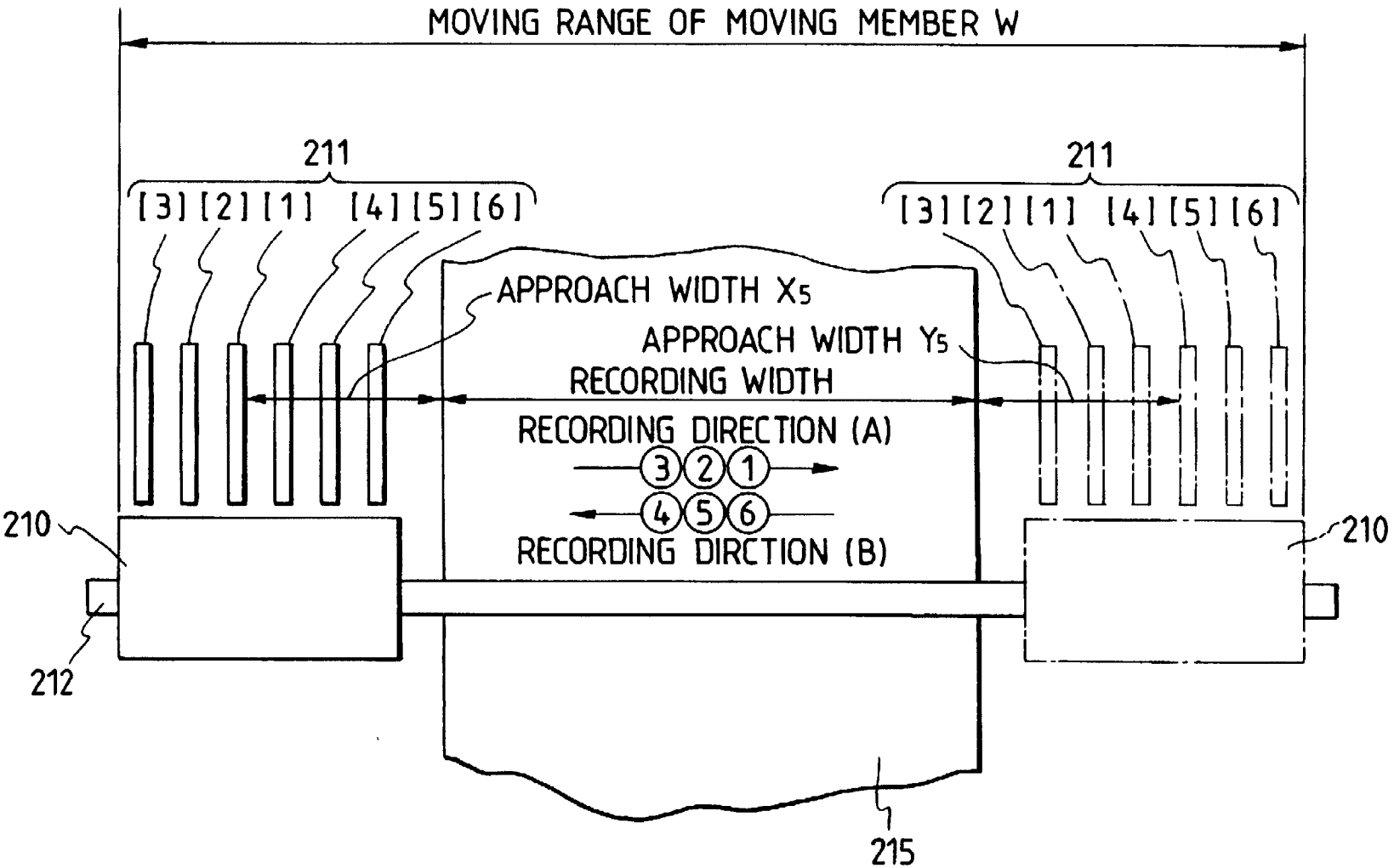
FIG. 33 is a schematic view which illustrates another example of a recording portion of a recording apparatus according to the present invention.

FIG. 33 is a schematic view which illustrates the recording operation according to another embodiment of the present invention. As shown in FIG. 33, six recording heads 211 are mounted on the movable member 210, the recording heads 211 being a light cyan recording head [3], a dark cyan recording head [2], a black recording head [1], a dark magenta recording head [4], a light magenta recording head [5] and a yellow recording head [6] disposed in this sequential order when view from the left portion of FIG. 33. When the movable member 210 is moved forwards (in the direction to the right), the three left recording heads are used to record an image. When the same is moved rearwards (in the direction to the left), the three right recording heads are used to record an image. That is, the plural (six) recording heads 211 are divided into two groups each of which is composed of three heads. The left recording head group is used to record an image at the forward movement, while the right recording head group is used to record an image at the rearward movement. When an image is recorded on the recording member 215, a main scanning motor comprising a stepping motor or the like is rotated forwards to move the movable member (carriage) 210 from the left end designated by a solid line in a direction (to the right) designated by an arrow A. Simultaneously, the three recording heads [1], [2] and [3] disposed downstream in the direction of the forward movement are operated in response to desired image signals to discharge the black, dark cyan and the light cyan inks so that image for one line is recorded on the recording member 215.

Then, the main scanning motor is rotated inversely so that the movable member 210 is moved from the right end designated by an alternate long and a dashed line in a direction designated by an arrow B along the same column in the direction of the arrow A. Simultaneously, the three residual recording heads [4], [5] and [6] disposed downstream in the direction of the rearward movement are operated in response to desired image signals. As a result, the black, dark cyan and the light cyan inks are discharged to record an image for one line on the recording member 215.

By repeating the foregoing process similarly, images are recorded on the overall area of the recording member 215.

Since the foregoing embodiment is arranged in such a manner that the plural (six) recording heads 211 are divided into two groups each composed of three heads, and the three recording heads [1], [2] and [3] disposed downstream in the direction of the forward movement are used to record an image at the time of the forward movement in the direction designated by the arrow A. Further, the recording heads [4], [5] and [6] disposed downstream in the direction of the rearward movement are used to record an image at the time of the rearward movement in the direction designated by the arrow B. Therefore, the approach widths $X_5$ and $Y_5$ for the movable member 210 shown in FIG. 33, that is, the distance from the recording head [1] or [4] disposed upstream in the movement direction before the movement is commenced and the end of the recording member 215 in the lower stream in the movement direction can be shortened. Therefore, the movable range for the movable member 210 can be reduced by the corresponding degree so that the size and the weight of the recording apparatus can be reduced.

Since the half (three) of the six heads 211 are used to record an image by reciprocating the movable member 210, the power source for driving the recording heads 211 is so arranged that one source having the capacity for the three recording heads is used and the source is switched between the forward movement and the rearward movement. As a result, the size and the cost of the power source for operating the recording heads 211 can be reduced as compared with the conventional structure in which all four recording heads are simultaneously operated to record an image.

Although the black, dark cyan, light cyan, dark magenta, light magenta and yellow recording is performed in this sequential order in the embodiment shown in FIG. 33, the recording order may be freely changed such that the other ink color is combined or an ink having a different density is combined. The present invention is not limited to the ink jet recording apparatus, and the same may be adapted to another type recording apparatus. If a large number of the heads are used, the recording operation can be performed similarly.

Figure 34:
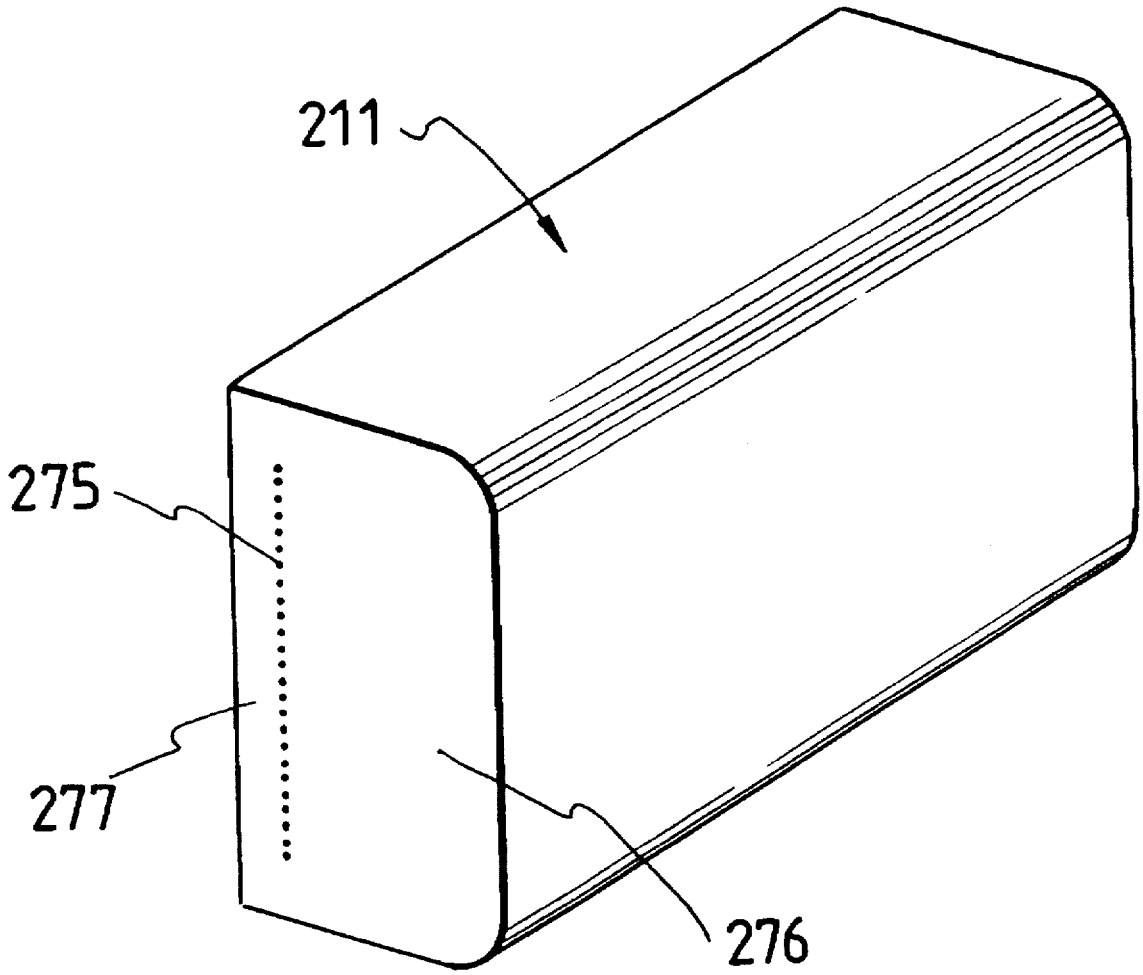
FIG. 34 is a schematic perspective view which illustrates an example of the structure of recording means needing different spaces on the two sides thereof with respect to the main recording scanning portion.

FIG. 34 is a schematic perspective view which illustrates an example in which the recording heads 211 are disposed asymmetrically. That is, the needed spaces for the recording head 211 are disposed asymmetrically with respect to the main scanning portion (the discharge port array in the case of the ink jet recording head). FIG. 10 illustrates a cartridge type recording head integrated with an ink tank.

Referring to FIG. 10, the recording head 211 has, on the front surface thereof (the surface facing the recording member 215), a main scanning portion (the ink discharge portion in the case of the ink jet recording head) 275. The main scanning portion 275 is composed of plural dot elements (the discharge ports 82 in the case of the ink jet recording head) disposed in a direction intersecting the direction of the movement of the movable member 210, the main scanning portion 275 being disposed while being deviated to the right or left as illustrated. Therefore, the recording head 211 has a portion 276, the area of which is large, on either side with respect to the main scanning portion 275, and a small portion 277 on the residual side.

Figure 35:
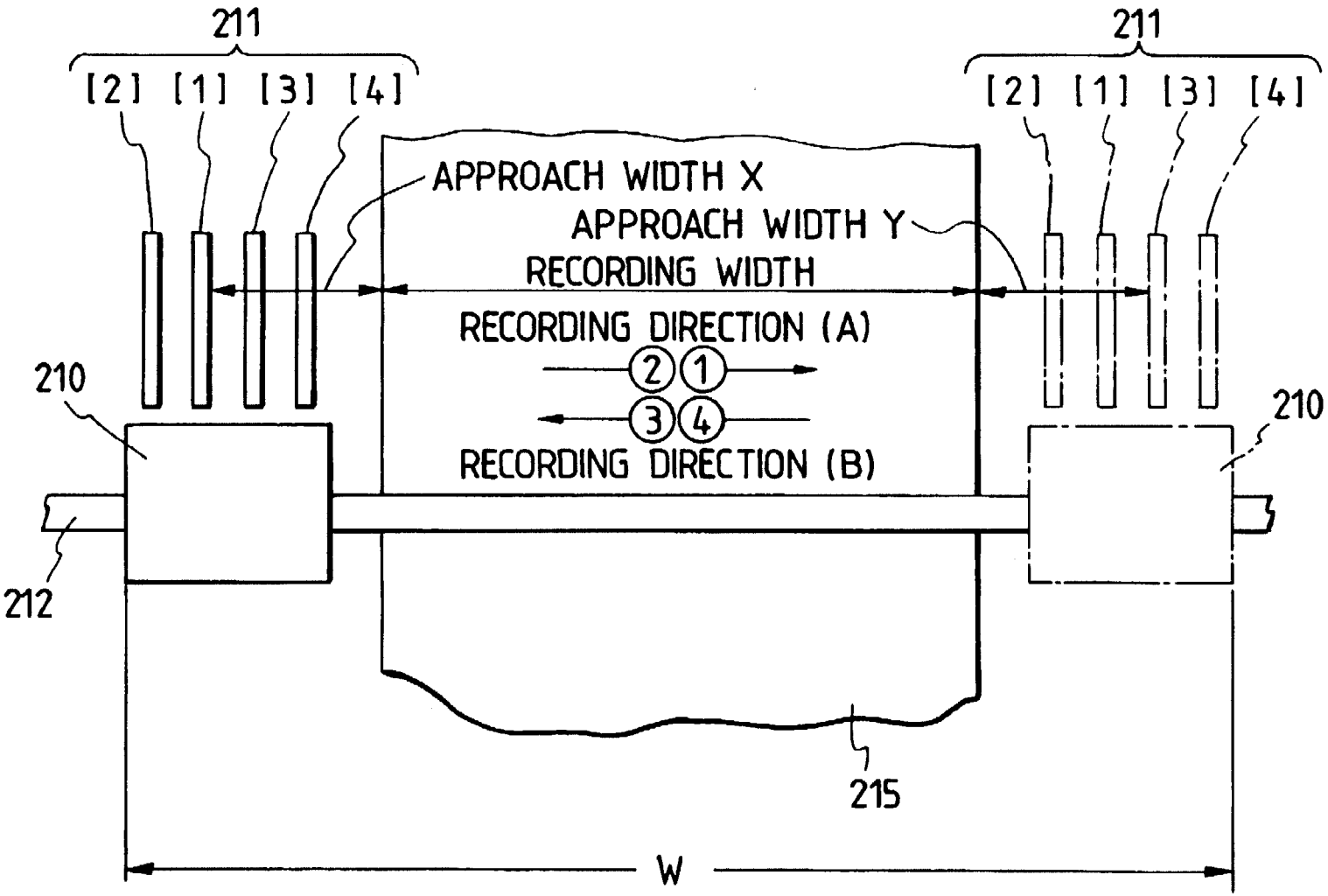
FIG. 35 is a schematic view which illustrates an example of a recording operation performed by the recording apparatus according to the present invention.

FIG. 35 is a schematic view which illustrates the recording operation of another embodiment of the present invention. As shown in FIG. 35, the movable member 210 has four recording heads 211 mounted thereon. The sequential order of the inks is so arranged that the cyan recording head [2], the black recording head [1], the magenta recording head [3]

and the yellow recording head [4] are disposed when viewed from the left of FIG. 35. The movable member 210 is guided and supported along the guide rail 212 as to be capable of reciprocating, the movable member 210 being reciprocated by the main scanning motor 13 (see FIGS. 1A to 1D) comprising a stepping motor while using a transmission mechanism, such as a timing belt 14 or a lead screw (omitted from illustration).

When an image is recorded on the recording member 215, the main scanning motor is rotated forwards to move the movable member (the carriage) 210 from the left end (designated by a solid line) in a direction designated by an arrow A. During this, the two recording heads [1] and [2] disposed downstream in the direction of the forward movement are used to record a black image and a cyan image. Then, the main scanning motor is rotated inversely to move the movable member 210 from the right end (designated by an alternate long and dash line) in the direction of the arrow B along the same line in the direction of the arrow A. During this, the two residual recording heads [3] and [4] disposed downstream in the direction of the rearward movement are used to record the magenta and the yellow images. As a result of the foregoing process, color recording for one line formed by superposing inks in the sequential order as black, cyan, magenta and yellow is completed.

Then, the conveyance motor is rotated to rotate the conveyance roller pair and the holding roller pair by predetermined quantities so that the recording member 215 is moved (sub-scanned) by a predetermined length in a direction perpendicular to the movement direction of the movable member 210. As a result, a process similar to the previous operation is performed so that a color image for one line is recorded. By repeating the similar process, a color image is recorded on a desired range (for example, the overall region) of the recording member 215. As a power source for driving the four recording heads 211, one power source having a capacity corresponding to the two recording heads is used as to be switched between the forward recording movement and the rearward recording movement.

The recording apparatus according to the present invention performs a reciprocating recording operation by using plural recording heads (recording means) 211 having needed spaces 276 and 277 formed asymmetrically with respect to the main scanning portion 275 in such a manner that the plural recording heads 211 are divided into two groups in the direction of the movement. Further, the two recording heads disposed adjacently at the boundary are so disposed that their large portions 276 are disposed adjacently. In addition, the two recording heads at the right and left ends and disposed away from the foregoing boundary portion are so disposed that their larger portion 276 are disposed outwardly. At the time of the forward movement, the downstream group in the forward movement direction is used to record an image. At the time of the rearward movement, the downstream group in the rearward movement direction is used to record an image. The structure is arranged in such a manner that the plural (four in the structure shown in FIG. 35) recording heads 211 are equally divided into two groups. Further, the recording heads (the two downstream heads in the forward movement direction in the structure shown in FIG. 35) for use in the forward movement and the recording heads (the two downstream heads in the rearward movement direction in the structure shown in FIG. 35) for use in the rearward movement are operated by a common power source.

Figure 36:
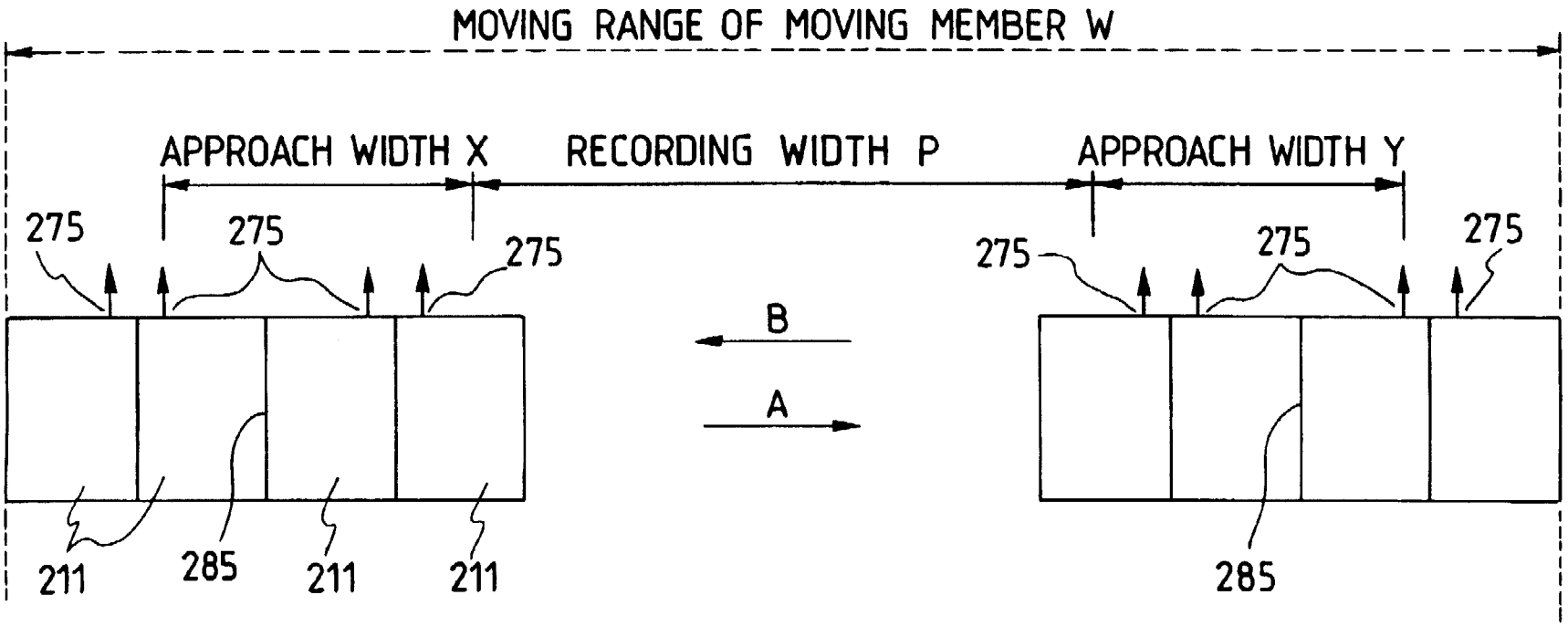
FIG. 36 is a schematic view which illustrates a state where four recording means are fastened and the operation of the recording apparatus according to the present invention.

FIG. 36 is a schematic view which illustrates a state where the plural recording heads shown in FIG. 34 are fastened. As shown in FIG. 36, four recording heads 211 are mounted on the movable member 210, the recording heads 211 being formed asymmetrically to have the right and left spaces 276 and 277 formed into different shapes with respect to the main scanning portion 257 (see FIG. 34). The four recording heads 211 are divided into two groups in the direction of the movement (the boundary 285) so that the forward movement recording is performed by the two recording heads disposed downstream in the direction of the forward movement and the rearward movement recording is performed by the two recording heads disposed downstream in the direction of the rearward movement. The recording heads 211 are disposed on the movable member 210 in such a manner that the two recording heads disposed adjacently at the boundary are so disposed that their large portions 276 are disposed adjacently, and the two recording heads at the right and left ends and disposed away from the foregoing boundary portion are so disposed that their larger portion 276 are disposed outwardly.

The four recording heads 211 are equally divided into two groups in the direction of the movement. At the time of the forward movement in the direction of the arrow A, the recording heads [1] and [2] in the group disposed downstream in the direction of the forward movement are used to record an image. At the time of the rearward movement in the direction of the arrow B, the recording heads [3] and [4] in the group disposed downstream in the direction of the rearward movement are used to record an image. Therefore, the approach widths X and Y (the distance from the recording head for use at the subject movement before the commencement of the movement and the end of the side of the recording member 215 in the movement commencement direction) can be shortened. Further, the movable range W for the movable member 210 can be narrowed. As a result, the size and the weight of the recording apparatus can be reduced. It should be noted that symbol P shown in FIG. 36 denotes the width of the record.

Figure 37:
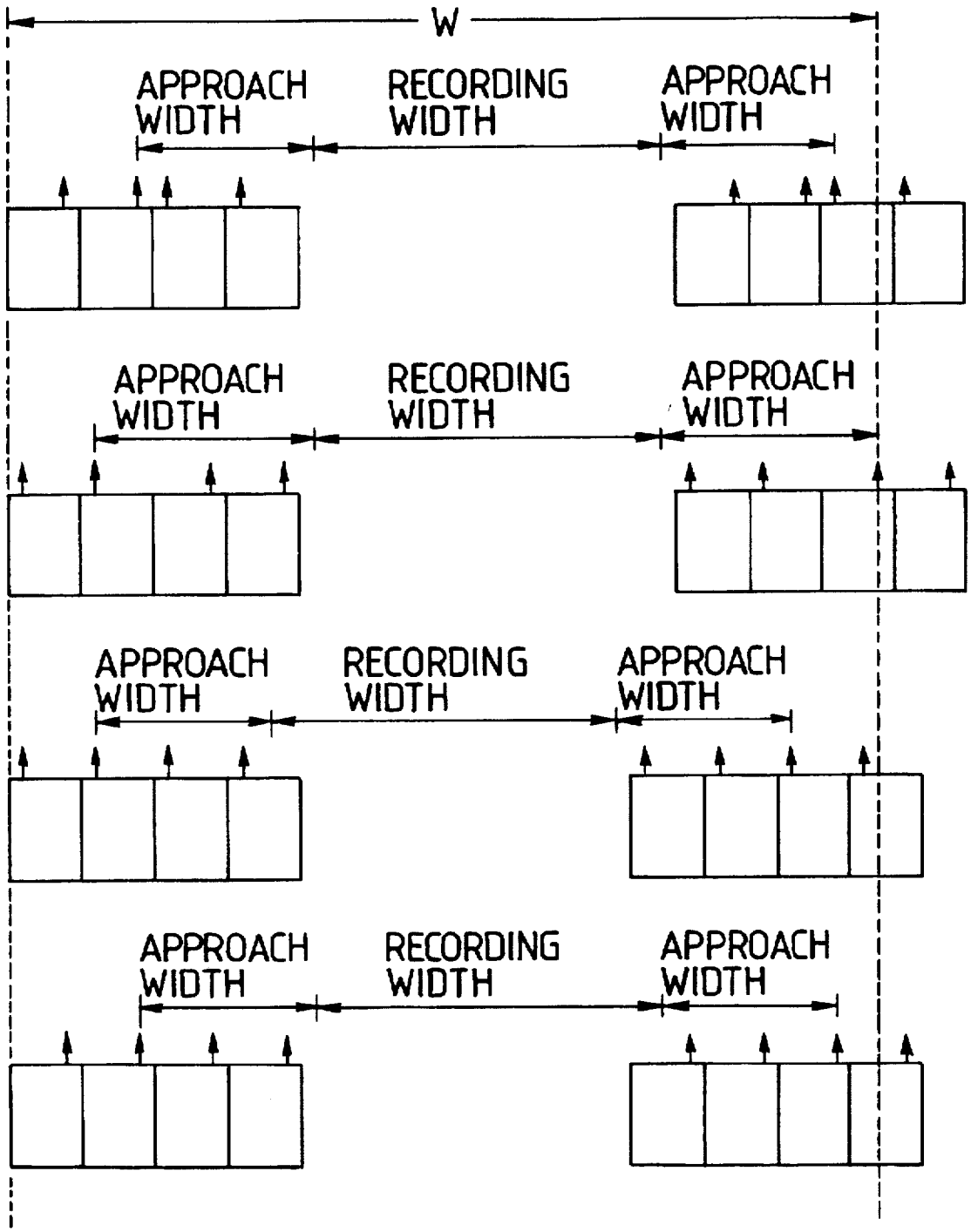
FIG. 37 is a schematic view which illustrates a state where a plurality of recording means are fastened and the operation of a recording apparatus which is not according to the present invention in contrast with the embodiment shown in FIG. 36.

FIG. 37 is a schematic view which illustrates comparative examples of the dispositions of four asymmetrical recording heads 211 (by methods except the method shown in FIG. 36). Referring to FIG. 37, symbol W denotes the movable range for the movable member 210 in the embodiment shown in FIG. 36. As can also be seen from FIG. 37, the present invention is able to effectively reduce the movable range for the movable member 210.

Since the recording apparatus according to the present invention performs recording by operating only two of the four recording heads 211 at the time of each of the forward movement and the rearward movement of the movable member 210, the capacity of the power source for operating the recording heads can be decreased to that for the two recording heads. Further, the arrangement made such that the power source is switched in accordance with the subject movement direction of the movable member 210 enables the power source for operating the recording heads to be decreased to one. Therefore, the power source having a small capacity is sufficient to be adapted to this embodiment, causing the size and the cost of the power source for operating the recording heads to be reduced. Further, the power source can be used efficiently. In addition, the fact that the recording order of colors can always be made the same at the time of the color recording operation, an excellent-quality image can stably be recorded.

Although the black, cyan, magenta and yellow recording is performed in this sequential order in the embodiment shown in FIGS. 35 and 36, the recording order may be freely changed such that the other ink color is combined or an ink having a different density is combined. The present invention is not limited to the ink jet recording apparatus, and the same may be adapted to another type recording apparatus.

Figure 38:
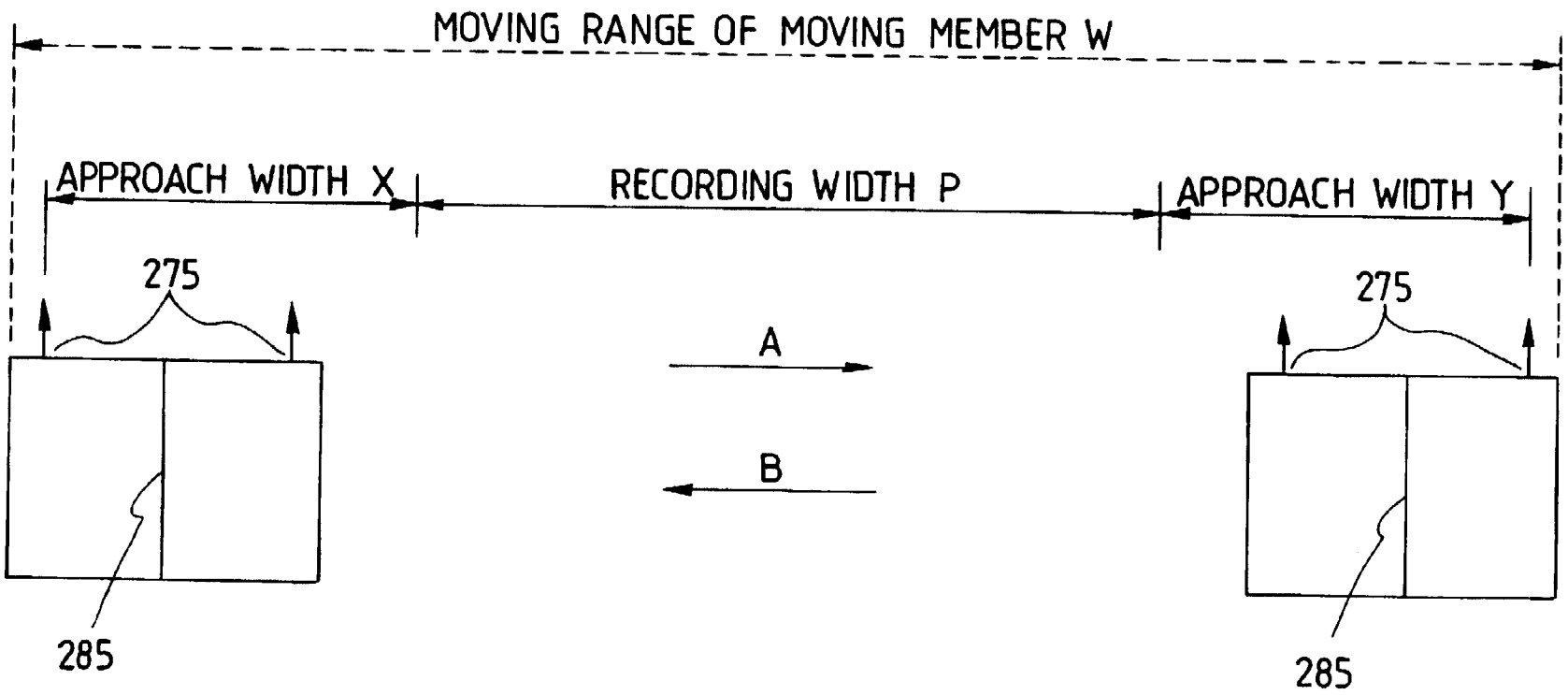
FIG. 38 is a schematic view which illustrates a state where two recording means are fastened and the operation of the recording apparatus according to the present invention.

FIG. 38 is a schematic view which illustrates a state where a plurality of recording heads are fastened. FIG. 38 illustrates a structure in which two recording heads 211 are employed. Referring to FIG. 38, two recording heads 211 are mounted on the movable member 210, the recording heads 211 having right and left space 276 and 276 formed into different shapes with respect to the main scanning portion 275. The two recording head 211 is divided into two sections (the boundary 285) so that the recording head disposed downstream in the direction of the forward movement is used to record an image at the time of the forward movement. The recording head disposed downstream in the direction of the rearward movement is used to record an image at the time of the rearward movement. The two recording heads 211 are disposed on the movable member 210 in such a manner that their large portions 276 of the recording heads 211 are disposed adjacently.

When an image is recorded on the recording member 215, the recording head (at the left of the drawing) disposed downstream in the direction of the forward movement is, similarly to the above-made description, used to record an image at the time of the forward movement of the movable member 210. On the other hand, the recording head (at the right of the drawing) disposed downstream in the direction of the rearward movement is used to record an image at the time of the rearward movement of the movable member 210. Further, one power source for the recording heads having a capacity of one recording head is used to be switched to cause the forward movement and the rearward movement to be performed.

Since the embodiment shown in FIG. 38 is arranged in such a manner that the two recording heads 211 are divided into two heads disposed in the movement direction and the recording head disposed downstream in the direction of each of the forward movement and the rearward movement is used, the approach widths X and Y for the movable member 210 can be shortened. Further, the movable range W for the movable member 210 can be narrowed. As a result, the size and the weight of the recording apparatus can be reduced.

Figure 39:
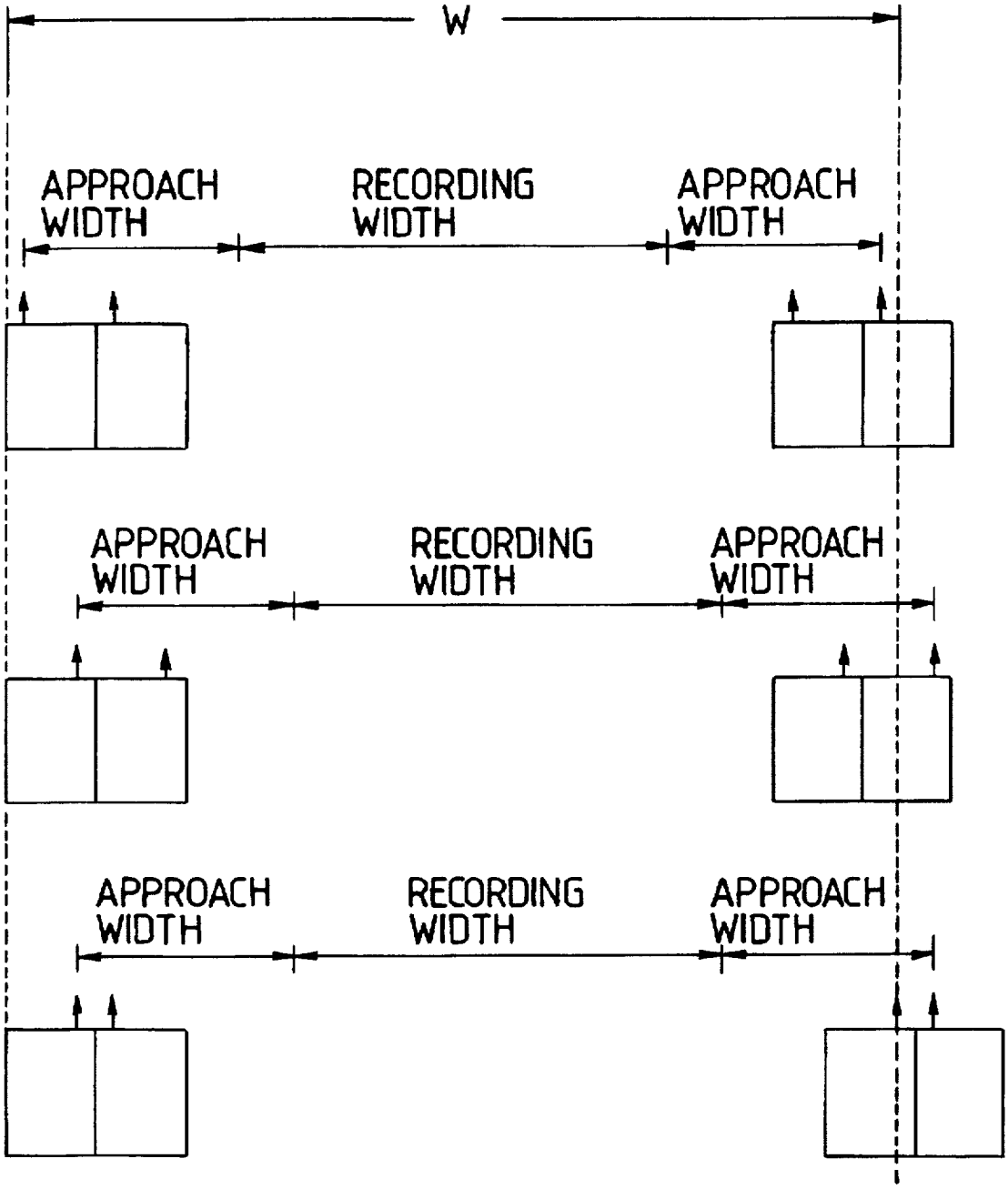
FIG. 39 is a schematic view which illustrates a state where two recording means are fastened and the operation of a recording apparatus which is not according to the present invention in contrast with the embodiment shown in FIG. 38.

FIG. 39 is a schematic view which illustrates comparative examples of the dispositions of four asymmetrical recording heads 211 (by methods except the method shown in FIG. 38). Referring to FIG. 39, symbol W denotes the movable range for the movable member 210 in the embodiment shown in FIG. 38. As can also be seen from FIG. 39, the present invention is able to effectively reduce the movable range for the movable member 210. Since the recording apparatus according to the present invention performs recording by operating only one recording head 211 at the time of each of the forward movement and the rearward movement of the movable member 210, the capacity of the power source for operating the recording heads can be decreased to that for the one recording head. Further, the arrangement made such that the power source is switched in accordance with the subject movement direction of the movable member 210 enables the power source for operating the recording heads to be decreased to one. As a result, the size and the cost of the power source for operating the recording heads can be reduced.

Figure 40:
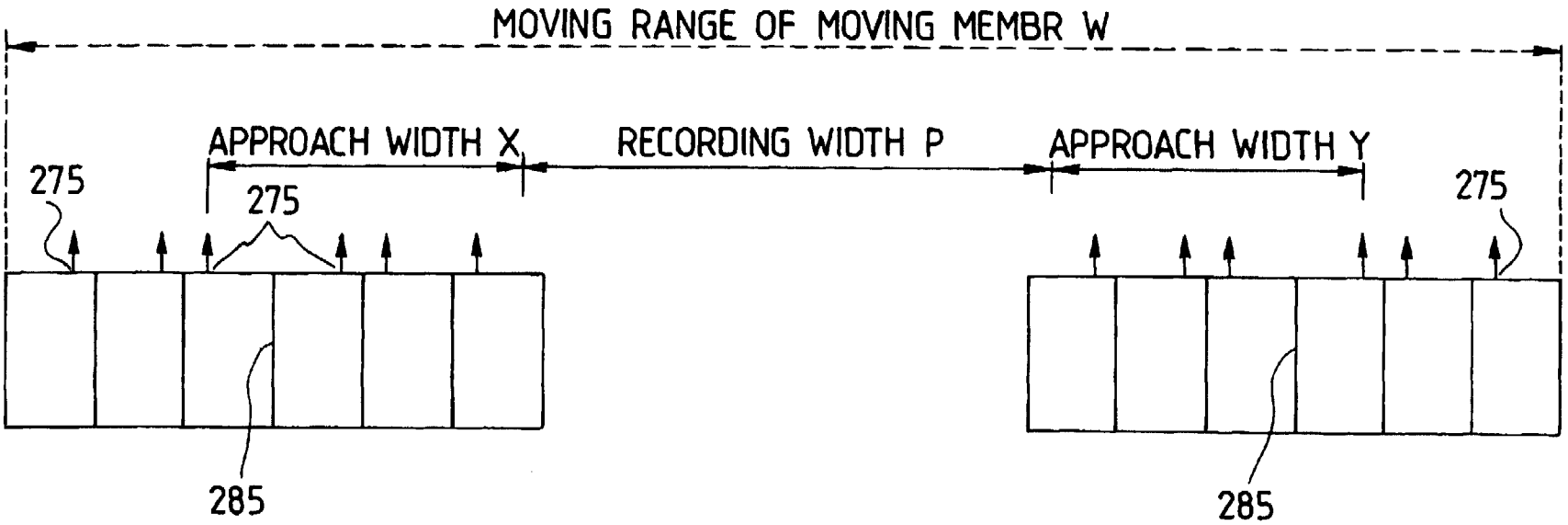
FIG. 40 is a schematic view which illustrates a state where a plurality of recording means are fastened and the operation of a recording apparatus according to the present invention.
Figure 41:
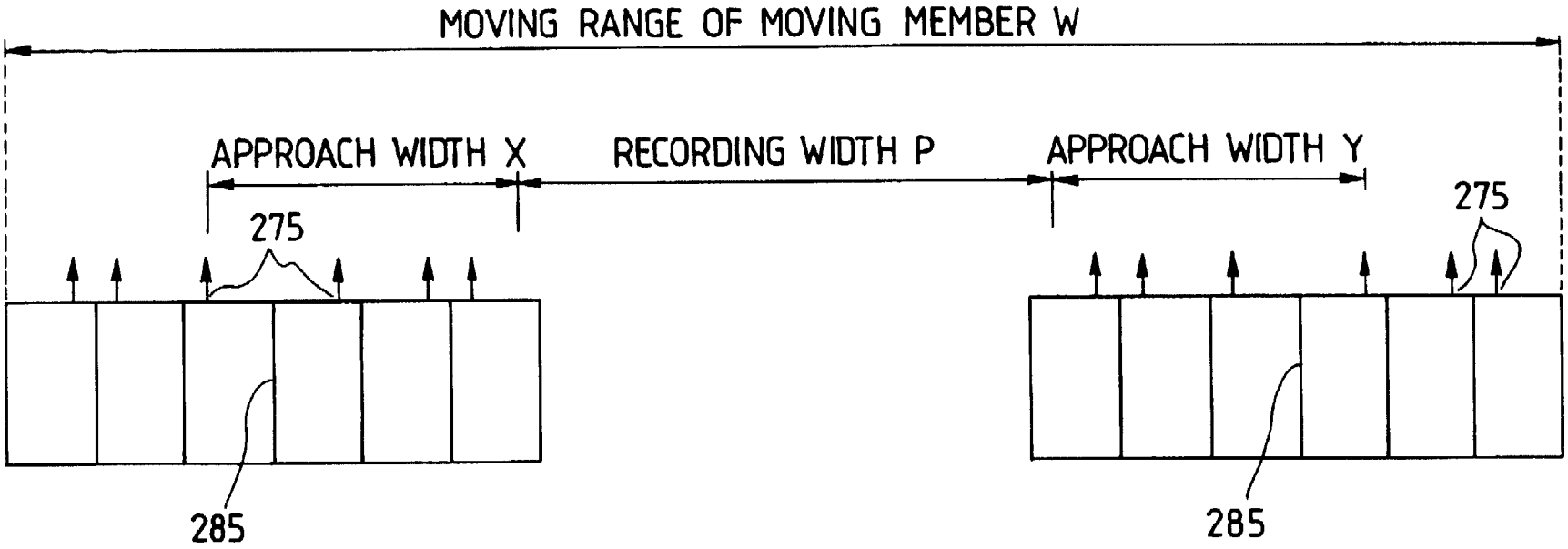
FIG. 41 is a schematic view which illustrates another state where a plurality of recording means are fastened and the operation of a recording apparatus according to the present invention.

FIGS. 40 and 41 are schematic views which illustrates states where plural recording heads are fastened. FIGS. 40 and 41 illustrate six recording heads 211 are mounted on the movable member 210. The recording heads 211 are disposed in such a manner that a light cyan recording head, a dark cyan recording head, a black recording head, a dark magenta recording head, a light magenta recording head and a yellow recording head are disposed in this sequential order when view from the left portion of the drawing. The movable member 210 is guided and supported along the guide rail 212 as to be capable of reciprocating, the movable member 210 being reciprocated by the main scanning motor 13 comprising a stepping motor while using a transmission mechanism, such as a timing belt or a lead screw (omitted from illustration).

Each recording head 211 has needed spaces 276 and 277 formed asymmetrically with respect to the main scanning portion 275 in such a manner that the plural (four or more, in the illustrated structure, it is six) recording heads 211 are divided into two groups composed of three recording heads in the direction of the movement. Further, the two recording heads disposed adjacently at the boundary 285 are so disposed that their large portions 276 are disposed adjacently. In addition, the two recording heads at the right and left ends and disposed away from the foregoing boundary portion are so disposed that their larger portion 276 are disposed outwardly.

When an image is recorded on the recording member 215, the main scanning motor is rotated forwards to move the movable member (the carriage) 210 from the left end in a direction designated by an arrow A. During this, the three recording heads disposed downstream in the direction of the forward movement are used to record a black image, a dark cyan image and a light cyan image for one line. Then, the main scanning motor is rotated inversely to move the movable member 210 from the right end in the direction of the arrow B along the same line in the direction of the arrow A. During this, the three residual recording heads disposed downstream in the direction of the rearward movement are used to record a dark magenta image, a light magenta image and a yellow image to record an image on the same line. As a result of the foregoing process, color recording for one line formed by superposing inks in the sequential order as dark cyan, light cyan, dark magenta, light magenta and yellow inks corresponding to the color image signals is completed.

Then, the conveyance motor is rotated to rotate the conveyance roller pair and the holding roller pair by predetermined quantities so that the recording member 215 is moved (sub-scanned) by a predetermined length. As a result, a process similar to the previous operation is performed so that a color image for one line is recorded. By repeating the similar process, a color image is recorded on a desired range (for example, the overall region) of the recording member 215. As a power source for driving the four recording heads 211, one power source having a capacity corresponding to the three recording heads is used as to be switched between the forward recording movement and the rearward recording movement to operate the needed recording heads 211.

The structure shown in FIGS. 40 and 41 is arranged in such a manner that four or more (six in the illustrated case) are used each of which has the needed spaces 276 and 277 formed asymmetrically with respect to the main scanning portion 275 in such a manner that the same number (three) recording heads 211 are divided into two groups. Further, the two recording heads disposed adjacently at the boundary 285 are so disposed that their large portions 276 are disposed adjacently. In addition, the two recording heads at the right and left ends and disposed away from the foregoing boundary portion are so disposed that their larger portion 276 are disposed outwardly. The recording operation is performed so that a group of recording heads disposed downstream in the direction of the forward movement is used at the time of the forward movement in the direction of the arrow A and a group of recording heads disposed downstream in the direction of the rearward movement is used at the time of the rearward movement in the direction of the arrow B.

According to the embodiment shown in FIGS. 40 and 41, the approach widths X and Y (the distance from the recording head for use at the subject movement before the commencement of the movement and the end of the side of the recording member 215 in the movement commencement direction) for the movable member 210 can be shortened. Further, the movable range W for the movable member 210 can be narrowed. As a result, the size and the weight of the recording apparatus can be reduced. In addition, the fact that the recording order of colors can always be made the same at the time of the color recording operation, an excellent-quality image can stably be recorded. Referring to FIGS. 40 and 41, symbol P denotes the recording width.

Figure 42:
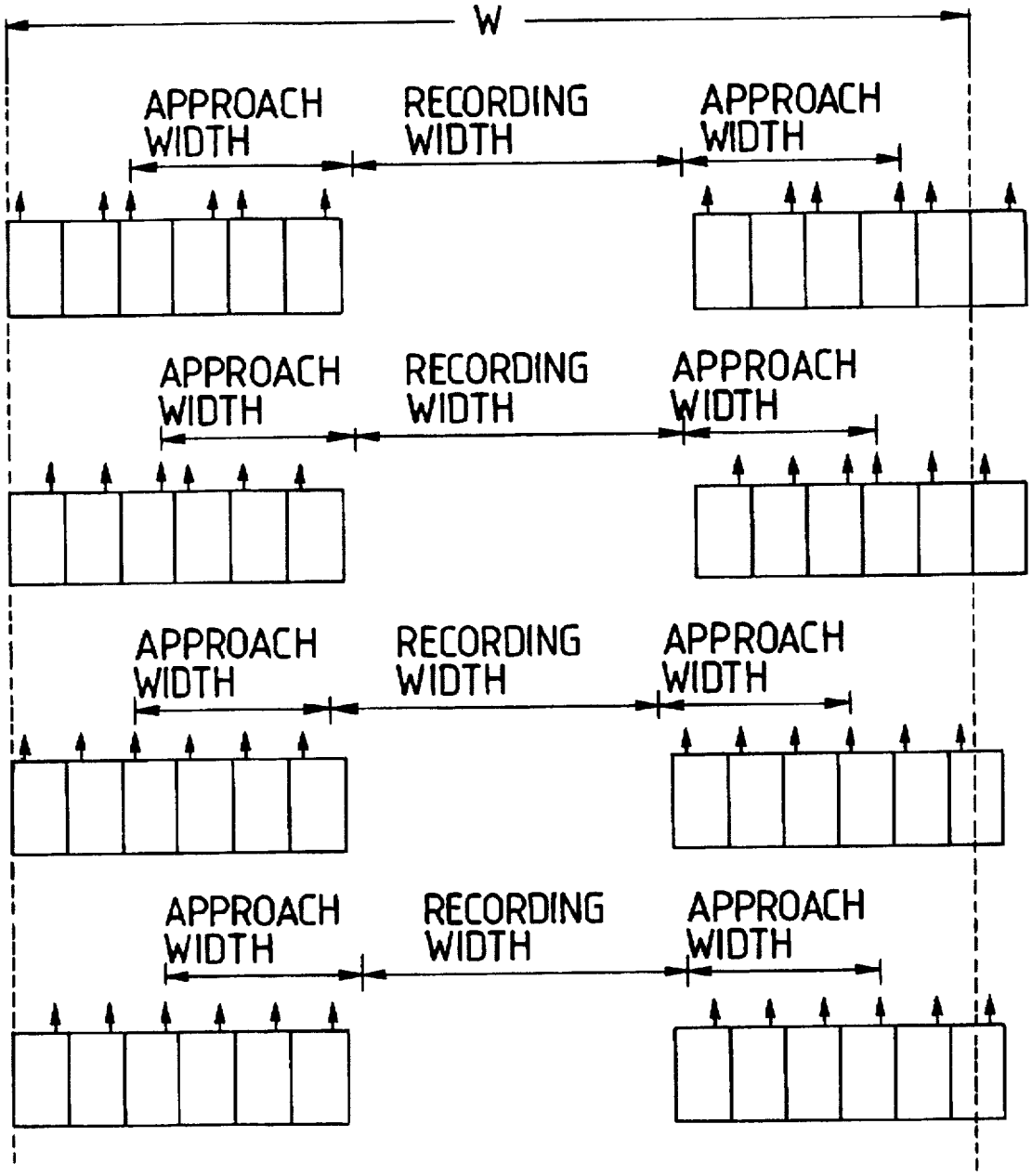
FIG. 42 is a schematic view which illustrates a state where a plurality of recording means are fastened and the operation of a recording apparatus which is not according to the present invention in contrast with the embodiment shown in FIGS. 40 and 41.

FIG. 42 is a schematic view which illustrates comparative examples of configurations in which six (four or more) asymmetrical recording heads 211 are mounted by methods except the method according to the present invention (except the methods shown in FIGS. 40 and 41). Symbol W shown in FIG. 42 denotes the movable range for the movable member 210 of the embodiments shown in FIGS. 40 and 41. As can also be seen from FIG. 42, the present invention is able to effectively reduce the movable range for the movable member 210.

Since also this embodiment is so arranged that the half (three) of the six heads 211 are used to record an image by the forward or the rearward movements, the power source for driving the recording heads 211 is so arranged that one source having the capacity for the three recording heads is used and the source is switched between the forward movement and the rearward movement. As a result, the size and the cost of the power source for operating the recording heads 211 can be reduced. In addition, the power source can be used efficiently.

Although the black, dark cyan, light cyan, dark magenta, light magenta and yellow recording is performed in this sequential order in the embodiment shown in FIGS. 40 and 41, the recording order may be freely changed such that the other ink color is combined or an ink having a different density is combined. The present invention is not limited to the ink jet recording apparatus, and the same may be adapted to another type recording apparatus.

Further, three recording heads 211 having needed spaces formed asymmetrically with respect to the main scanning portion 275 are used in such a manner that the six recording heads 211 are divided into two groups composed of three recording heads in the direction of the movement. Further, the two recording heads disposed adjacently at the boundary 285 are so disposed that their large portions 276 are disposed adjacently. In addition, the two recording heads at the right and left ends and disposed away from the foregoing boundary portion are so disposed that their larger portion 276 are disposed outwardly. At the time of the forward movement, the recording heads disposed lower stream in the direction of the forward direction than the boundary 285 are used to record an image. At the time of the rearward movement, the recording heads disposed lower stream in the direction of the rearward direction than the boundary 285 are used to record an image. The present invention, in its scope, includes the foregoing structure which enables a similar effect to be obtained to that obtainable from the foregoing embodiments.

Although each of the foregoing embodiments is arranged in such a manner that the recording head groups are composed of the plural independent recording heads 11, the present invention only needs the recording groups. For example, an integrated recording head group may be employed which comprises all recording head portions or the plural recording head portions formed on one orifice plate.

Figure 43:
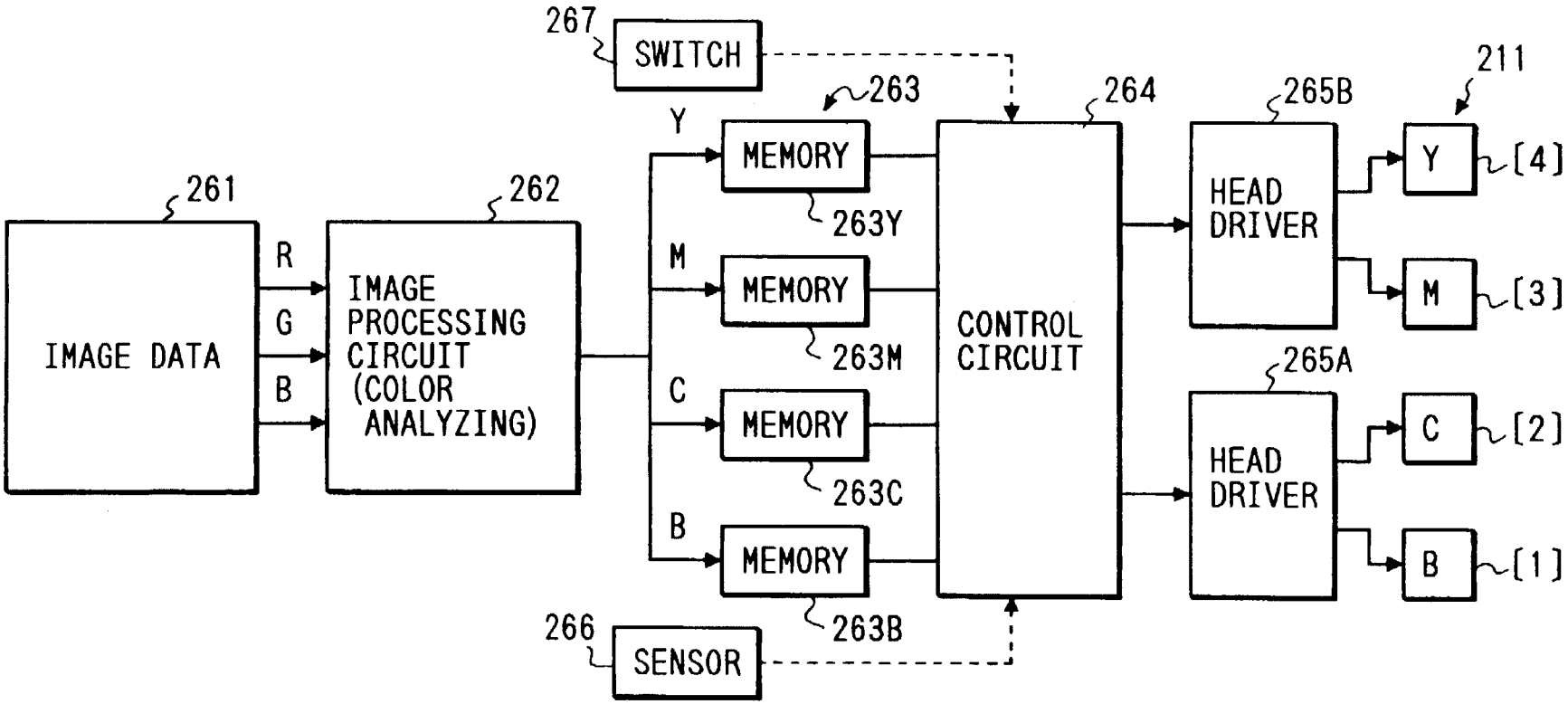
FIG. 43 is a block diagram which illustrates the schematic structure of a control system according to an embodiment of a recording apparatus of the present invention.

FIG. 43 is a block diagram which schematically illustrates an example of the structure of a control system for the recording apparatus according to the present invention. Referring to FIG. 43, image data 261 composed of R, G and B is decomposed into Y (yellow), M (magenta), C (cyan) and B (black) data by an image processing circuit 262. Decomposed color information is temporarily received by corresponding memories 263Y, 263M, 263C and 263B. A control circuit 264 controls two head drivers 265A and 265B in accordance with color information received by the memories 263Y, 263M, 263C and 263B. In the illustrated structure, the head driver 265A causes the forward movement recording operation to be performed by using the black and cyan recording heads [1] and [2]. On the other hand, the head driver 265B causes the rearward movement recording operation to be performed by using the magenta and yellow recording heads [3] and [4].

In accordance with information about the reciprocation supplied from a forward/rearward movement detection sensor 266 for detecting the rotational direction and the like of a motor for driving the movable member (carriage) (omitted from illustration), the control circuit 264 controls to switch a forward movement operation by using the head driver 265A and a rearward movement operation by using the head driver 265B. The control circuit 264 uses a mode switch to discriminate whether the mode is an image recording (multi-color recording) mode or a character recording (mono-color recording) mode. In accordance with this, the control circuit 264 controls the operation of the needed recording heads. Thus, predetermined recording head are used at the time of the forward movement and the rearward movement of each recording head 211 so that an image is recorded on the recording member 215 while employing the dot pattern determined in accordance with information about corresponding colors.

The present invention is adaptable to a variety of recording apparatuses of a type using a plurality of, that is, two or more, recording means, such as a recording apparatus for recording a color image using different colors, a recording apparatus for recording a gradient image of the same color but having different density, or a recording apparatus of a type combining the foregoing apparatuses to obtain a similar effect. Further, the recording means may be, as well as the cartridge type means formed by integrating the recording head portion and the ink tank, a structure comprising an individual recording head portion, an ink tank and an ink supply tube establishing the connection between the foregoing elements. As described above, the present invention may be similarly adapted regardless of the structure of the recording means and the ink tank to obtain a similar effect.

The structure is arranged in such a manner that the plural recording means are divided into two groups in the direction of the movement, the recording means disposed downstream in the direction of the forward movement are used at the time of the forward movement and the recording means disposed downstream in the direction of the rearward movement are used at the time of the rearward movement. Therefore, the movable range for the movable member in the case where the plural recording heads (recording means) are used can be reduced and, accordingly, the size of the apparatus can be reduced. Further, a recording apparatus in which the capacity of the power source for operating the recording heads can be reduced so that the size and the cost of the power source can be reduced.

A recording apparatus for performing a reciprocating recording operation comprising: four or more recording means each having needed spaces which are asymmetrical with respect to a main scanning recording portion, wherein the plurality of recording means are divided into two groups, two recording means adjacent at the boundary are disposed in such a manner that their large portions are disposed adjacently, the right and left end recording means positioned away from the boundary are disposed in such a manner that their large portions are disposed outside, a group disposed downstream in the direction of forward movement is used to perform recording at the time of the forward movement and a group disposed downstream in the direction of rearward movement is used to perform recording at the time of the rearward movement. Therefore, when a recording operation is performed by using a plurality of recording means having the right and left needed portions which are different with respect to the main recording scanning portion, the approaching width for the movable member can be reduced, the movable range for the movable member can be decreased, the size and the weight of the apparatus can be reduced, the capacity of the power source for operating the recording means can be reduced, and the size and the cost of the power source can be reduced.

When three recording means having the right and left needed spaces, which are different with respect to the main recording scanning portion, are used to perform recording, the approaching width for the movable member can be reduced, and the movable range for the movable member can be decreased. Therefore, the size and the weight of the apparatus can be reduced, the capacity of a power source for operating the recording means can be reduced, and the size and the cost of the power source can be reduced.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An ink jet recording apparatus for use with ink jet recording heads each provided with a discharge port for discharging ink, the apparatus comprising:

a single suction mechanism for selectively sucking said ink jet recording heads, said mechanism including a suction cap for covering any one of said ink jet recording heads and a pump communicated with said cap, said pump generating a pressure change for sucking ink from said discharge port when said cap covers said discharge port;

a plurality of protection caps provided corresponding to said ink jet recording heads, said protection caps covering said discharge port of respective ones of said ink jet recording heads;

a carriage capable of reciprocating along a recording member and having said recording heads mounted thereon to perform recording by discharging ink from said recording heads to said recording member; and cleaning means for cleaning said recording heads, said cleaning means being disposed in a range of a recording region determined in a movable range of said carriage, wherein said cleaning means is a discharge receiving portion for receiving waste ink discharged for the purpose of preventing drying of the discharge port of each of said recording heads.

2. An ink jet recording apparatus according to claim 1, wherein said previous discharge receiving portion is provided for a platen.

3. An ink jet recording apparatus according to claim 1, wherein said previous discharge receiving portion is provided for a paper-conveying roller.

4. An ink jet recording apparatus according to claim 1, wherein said recording region is a maximum range in which said carriage traces when said carriage moves to perform recording.

5. An ink jet recording apparatus for use with ink jet recording heads each provided with a discharge port for discharging ink, the apparatus comprising:

a single suction mechanism for selectively sucking said ink jet recording heads, said mechanism including a suction cap for covering any one of said ink jet recording heads and a pump communicated with said cap, said pump generating a pressure change for sucking ink from said discharge port when said cap covers said discharge port;

a plurality of protection caps provided corresponding to said ink jet recording heads, said protection caps covering said discharge port of respective ones of said ink jet recording heads;

a carriage capable of reciprocating along a recording member and having said recording heads mounted thereon to perform recording by discharging ink from said recording heads to said recording member; and cleaning means for cleaning said recording heads, said cleaning means being disposed in a range of a recording region determined in a movable range of said carriage, wherein said cleaning means comprises a plurality of discharge receiving portions disposed at a plurality of positions for receiving waste ink discharged for the purpose of preventing drying of the discharge port of each of said recording heads.

6. An ink jet recording apparatus for use with ink jet recording heads each provided with a discharge port for discharging ink, the apparatus comprising:

a single suction mechanism for selectively sucking said ink jet recording heads, said mechanism including a suction cap for covering any one of said ink jet recording heads and a pump communicated with said cap, said pump generating a pressure change for sucking ink from said discharge port when said cap covers said discharge port;

a plurality of protection caps provided corresponding to said ink jet recording heads, said protection caps covering said discharge port of respective ones of said ink jet recording heads;

a carriage capable of reciprocating along a recording member and having said recording heads mounted thereon to perform recording by discharging ink from said recording heads to said recording member; and cleaning means for cleaning said recording heads, said cleaning means being disposed in a range of a recording region determined in a movable range of said carriage, wherein each of said recording heads is an ink jet recording means comprising an electricity-to-heat converter for generating heat energy to discharge the ink.

7. An ink jet recording apparatus according to claims 1, 5 or 6, further comprising determining means for determining a necessity for suction of a given recording head, wherein the necessity for the suction is determined at a predetermined timing and a determination result of the determining means is used to selectively suck certain of said recording heads.

8. An ink jet recording apparatus according to claims 1, 5 or 6, wherein suction conditions including an initial suction pressure, a quantity of suction, and sucking intervals are determined for each of said recording heads.

9. An ink jet recording apparatus according to claims 1, 5 or 6, wherein said suction mechanism does not perform suction of a recording head which is not used in a recording operation.

10. An ink jet recording apparatus according to claims 1, 5 or 6, wherein when the discharge port of a given recording head is capped with said suction cap, ink is forcibly discharged from said discharge port, and wherein said suction cap has an ink absorber disposed therein with a capacity larger than a quantity of ink sucked from the discharge port by one operation of said suction mechanism.

11. An ink jet recording apparatus according to claim 10, wherein said suction operation is completed by uncapping said suction cap at a predetermined timing.

12. An ink jet recording apparatus according to claims 1, 5 or 6, wherein when the discharge port of a given recording head is capped with said suction cap, ink is forcibly discharged from said discharge port, and wherein said suction cap has an ink absorber disposed therein with a capacity larger than an internal capacity of an ink passage of said recording head.

13. An ink jet recording apparatus according to claim 12, wherein said forcible discharge of the ink performed by said recovery head is performed by a suction operation.

14. An ink jet recording apparatus according to claim 13, wherein said suction operation is completed by uncapping said suction cap at a predetermined timing.

15. An ink jet recording apparatus according to claim 12, wherein a quantity of the ink discharged is larger than the internal capacity of said ink passage of said recording head.

16. An ink jet recording apparatus according to claim 12, wherein the quantity of the ink discharged is smaller than the capacity of said ink absorber.

17. An ink jet recording apparatus according to claims 1, 5 or 6, wherein said cleaning means further comprises a wiper mechanism which brings an elastic member into contact with a surface of a discharge port of a given recording head to wipe out and clean the surface of said discharge port.

18. An ink jet recording apparatus according to claim 6, wherein each of said ink jet recording heads causes the ink to be discharged from the discharge port by making use of film boiling occurring in the ink by the heat energy generated by said electricity-to-heat converter.

19. An ink jet recording apparatus according to claims 1, 5 or 6, wherein said suction mechanism is disposed in a range of a recording region determined in a movable range of said carriage, said suction cap can be in close contact with a surface of the discharge port of each of said recording heads and said pump generates negative pressure in said suction cap.

20. An ink jet recording apparatus according to claim 19, wherein each of said plurality of protection caps is so disposed as to be in close contact with a surface of the discharge port of the corresponding recording head, said protection caps being in number equal to or lesser, by one, than said recording heads.

21. An ink jet recording apparatus according to claim 19, wherein said suction mechanism is capable of sucking elements other than said recording heads.

22. An ink jet recording apparatus according to claim 19, wherein said suction mechanism further comprises gap forming means for generating a gap between said suction cap and said surface of said discharge port before a suction operation is completed.

23. An ink jet recording apparatus according to claim 22, wherein said gap forming means is a carriage moving means for moving said carriage.

24. An ink jet recording apparatus according to claim 22, wherein said gap forming means is a cap displacement means for moving or deforming said cap.

25. A recording apparatus according to claims 1, 5 or 6, further comprising a plurality of recording heads divided into two groups in a direction of movement, a first group being disposed downstream in a direction of forward movement and used during forward movement and a second group being disposed downstream in a direction of rearward movement and used during rearward movement.

26. A recording apparatus according to claim 25, wherein said plurality of recording heads is equally divided into said two groups.

27. A recording apparatus according to claim 25, wherein said first group and said second group are operated by a common power source.

28. A recording apparatus according to claim 25, wherein said forward movement and said rearward movement have a same approach width.

29. A recording apparatus according to claims 1, 5 or 6, further comprising a plurality of recording heads, wherein said apparatus performs a reciprocating recording operation, and wherein said plurality of recording heads comprises four or more recording heads each having needed spaces which are arranged asymmetrically with respect to a main scanning recording portion, said recording heads is are divided into two groups with a boundary therebetween, two recording heads adjacent to the boundary being disposed so that large portions of said two recording heads are disposed adjacently and a right end recording head and a left end recording head positioned furthest away from said boundary being disposed so that large portions of said right end recording head and said left end recording head are disposed outside, and a first group disposed downstream in a direction of forward movement is used to perform recording during forward movement and a second group disposed downstream in a direction of rearward movement is used to perform recording during rearward movement.

30. A recording apparatus according to claim 29, wherein said recording heads used during said forward movement and said recording heads used during said rearward movement are operated by a common power source.

31. A recording apparatus according to claim 29, wherein each of said plurality of recording heads comprises an electricity-to-heat converter for generating heat energy to discharge the ink.

32. A recording apparatus according to claim 31, wherein each of said plurality of ink jet recording heads causes the ink to be discharged from the discharge port by making use of film boiling occurring in the ink by the heat energy generated by said electricity-to-heat converter.

33. A recording apparatus according to claims 1, 5 or 6, further comprising a plurality of recording heads wherein said apparatus performs a reciprocating recording operation, and wherein said plurality of recording heads comprises three recording heads each having needed spaces which are arranged asymmetrically with respect to a main scanning recording portion, said three recording heads are divided into two groups with a boundary therebetween, two recording heads adjacent to the boundary being disposed so that large portions of said two recording heads are disposed adjacently and one recording means positioned away from said boundary being disposed so that a large portion thereof is disposed outside, and a first group disposed downstream in a direction of forward movement is used to perform recording during forward movement and a second group disposed downstream in a direction of rearward movement is used to perform recording during rearward movement.

34. A recording apparatus according to claims 1, 5 or 6, further comprising a plurality of recording heads, wherein said apparatus performs a reciprocating recording operation, and wherein said plurality of recording heads comprises two recording heads each having needed spaces which are arranged asymmetrically with respect to a main scanning recording portion, said two recording heads are divided into two groups each of which is composed of one recording head, said two recording means being disposed so that large portions thereof are disposed adjacently, and said recording head disposed downstream in the direction of forward movement is used to perform recording at the time of the forward movement and said recording means disposed downstream in the direction of rearward movement is used to perform recording at the time of the rearward movement.

35. An ink jet recording apparatus for use with ink jet recording heads each provided with a discharge port for discharging ink, the apparatus comprising:

a common suction mechanism for selectively sucking said ink jet recording heads, said mechanism including a suction cap for covering any one of said ink jet recording heads and a pump communicated with said cap, said pump generating a pressure change for sucking ink from said discharge port when said cap covers said discharge port;

a plurality of protection caps corresponding to said ink jet recording heads, said protection caps covering said discharge port of respective ones of said ink jet recording heads;

a carriage capable of reciprocating along a recording member and having said recording heads mounted thereon to perform recording by discharging ink from said recording heads to said recording member; and cleaning means for cleaning said recording heads, said cleaning means being disposed in a range of a recording region determined in a moveable range of said carriage, wherein said cleaning means is a discharge receiving portion for receiving waste ink discharged for the purpose of preventing drying of the discharge port of each of said recording heads.

36. An ink jet recording apparatus according to claim 35, wherein said recording region is a maximum range in which said carriage traces when said carriage moves to perform recording.

* * * * *

UNITED STATES PATENT AND TRADEMARK OFFICE

CERTIFICATE OF CORRECTION

PATENT NO. : 5,896,143

DATED : April 20, 1999

INVENTORS : SHINYA MATSUI et al.

It is certified that error appears in the above-identified patent and that said Letters Patent is hereby corrected as shown below:

COLUMN 1

Line 12, "A recording" should read --Recording--.

COLUMN 2

Line 55, after "be" insert --in--.

COLUMN 3

Line 43, "other" should read --another--.

COLUMN 4

Line 47, "element" should read --elements--.

UNITED STATES PATENT AND TRADEMARK OFFICE

CERTIFICATE OF CORRECTION

PATENT NO. : 5,896,143

DATED : April 20, 1999

INVENTORS : SHINYA MATSUI et al.

It is certified that error appears in the above-identified patent and that said Letters Patent is hereby corrected as shown below:

COLUMN 7

Line 48, delete "be".

COLUMN 10

Line 9, "illustrates" should read --illustrate--.

Line 35, "illustrates" should read --illustrate--.

COLUMN 11

Line 4, "enabled" should read --enables--.

Line 29, "correspond" should read --corresponds--.

COLUMN 12

Line 63, delete "the" (first occurrence).

COLUMN 13

Line 17, after "optimally" insert --be--.

UNITED STATES PATENT AND TRADEMARK OFFICE

CERTIFICATE OF CORRECTION

PATENT NO. : 5,896,143

DATED : April 20, 1999

INVENTORS : SHINYA MATSUI et al.

It is certified that error appears in the above-identified patent and that said Letters Patent is hereby corrected as shown below:

COLUMN 15

Line 12, "illustrates" should read --illustrate--.

Line 22, "position" should read --positioned--.

Line 25, "represent" should read --represents--.

COLUMN 16

Line 21, "discharge" should read --discharged--.

COLUMN 19

Line 7, "embodiments" shold read --embodiment--.

COLUMN 23

Line 49, "suck" should read --sucks--.

UNITED STATES PATENT AND TRADEMARK OFFICE

CERTIFICATE OF CORRECTION

PATENT NO. : 5,896,143

DATED : April 20, 1999

INVENTORS : SHINYA MATSUI et al.

It is certified that error appears in the above-identified patent and that said Letters Patent is hereby corrected as shown below:

COLUMN 28

Line 28, "directions ." should read --directions.--.

COLUMN 29

Line 26, after "type" insert --of--.

Line 35, "view" should read --viewed--.

COLUMN 30

Line 39, after "type" insert --of--.

COLUMN 33

Line 3, after "type" insert --of--.

Line 9, "space" should read --spaces--.

Line 11, "is" should read --are--.

Line 64, "illustrates" should read --illustrate--.

UNITED STATES PATENT AND TRADEMARK OFFICE

CERTIFICATE OF CORRECTION

PATENT NO. : 5,896,143

DATED : April 20, 1999

INVENTORS : SHINYA MATSUI et al.

It is certified that error appears in the above-identified patent and that said Letters Patent is hereby corrected as shown below:

COLUMN 33 - Continued

Line 66, delete "are".

COLUMN 34

Line 5, "view" should read --viewed--.

Line 21, "portion" (second occurrence) should read --portions--.

Line 59, after "(three)" insert --of--.

COLUMN 35

Line 45, after "type" insert --of--.

Line 56, "portion" (second occurrence) should read --portions--.

COLUMN 36

Line 35, "head" should read --heads--.

UNITED STATES PATENT AND TRADEMARK OFFICE

CERTIFICATE OF CORRECTION

PATENT NO. : 5,896,143

DATED : April 20, 1999

INVENTORS : SHINYA MATSUI et al.

It is certified that error appears in the above-identified patent and that said Letters Patent is hereby corrected as shown below:

COLUMN 37

Line 38, "particularly," should read --particularity,--.

COLUMN 40

Line 34, delete "is".

Signed and Sealed this

Fifteenth Day of February, 2000

*Attest:*

Q. TODD DICKINSON

*Attesting Officer*

*Commissioner of Patents and Trademarks*